US010811204B2

(12) United States Patent
Nakahata et al.

(10) Patent No.: US 10,811,204 B2
(45) Date of Patent: Oct. 20, 2020

(54) ELECTROMAGNETIC RELAY

(71) Applicant: PANASONIC INTELLECTUAL PROPERTY MANAGEMENT CO., LTD., Osaka (JP)

(72) Inventors: Atsushi Nakahata, Mie (JP); Yoshimasa Kato, Mie (JP); Machiko Nishiyama, Mie (JP); Hironori Hounoki, Mie (JP); Izumi Fujita, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 109 days.

(21) Appl. No.: 15/750,033

(22) PCT Filed: Jul. 28, 2016

(86) PCT No.: PCT/JP2016/003506

§ 371 (c)(1),
(2) Date: Feb. 2, 2018

(87) PCT Pub. No.: WO2017/022225

PCT Pub. Date: Feb. 9, 2017

(65) Prior Publication Data

US 2018/0247782 A1 Aug. 30, 2018

(30) Foreign Application Priority Data

Aug. 3, 2015 (JP) ..... 2015-153745
Aug. 3, 2015 (JP) ..... 2015-153749
Aug. 3, 2015 (JP) ..... 2015-153750

(51) Int. Cl.
*H01H 50/18* (2006.01)
*H01H 50/44* (2006.01)
(Continued)

(52) U.S. Cl.
CPC ..... *H01H 50/44* (2013.01); *H01H 50/02* (2013.01); *H01H 50/043* (2013.01);
(Continued)

(58) Field of Classification Search
CPC .. H01H 51/2236; H01H 50/44; H01H 50/043; H01H 50/24; H01H 50/02;
(Continued)

(56) References Cited

U.S. PATENT DOCUMENTS 9,305,730 B2 4/2016 Sasaki et al.
9,530,599 B2 12/2016 Yamagata et al.
(Continued)

FOREIGN PATENT DOCUMENTS

EP 2226827 A2 9/2010
JP S59-148225 A 8/1984
(Continued)

OTHER PUBLICATIONS

Search Report issued in European Patent Office (EPO) family member Patent Appl. No. 16832508.2, dated Sep. 25, 2018.
(Continued)

*Primary Examiner* — Ramon M Barrera
(74) *Attorney, Agent, or Firm* — Greenblum & Bernstein, P.L.C.

(57) ABSTRACT

An electromagnetic relay includes an armature, and a movable body configured to move in association with a swing of the armature. The armature includes a support portion opposed to a leg portion of an iron core, a magnetic pole opposed to another leg portion of the iron core, and an arm portion extending to connect the support portion and the magnetic pole. A movable body is attached to the arm portion and provided with a pressure projection for moving movable contacts. The pressure projection is located on a segment connecting the center of gravity of the support portion and the center of gravity of the magnetic pole.

21 Claims, 48 Drawing Sheets

(51) Int. Cl.

| | |
|---|---|
| ***H01H 50/04*** | (2006.01) |
| ***H01H 50/24*** | (2006.01) |
| ***H01H 51/22*** | (2006.01) |
| ***H01H 50/02*** | (2006.01) |
| ***H01H 50/36*** | (2006.01) |
| ***H01H 50/56*** | (2006.01) |

(52) U.S. Cl.
CPC ..... *H01H 50/24* (2013.01); *H01H 50/36* (2013.01); *H01H 50/56* (2013.01); *H01H 51/2236* (2013.01); *H01H 50/18* (2013.01); *H01H 2050/446* (2013.01)

(58) Field of Classification Search
CPC ..... H01H 50/36; H01H 50/56; H01H 50/18; H01H 2050/446
See application file for complete search history.

(56) References Cited

U.S. PATENT DOCUMENTS

| | | | | |
|---|---|---|---|---|
| 2003/0062977 | A1 | 4/2003 | Mochizuki | |
| 2009/0267715 | A1 | 10/2009 | Fukui et al. | |
| 2010/0225428 | A1* | 9/2010 | Fujimoto ..... | H01H 50/24 335/189 |
| 2017/0365431 | A1 | 12/2017 | Sakai et al. | |
| 2017/0365432 | A1 | 12/2017 | Sakai et al. | |
| 2018/0061599 | A1 | 3/2018 | Enomoto et al. | |
| 2018/0061600 | A1 | 3/2018 | Ito | |

FOREIGN PATENT DOCUMENTS

| | | | |
|---|---|---|---|
| JP | H05-002964 | A | 1/1993 |
| JP | 2005-183262 | A | 8/1998 |
| JP | H10-255630 | A | 9/1998 |
| JP | 2003-115248 | A | 4/2003 |
| JP | 10-214550 | A | 7/2005 |
| JP | 2013-218885 | A | 10/2013 |
| WO | 2007/023792 | A1 | 3/2007 |

OTHER PUBLICATIONS

U.S. Appl. No. 15/838,927 to Kazushige Daikoku et al., which was filed on Dec. 12, 2017.

U.S. Appl. No. 15/760,057 to Toshinori Fujimura et al., which was filed on Mar. 14, 2018.

International Search Report for WIPO Patent Application No. PCT/JP2016/003506, dated Oct. 18, 2016 , along with an English translation thereof.

* cited by examiner

ELECTROMAGNETIC RELAY

TECHNICAL FIELD

The present invention relates to an electromagnetic relay.

BACKGROUND ART

Electromagnetic relays are known that include a contact block including a fixed contact portion provided with a fixed contact and a movable contact portion provided with a movable contact brought into contact with and separated from the fixed contact, and a drive block for bringing the movable contact into contact with the fixed contact and separating the movable contact from the fixed contact (for example, refer to Patent Literature 1).

In Patent Literature 1, the drive block includes a coil block including an iron core having a body portion extending in the horizontal direction and a pair of leg portions extending downward from both ends of the body portion, a spool to which the iron core is fixed, and a coil wound on the spool provided with the iron core.

The drive block further includes an armature block which swings when the coil block is switched between an excitation state and a non-excitation state.

The armature block includes an armature extending in the horizontal direction, having one end and the other end opposed to the respective leg portions of the iron core, and configured to swing on the one end serving as an axis so that the other end comes close to and separates from the leg portion when the coil block is switched between the excitation state and the non-excitation state. The armature includes an arm body extending in the horizontal direction, a support portion formed at one end of the arm body in the horizontal direction to serve as the axis when the armature swings, and a magnetic pole formed at the other end of the arm body in the horizontal direction.

The armature block further includes a card which includes an operation projection brought into contact with the movable contact portion, and moves in association with the swing of the armature.

In Patent Literature 1, as described above, the armature swings to move the operation projection formed in the card when the coil block is switched between the excitation state and the non-excitation state, so that the movable contact is brought into contact with and separated from the fixed contact in association with the movement of the operation projection.

CITATION LIST

Patent Literature

Patent Literature 1: Japanese Patent Application Publication No. 2013-218885

SUMMARY OF INVENTION

Technical Problem

In the conventional electromagnetic relay, the support portion and the magnetic pole of the armature are each provided with an extending portion extending upward. The center of gravity of the support portion and the center of gravity of the magnetic pole in the armature are therefore located above the center of gravity of the arm body.

The operation projection of the card presses the arm body in the middle in the horizontal direction and in the middle in the vertical direction. Namely, the operation projection of the card presses a portion at substantially the same height as the center of gravity of the arm body.

The operation projection of the card in the conventional electromagnetic relay is thus configured to press the portion between the support portion and the magnetic pole and below the center of gravity of the support portion and the center of gravity of the magnetic pole.

This configuration may lift up the lower side of the armature when the armature swings and the operation projection of the card then presses the arm body. If the lower side of the armature is lifted up, the armature may be prevented from swinging smoothly.

In addition, the operation projection of the card in the conventional electromagnetic relay presses the middle of the arm body in the vertical direction at a portion shifted from the center in the horizontal direction toward the support portion.

Since the operation projection of the card in the conventional electromagnetic relay presses the arm body at the portion shifted from the center in the horizontal direction toward the support portion, the force acting on the support portion to move away from the iron core is larger than the force acting on the magnetic pole to move away from the iron core when the pressure force of the operation projection acts on the armature. As a result, the lower side of the armature may be lifted up, which may prevent the armature from swinging smoothly.

Further, in the conventional electromagnetic relay, the contact block including the fixed contact and the movable contact brought into contact with and separated from the fixed contact, and the drive block for bringing the movable contact into contact with the fixed contact and separating the movable contact from the fixed contact, are both fixed to a base.

The support portion of the armature is provided with shaft portions extending in both upper and lower directions. The lower shaft portion is fixed to a bearing provided in the base, and the upper shaft portion is fixed to a bearing provided in the spool, so that the armature swings on the support portion serving as an axis.

Namely, in the conventional electromagnetic relay, the support portion of the armature is positioned by both the base and the coil frame. Thus, unevenness caused by dimensional errors may increase, which prevents stability of swing strokes of the armature to result in an unstable operation of the electromagnetic relay accordingly.

It is thus difficult to improve the operational stability of the conventional electromagnetic relay.

It is an object of the present invention to provide an electromagnetic relay capable of achieving improved operational stability.

Solution to Problem

An electromagnetic relay according to the present invention includes: a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact.

The drive block includes an iron core including a body portion extending in one direction, and leg portions extending downward from both ends in an extending direction of the body portion in a state in which the extending direction of the body portion conforms to a horizontal direction. The drive block further includes a coil frame to which the iron core is fixed, and a coil wound on the body portion of the iron core with the coil frame interposed therebetween. The drive block further includes an armature arranged across the iron core from one leg portion to another leg portion and configured to swing on one end serving as an axis, and a movable body configured to move in association with a swing of the armature.

The armature includes: a support portion opposed to the one leg portion of the iron core to serve as the axis; a magnetic pole opposed to the other leg portion of the iron core; and an arm portion extending to connect the support portion and the magnetic pole and configured to cause the magnetic pole to swing on the support portion so as to come close to and separate from the other leg portion of the iron core.

The movable body is attached to the arm portion and provided with a pressure projection for moving the movable contact.

The pressure projection is located on a segment connecting a center of gravity of the support portion and a center of gravity of the magnetic pole.

The following electromagnetic relay may also be applicable.

The electromagnetic relay includes: a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact.

The drive block includes an iron core including a body portion extending in one direction, and leg portions extending downward from both ends in an extending direction of the body portion in a state in which the extending direction of the body portion conforms to a horizontal direction. The drive block further includes a coil frame to which the iron core is fixed, and a coil wound on the body portion of the iron core with the coil frame interposed therebetween. The drive block further includes an armature arranged across the iron core from one leg portion to another leg portion and configured to swing on one end serving as an axis, and a movable body configured to move in association with a swing of the armature.

The armature includes: a support portion opposed to the one leg portion of the iron core to serve as the axis; a magnetic pole opposed to the other leg portion of the iron core; and an arm portion extending to connect the support portion and the magnetic pole and configured to cause the magnetic pole to swing on the support portion so as to come close to and separate from the other leg portion of the iron core.

The movable body is attached to the arm portion and provided with a pressure projection for moving the movable contact.

The pressure projection is located on a segment connecting a center of magnetic force of the support portion and a center of magnetic force of the magnetic pole.

The following electromagnetic relay may also be applicable.

The electromagnetic relay includes: a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact.

The drive block includes an iron core including a body portion extending in one direction, and leg portions extending downward from both ends in an extending direction of the body portion in a state in which the extending direction of the body portion conforms to a horizontal direction. The drive block further includes a coil frame to which the iron core is fixed, and a coil wound on the body portion of the iron core with the coil frame interposed therebetween. The drive block further includes an armature arranged across the iron core from one leg portion to another leg portion and configured to swing on one end serving as an axis, and a movable body configured to move in association with a swing of the armature.

The armature includes: a support portion opposed to the one leg portion of the iron core to serve as the axis; a magnetic pole opposed to the other leg portion of the iron core; and an arm portion extending to connect the support portion and the magnetic pole and configured to cause the magnetic pole to swing on the support portion so as to come close to and separate from the other leg portion of the iron core.

The movable body is attached to the arm portion and provided with a pressure projection for moving the movable contact.

The pressure projection is located at a position shifted from a center of the armature in the horizontal direction toward the magnetic pole in a side view in a state in which an extending direction of the arm portion conforms to the horizontal direction and a width direction of the arm portion conforms to a vertical direction.

The following electromagnetic relay may also be applicable.

The electromagnetic relay includes: a contact block including a fixed contact and a movable contact brought into contact with and separated from the fixed contact; a drive block configured to bring the movable contact into contact with the fixed contact and separate the movable contact from the fixed contact; and a base to which the contact block and the drive block are fixed.

The drive block includes an iron core including a body portion extending in one direction, and leg portions extending downward from both ends in an extending direction of the body portion in a state in which the extending direction of the body portion conforms to a horizontal direction. The drive block further includes: a coil frame to which the iron core is fixed; a coil wound on the body portion of the iron core with the coil frame interposed therebetween; and an armature arranged across the iron core from one leg portion to another leg portion and configured to swing on one end serving as an axis.

The armature includes: a support portion opposed to the one leg portion of the iron core to serve as the axis; a magnetic pole opposed to the other leg portion of the iron core; and an arm portion extending to connect the support portion and the magnetic pole and configured to cause the magnetic pole to swing on the support portion so as to come close to and separate from the other leg portion of the iron core.

The support portion is positioned by the one leg portion of the iron core and a positioning portion provided in at least one of the coil frame and the base.

Advantageous Effects

The present disclosure can provide an electromagnetic relay capable of achieving improved operational stability.

BRIEF DESCRIPTION OF DRAWINGS

FIG. 1 FIGS. 1A and 1B are views showing an electromagnetic relay according to a first embodiment of the present invention. FIG. 1A is a perspective view of the electromagnetic relay as viewed in one direction, and FIG. 1B is a perspective view of the electromagnetic relay as viewed in another direction.

FIG. 4A is a perspective view of the electromagnetic relay as viewed in one direction, and FIG. 4B is a perspective view of the electromagnetic relay as viewed in another direction.

FIG. 5A is a perspective view of the drive block as viewed in one direction, and FIG. 5B is a perspective view of the drive block as viewed in another direction.

FIG. 10A is a perspective view of the coil frame as viewed in one direction, and FIG. 10B is a perspective view of the coil frame as viewed in another direction.

FIG. 12A is a side view of the coil frame as viewed in the direction in which the iron core is inserted, and FIG. 12B is a side view of the coil frame as viewed on the side from which a coil wound portion projects.

FIG. 16A is an exploded perspective view of the armature block as viewed in one direction, and FIG. 16B is an exploded perspective view of the armature block as viewed in another direction.

FIG. 17A is a side view of the armature block as viewed from the pressure projection side, and FIG. 17B is a side view of the armature block as viewed from the recess side.

FIG. 19A is a perspective view of the iron core and the armature block as viewed in one direction, and FIG. 19B is a perspective view of the iron core and the armature block as viewed in another direction.

FIG. 23A is a perspective view of the contact block as viewed in one direction, and FIG. 23B is a perspective view of the contact block as viewed in another direction.

FIG. 24A is a view showing the movable contact portion in a free state before fixation, and FIG. 24B is a view showing the movable contact portion after fixation in a state in which the drive block is not driven.

FIG. 30A is a perspective view, FIG. 30B is a side view as viewed from the drive block housing space side, and FIG. 30C is a plan view.

DESCRIPTION OF EMBODIMENTS

Figure 1A:
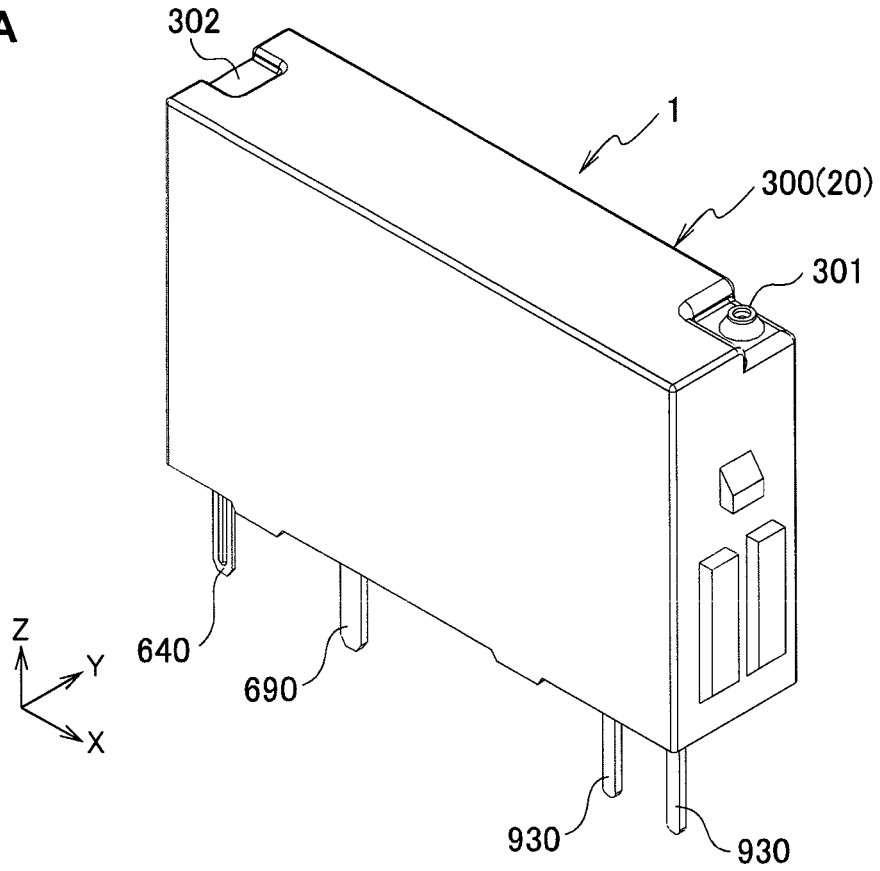

Embodiments of the present invention will be described in detail below with reference to the drawings. Hereinafter, the longitudinal direction of an electromagnetic relay is defined as a front-rear direction X, the short-side direction of the electromagnetic relay is defined as a width direction Y, and the thickness direction of the electromagnetic relay is defined as a vertical direction Z.

The following embodiments include similar elements. The similar elements are denoted by the common reference numerals, and overlapping explanations are not repeated below.

First Embodiment

Figure 1B:
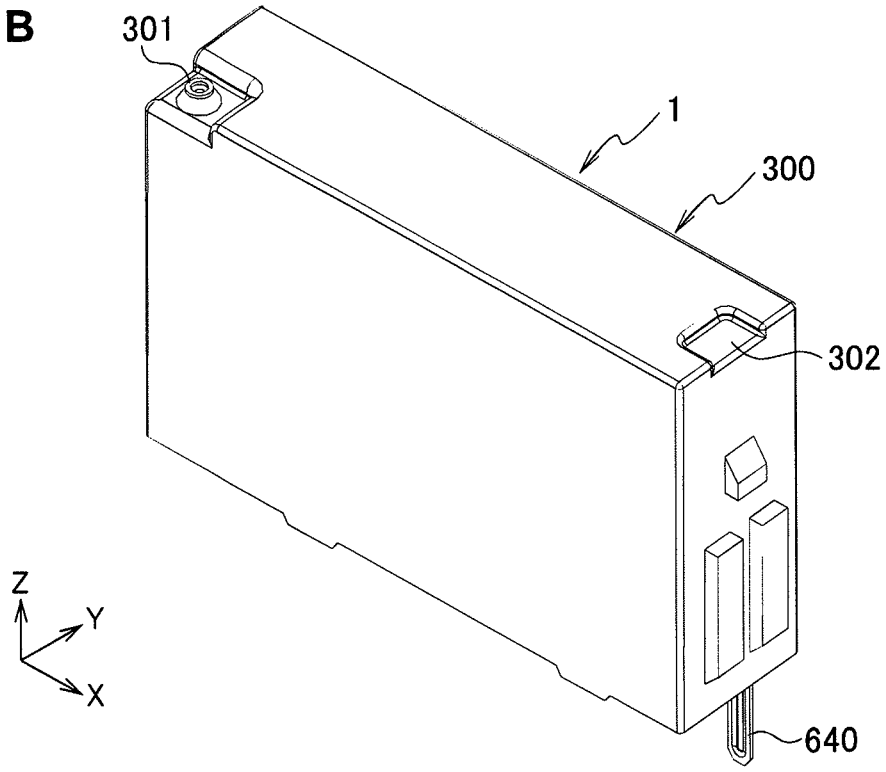
Figure 2:
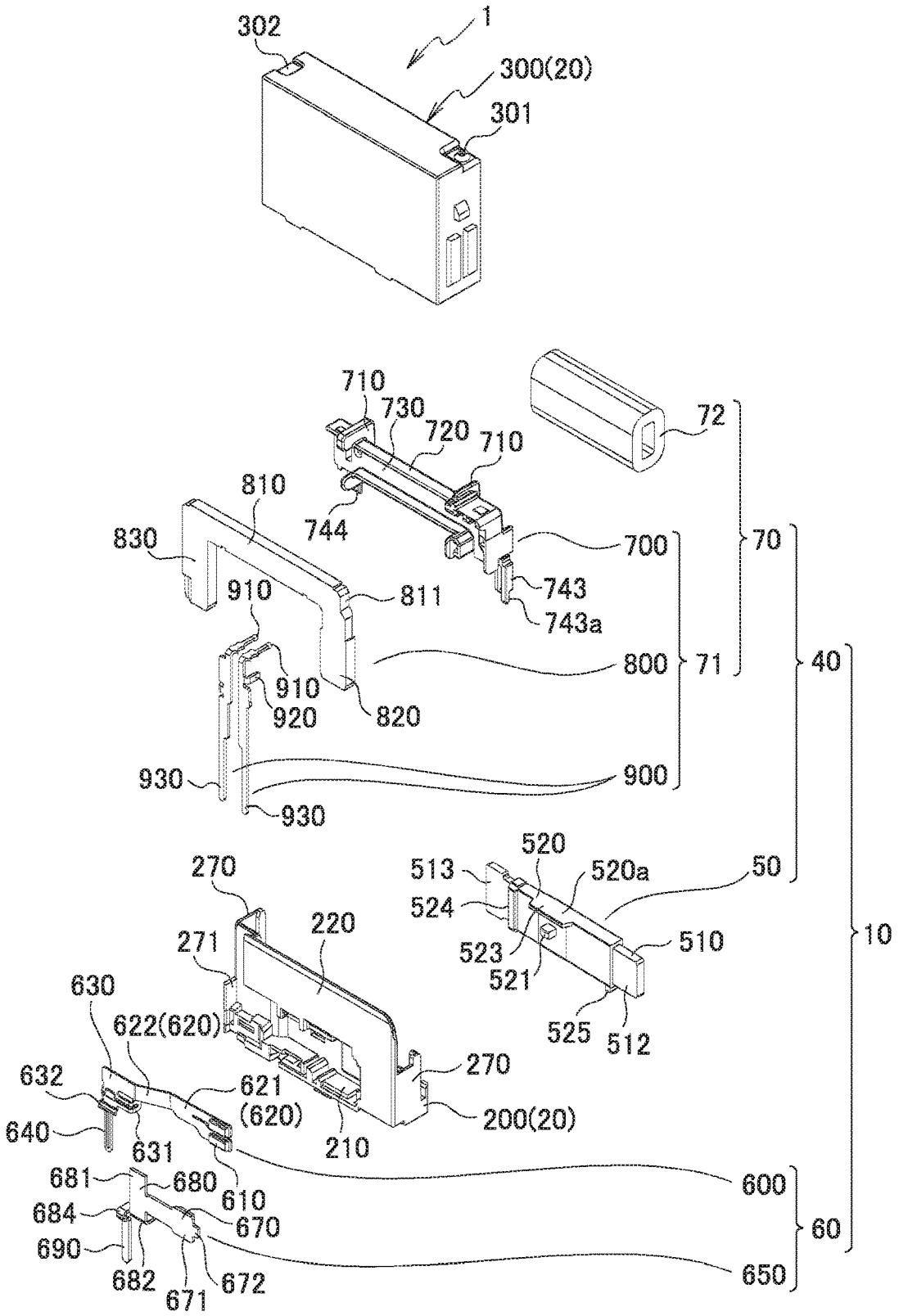
FIG. 2 is an exploded perspective view of the electromagnetic relay according to the first embodiment of the present invention as viewed in one direction.
Figure 3:
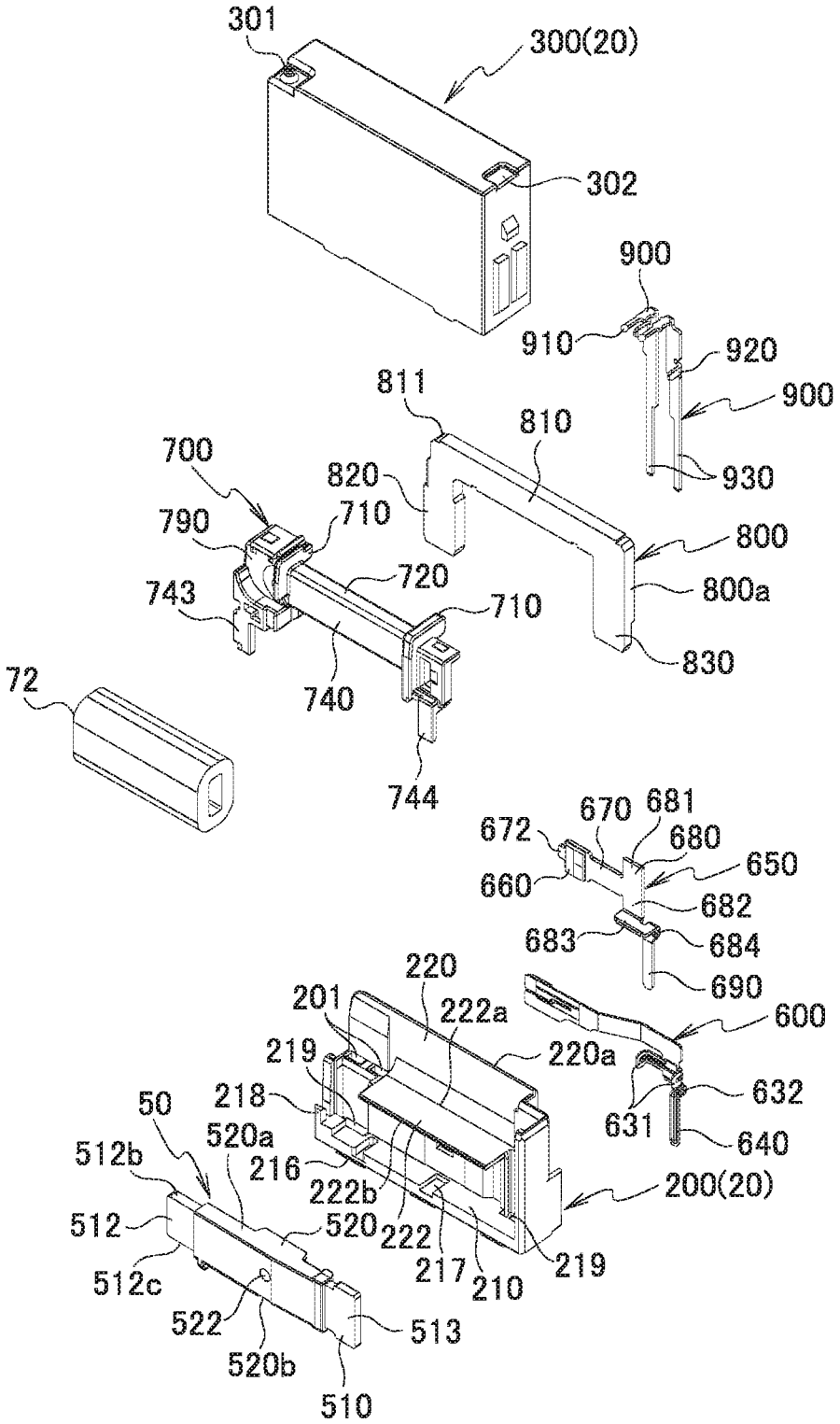
FIG. 3 is an exploded perspective view of the electromagnetic relay according to the first embodiment of the present invention as viewed in another direction.

An electromagnetic relay 1 according to the present embodiment includes a housing 20 having a substantially rectangular parallelepiped, as shown in FIGS. 1A, 1B and FIG. 2.

The housing 20 includes a base 200 made from a resin material to which a contact device 10 is fixed, and a cover 300 made from a resin material and having a substantially box-like shape with one side open so as to cover the base 200 to which the contact device 10 is fixed.

The base 200 is covered with the cover 300 so that the contact device 10 is housed in the housing 20.

The contact device 10 includes a contact block 60 including a fixed contact 660 and movable contacts 610 brought into contact with and separated from the fixed contact 660, and a drive block 40 for bringing the movable contacts 610 into contact with the fixed contact 660 and separating the movable contacts 610 from the fixed contact 660.

The housing 20 houses the contact block 60 including the fixed contact 660 and the movable contacts 610 brought into contact with and separated from the fixed contact 660, and the drive block 40 for bringing the movable contacts 610 into contact with the fixed contact 660 and separating the movable contacts 610 from the fixed contact 660.

Figure 4A:
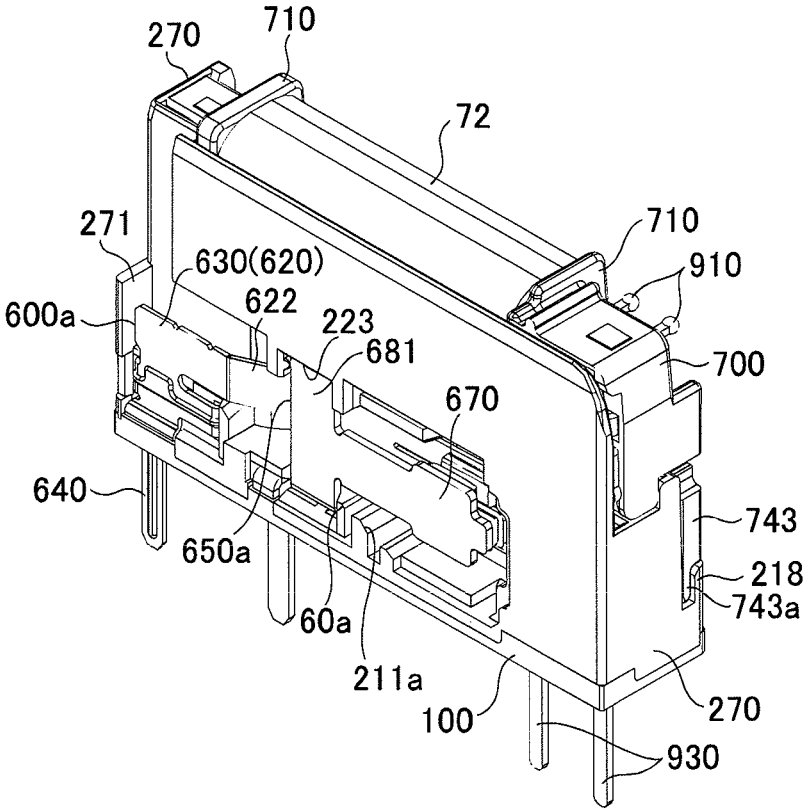
FIGS. 4A and 4B are views showing the electromagnetic relay according to the first embodiment of the present invention with a cover removed.
Figure 4B:
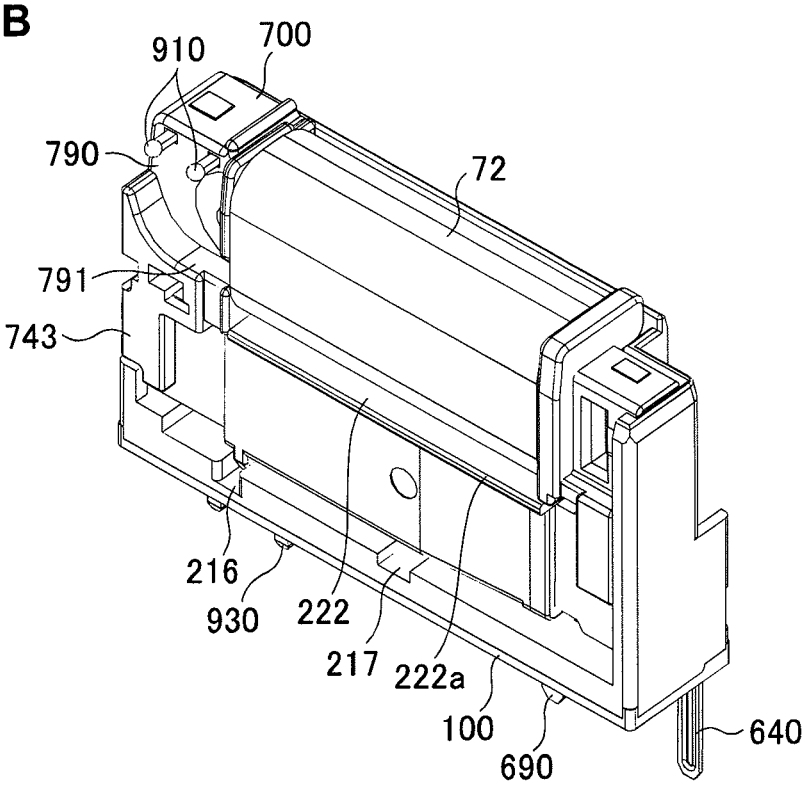
Figure 5A:
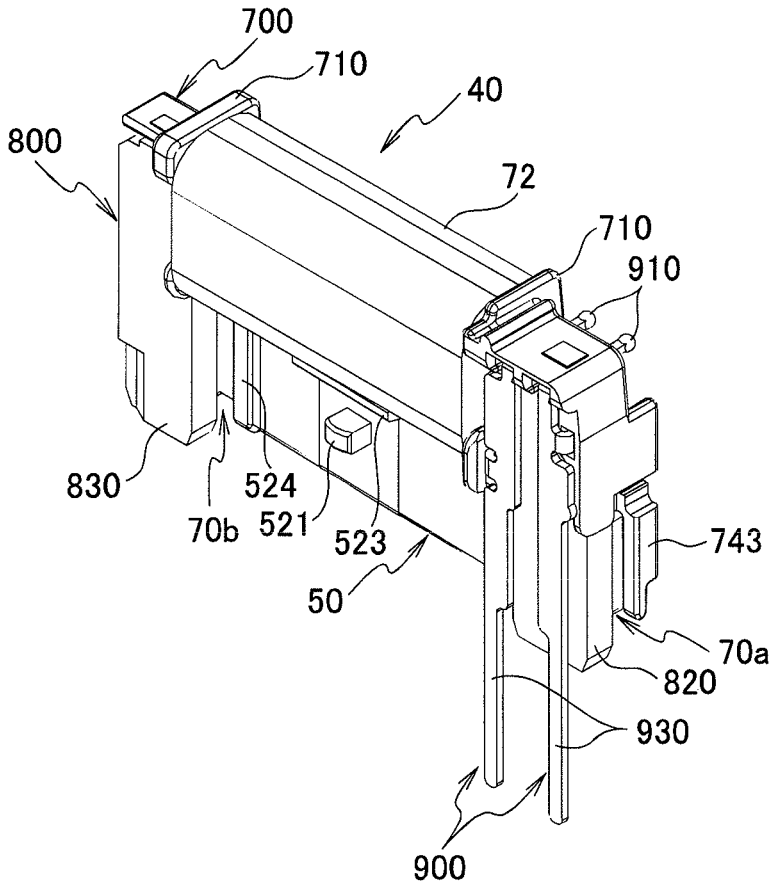
FIGS. 5A and 5B are views showing a drive block according to the first embodiment of the present invention.
Figure 5B:
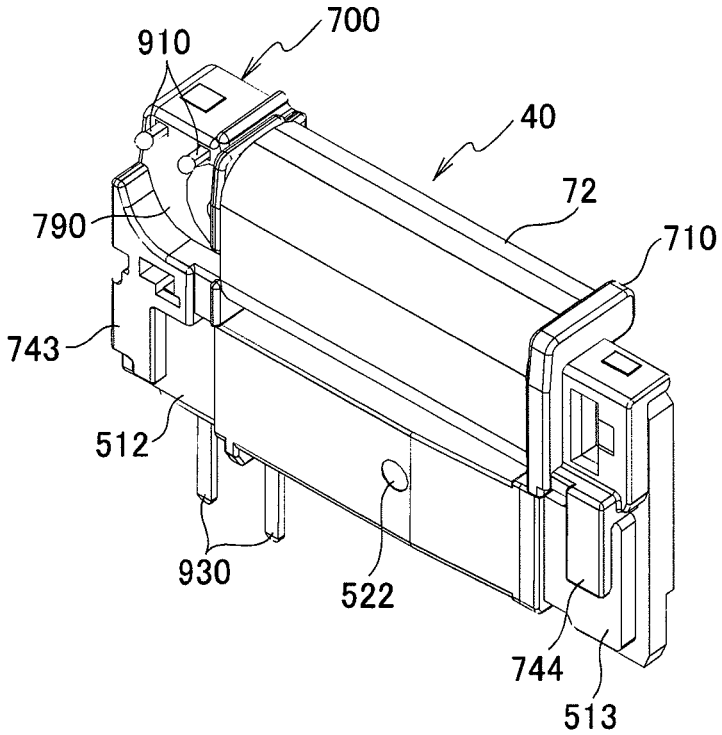

In a state in which the base 200 to which the contact device 10 is fixed is covered with the cover 300, an adhesive 100 is applied to the rear surface side of the base 200, so that the contact device 10 is fixed to the base 200, and the base 200 and the cover 300 are fixed together (refer to FIGS. 4A and 4B).

In the present embodiment, the cover 300 is provided, on the top wall, with a hole 301 for heat sealing, and a recess 302 for preventing defects derived from a gate during molding of the cover 300.

As shown in FIG. 2, the drive block 40 includes a coil block 70 which includes a coil 72 and an iron core 800 made from a magnetic material on which the coil 72 is wound and causes the iron core 800 to operate as an electromagnet when a current is applied to the coil 72, and an armature block 50 which swings when the iron core 800 operates as the electromagnet.

In the present embodiment, the base 200 is provided, on a bottom base portion 210, with an isolation wall 220 extending substantially in the X direction and extending upward in the Z direction. The contact block 60 and the drive block 40 are fixed to the base 200 in a state in which the contact block 60 and the drive block 40 are isolated from each other and insulated by the isolation wall 220.

Figure 28:
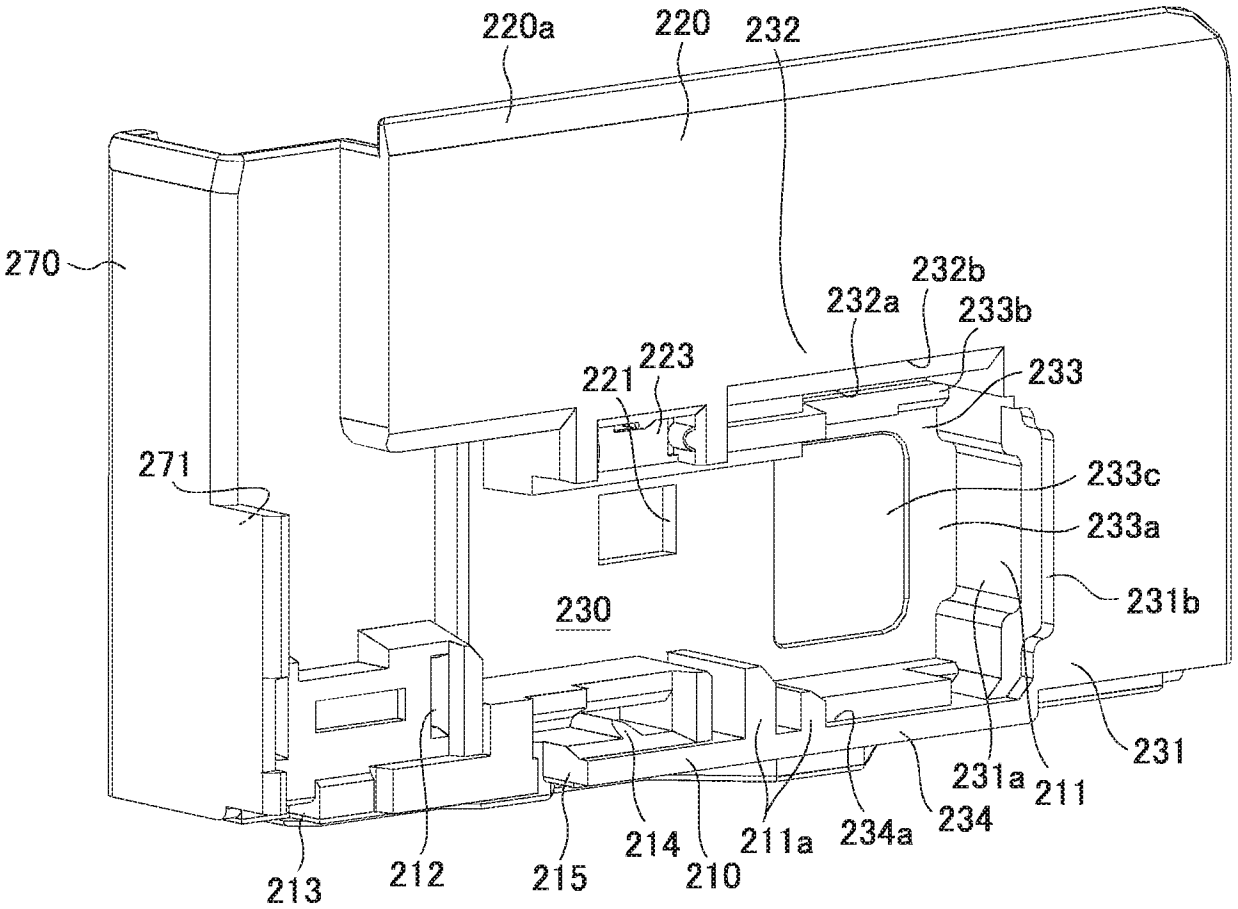
FIG. 28 is a perspective view showing a contact block housing space of the base according to the first embodiment of the present invention.
Figure 29:
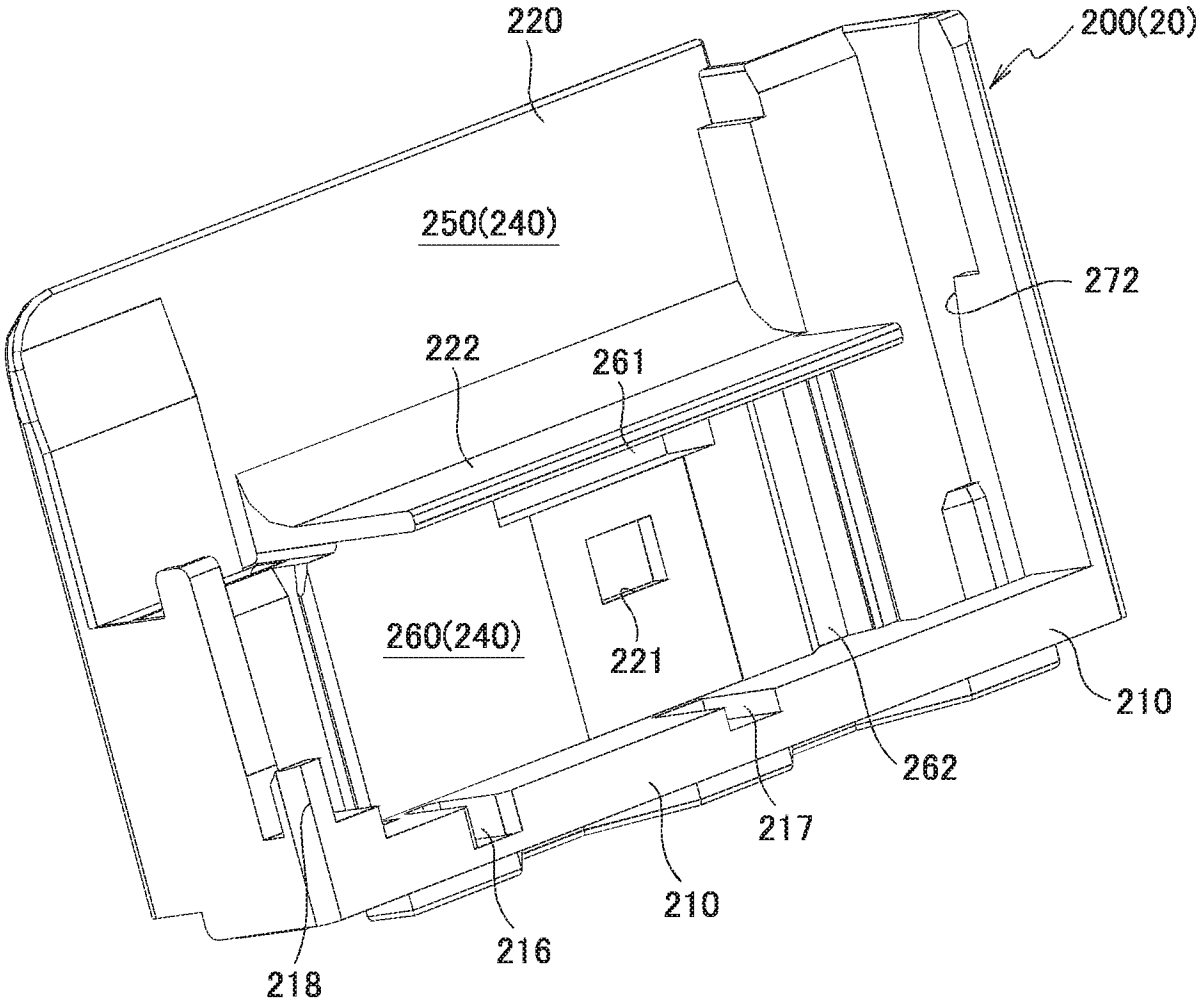
FIG. 29 is a perspective view showing a drive block housing space of the base according to the first embodiment of the present invention.

The inside of the housing 20 is divided into two spaces in the Y direction by the isolation wall 220 extending substantially in the X direction so as to define a contact block housing space 230 and a drive block housing space 240 (refer to FIG. 28 and FIG. 29).

The isolation wall 220 is provided with a partition wall 222 extending substantially in the X direction and projecting in the Y direction on the drive block housing space 240 side.

The coil 72 of the coil block 70 and the armature block 50 are fixed to the base 200 in a state in which the coil 72 and the armature block 50 are isolated from each other and insulated by the partition wall 222.

The drive block housing space 240 is divided into a coil housing space 250 and an armature block housing space 260 by the partition wall 222.

In the present embodiment, the inside of the housing 20 is thus divided mainly into the three spaces (the contact block housing space 230, the col housing space 250, and the armature block housing space 260). The contact block 60, the coil block 70, and the armature block 50 are housed in the corresponding spaces.

Figure 6:
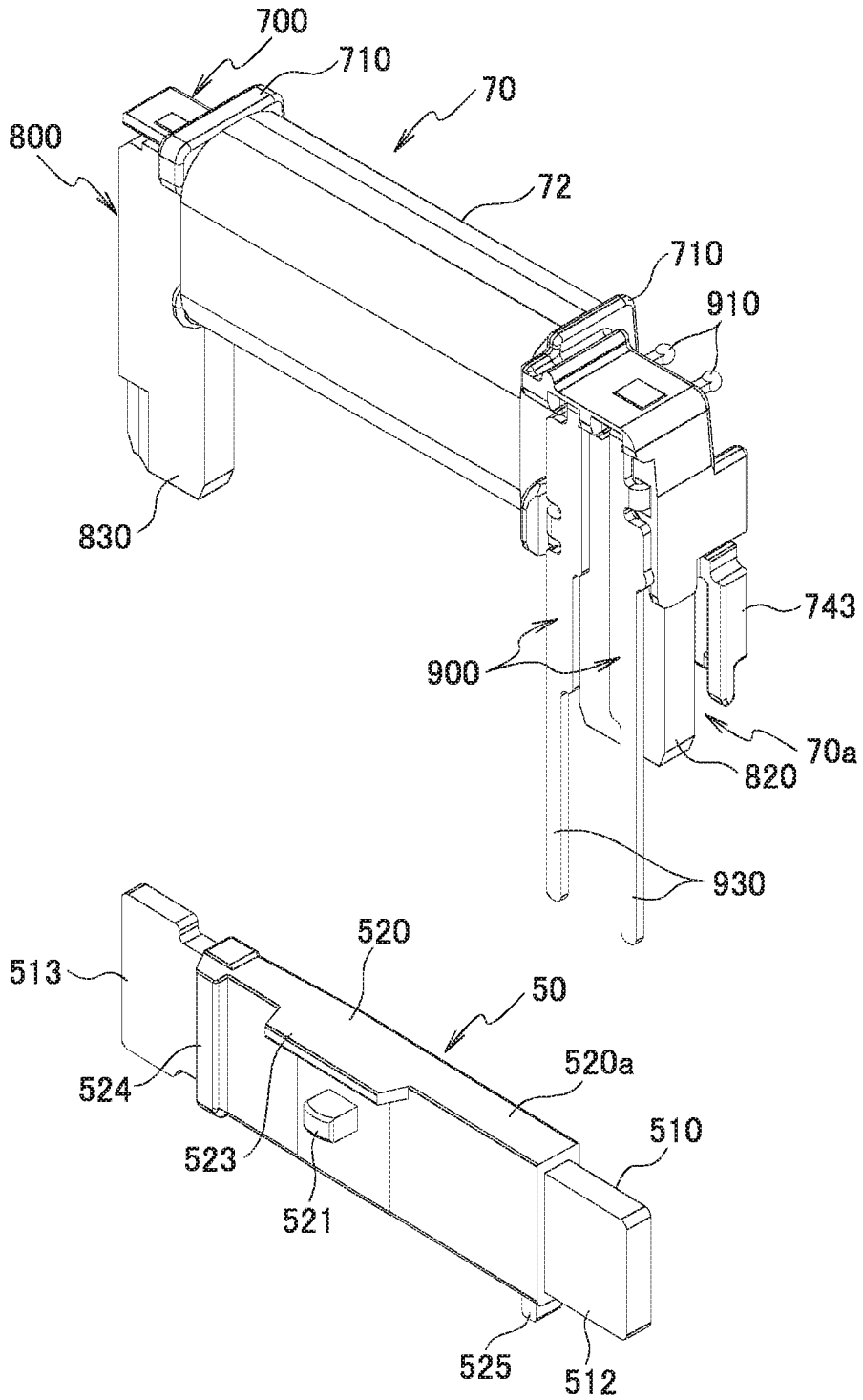
FIG. 6 is a perspective view of the drive block divided into a coil block and an armature block according to the first embodiment of the present invention as viewed in one direction.
Figure 7:
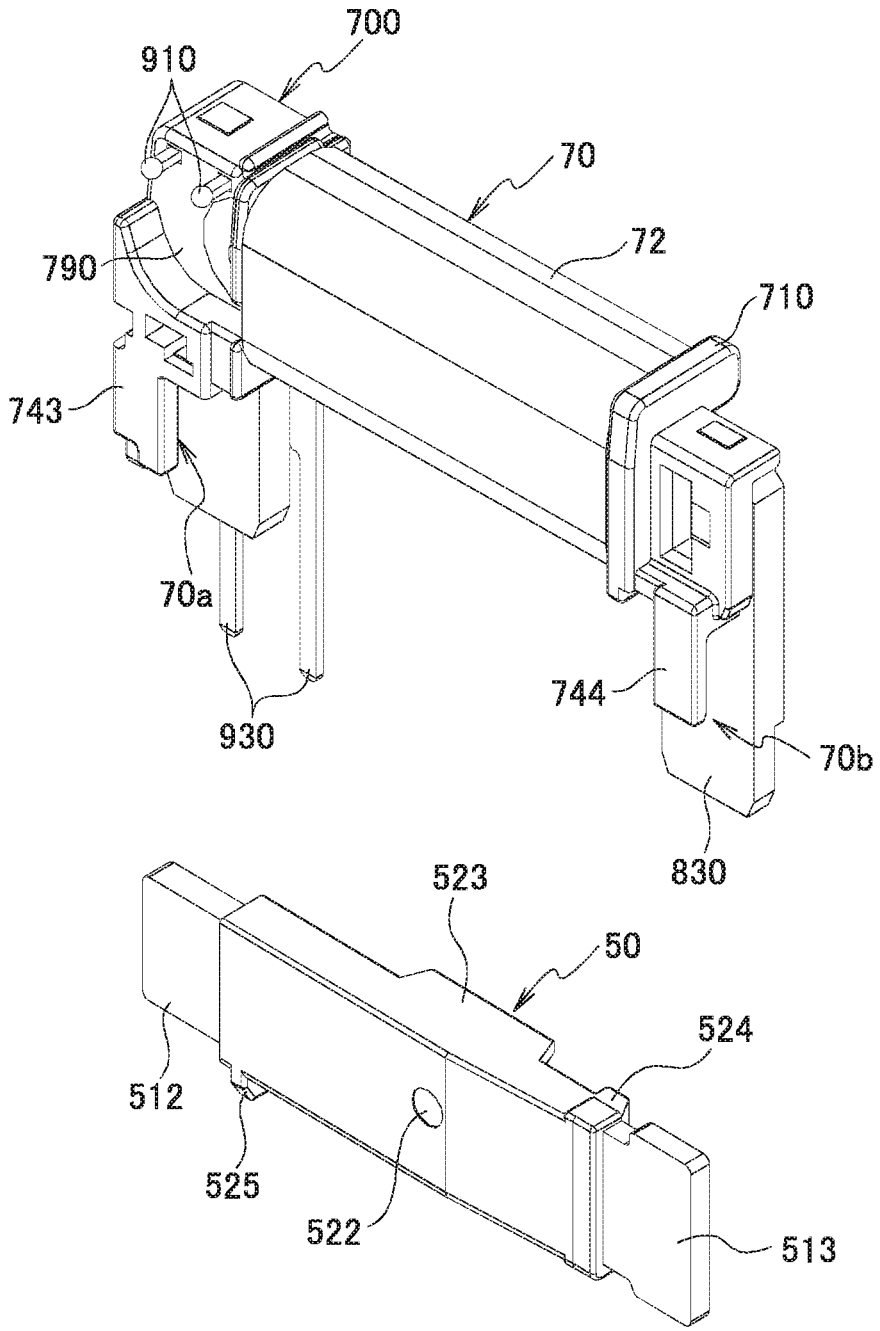
FIG. 7 is a perspective view of the drive block divided into the coil block and the armature block according to the first embodiment of the present invention as viewed in another direction.
Figure 8:
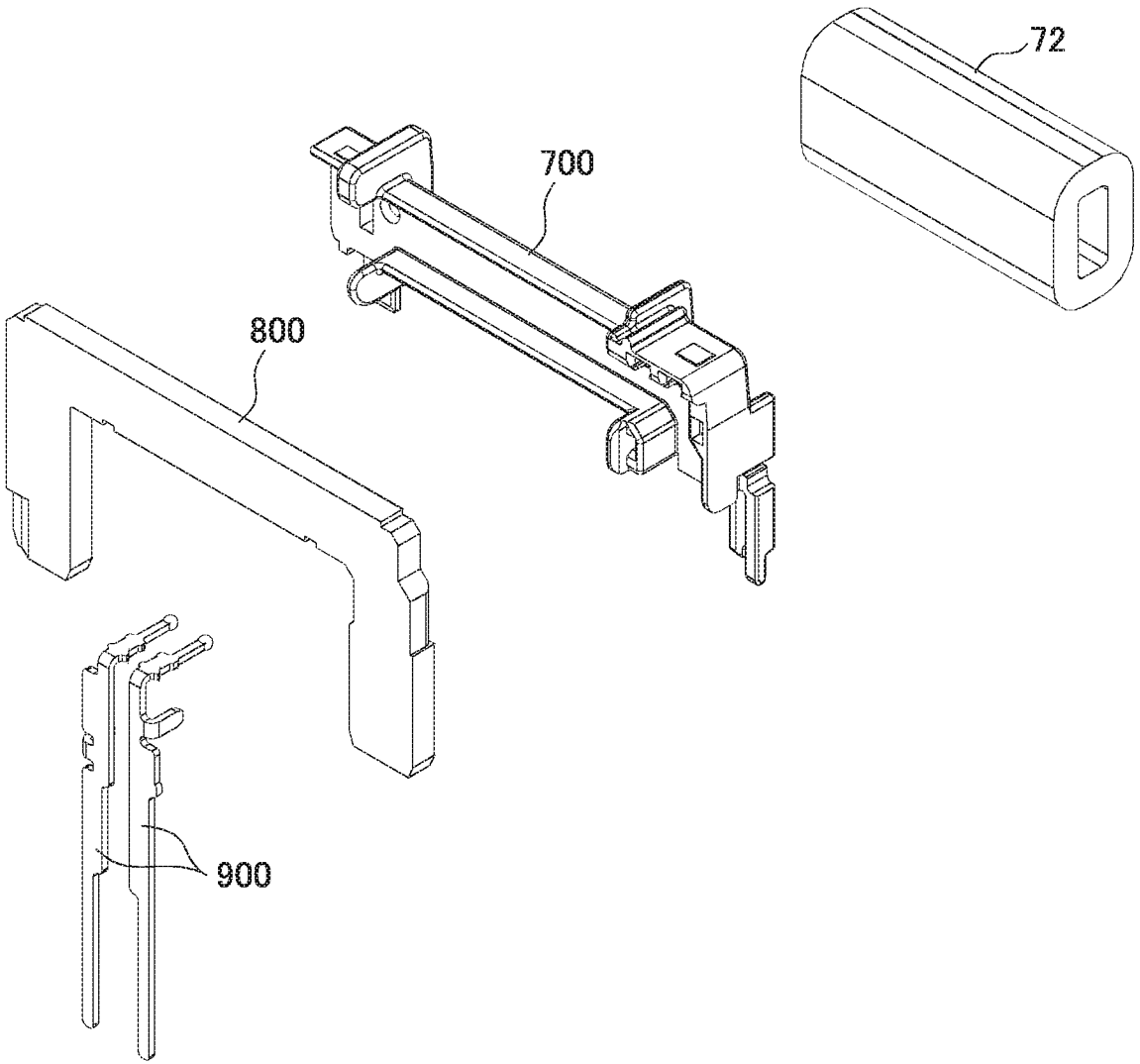
FIG. 8 is an exploded perspective view of the coil block according to the first embodiment of the present invention as viewed in one direction.
Figure 9:
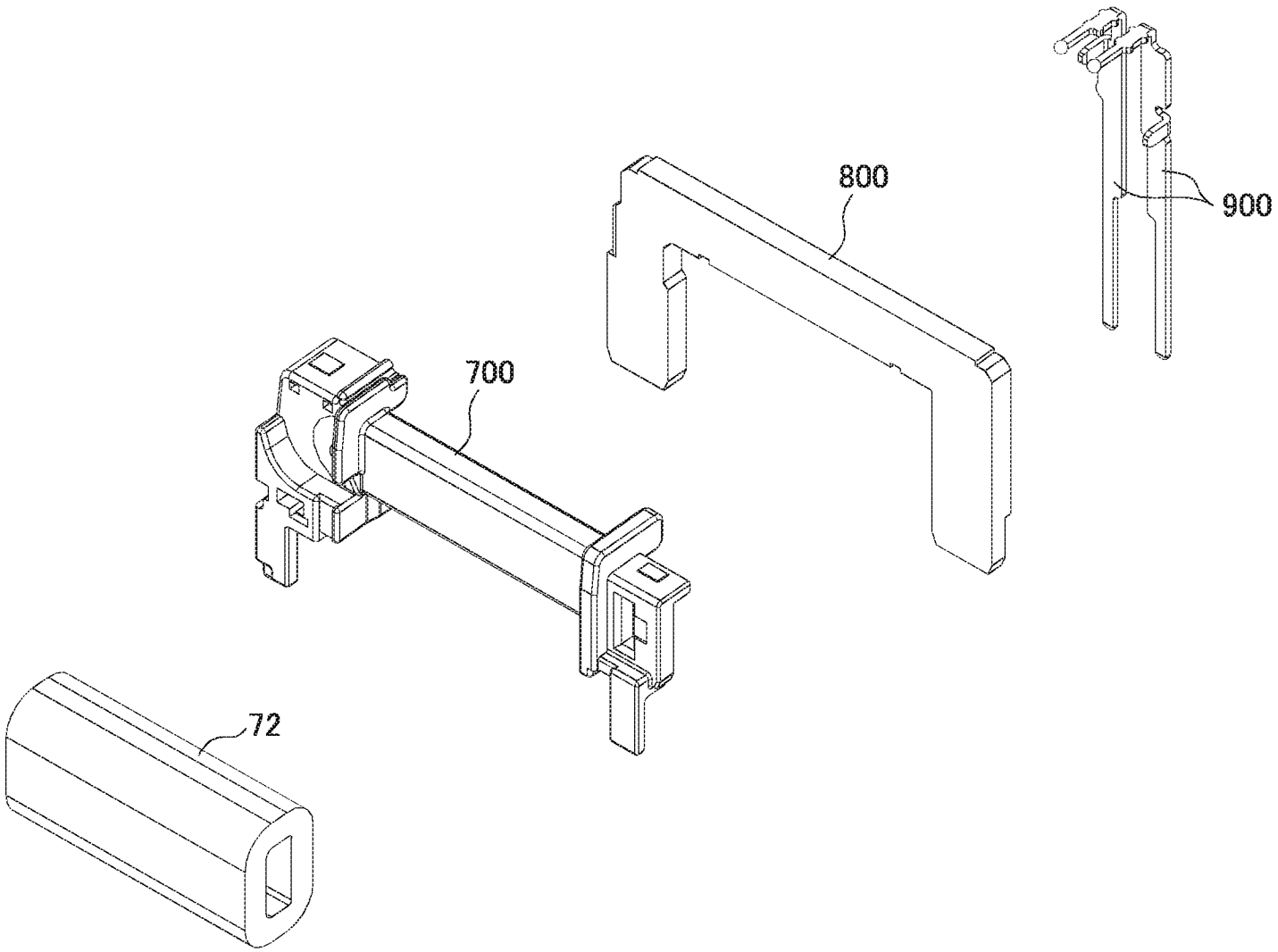
FIG. 9 is an exploded perspective view of the coil block according to the first embodiment of the present invention as viewed in another direction.
Figure 10A:
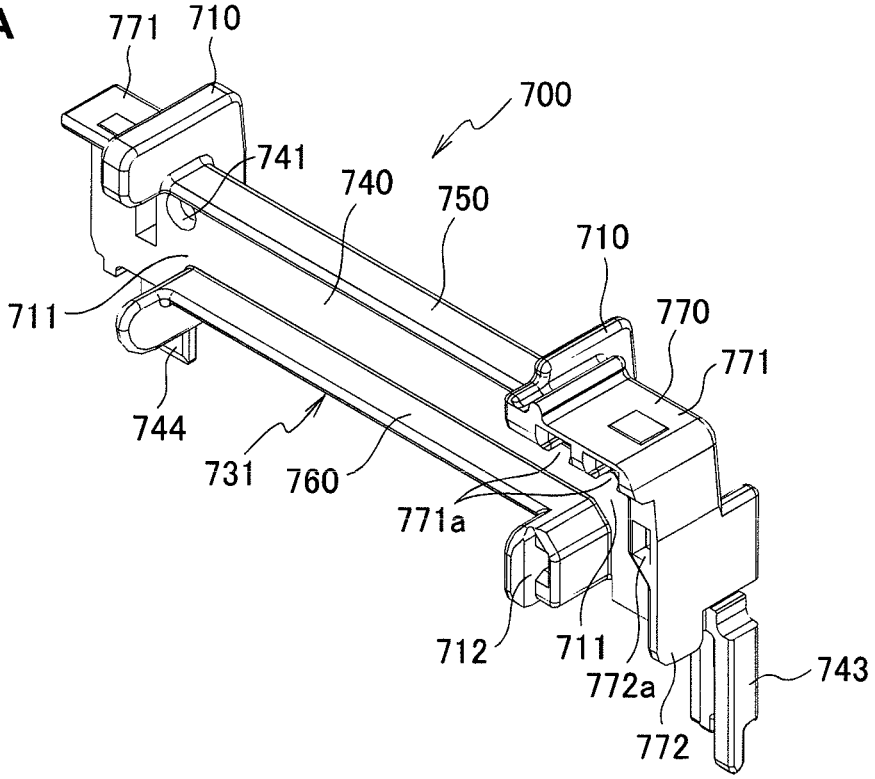
FIGS. 10A and 10B are views showing a coil frame according to the first embodiment of the present invention.
Figure 10B:
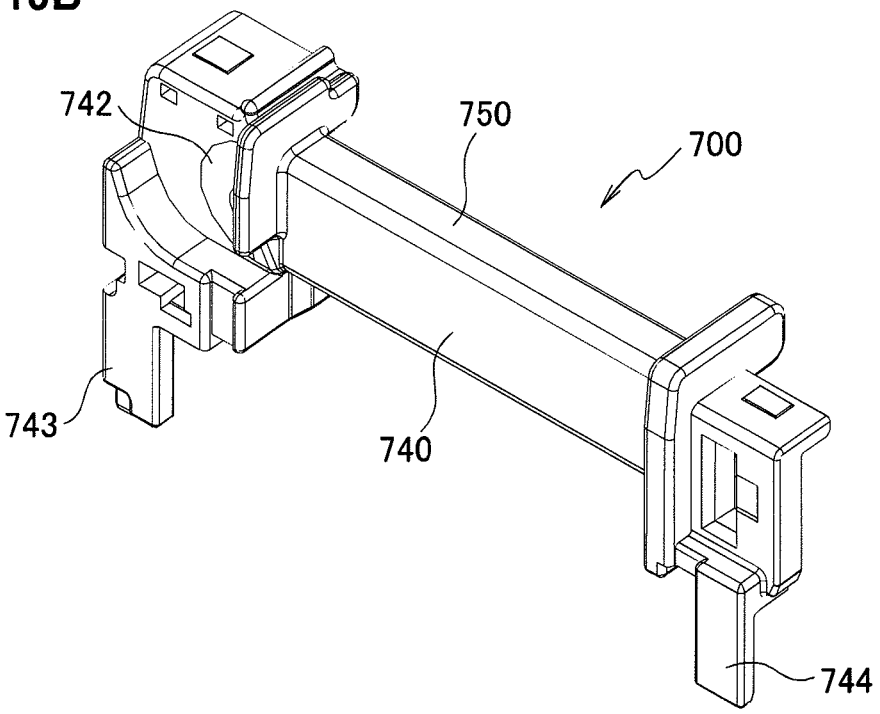
Figure 11:
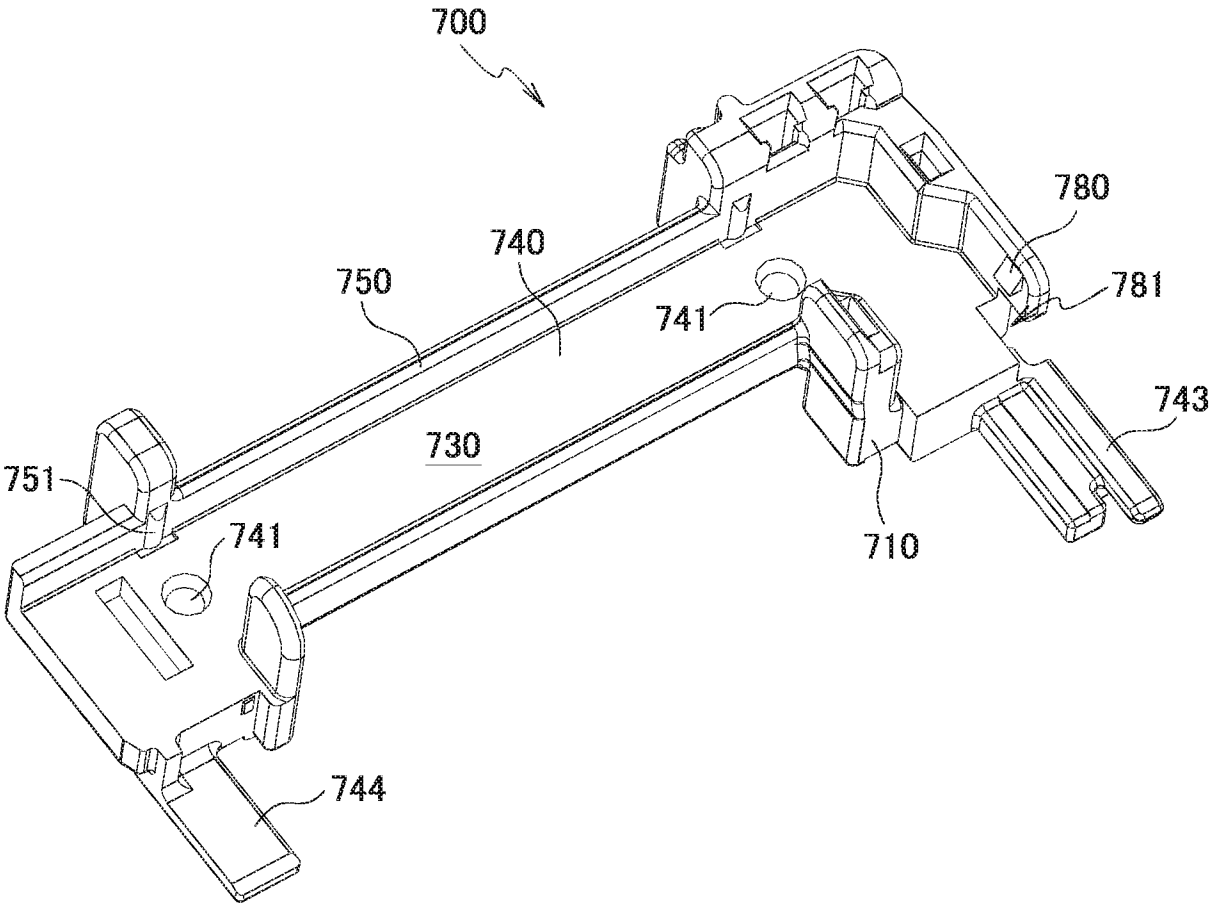
FIG. 11 is a perspective view of the coil frame according to the first embodiment of the present invention as viewed in a direction in which an iron core is inserted.
Figure 12A:
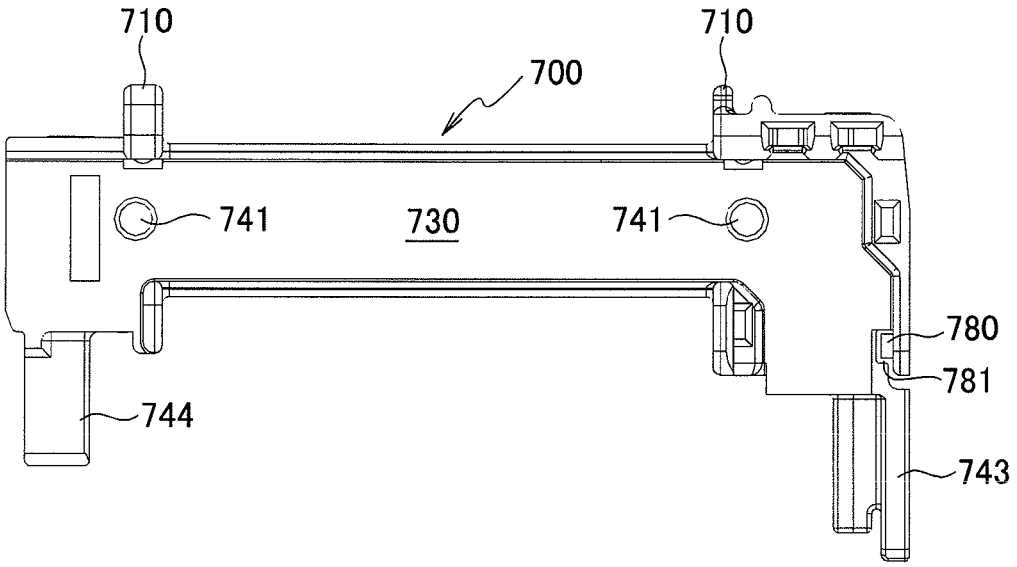
FIGS. 12A and 12B are views showing the coil frame according to the first embodiment of the present invention.
Figure 12B:
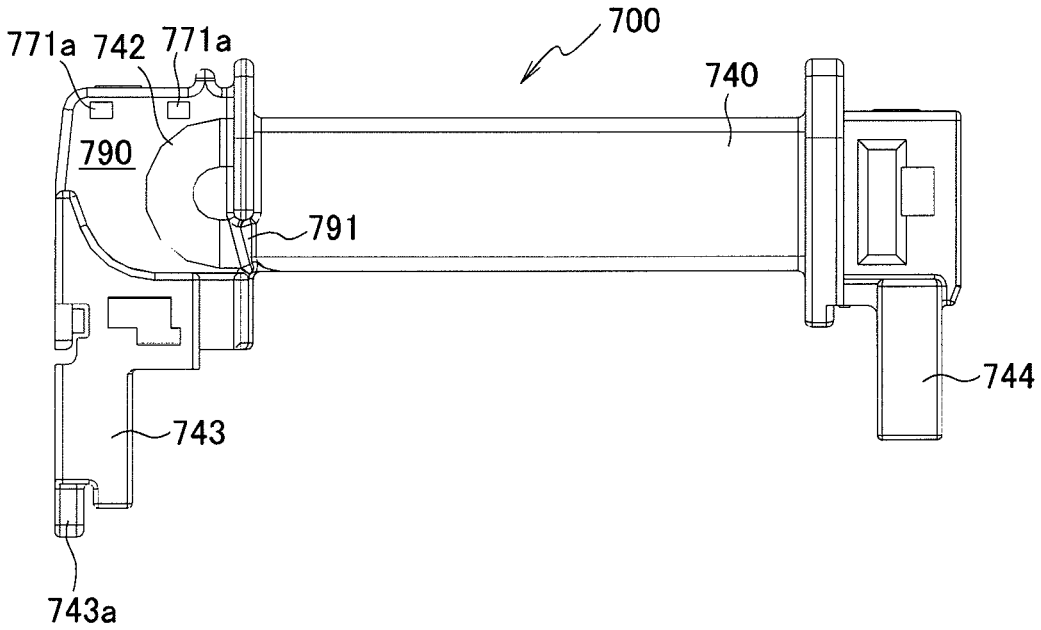
Figure 14:
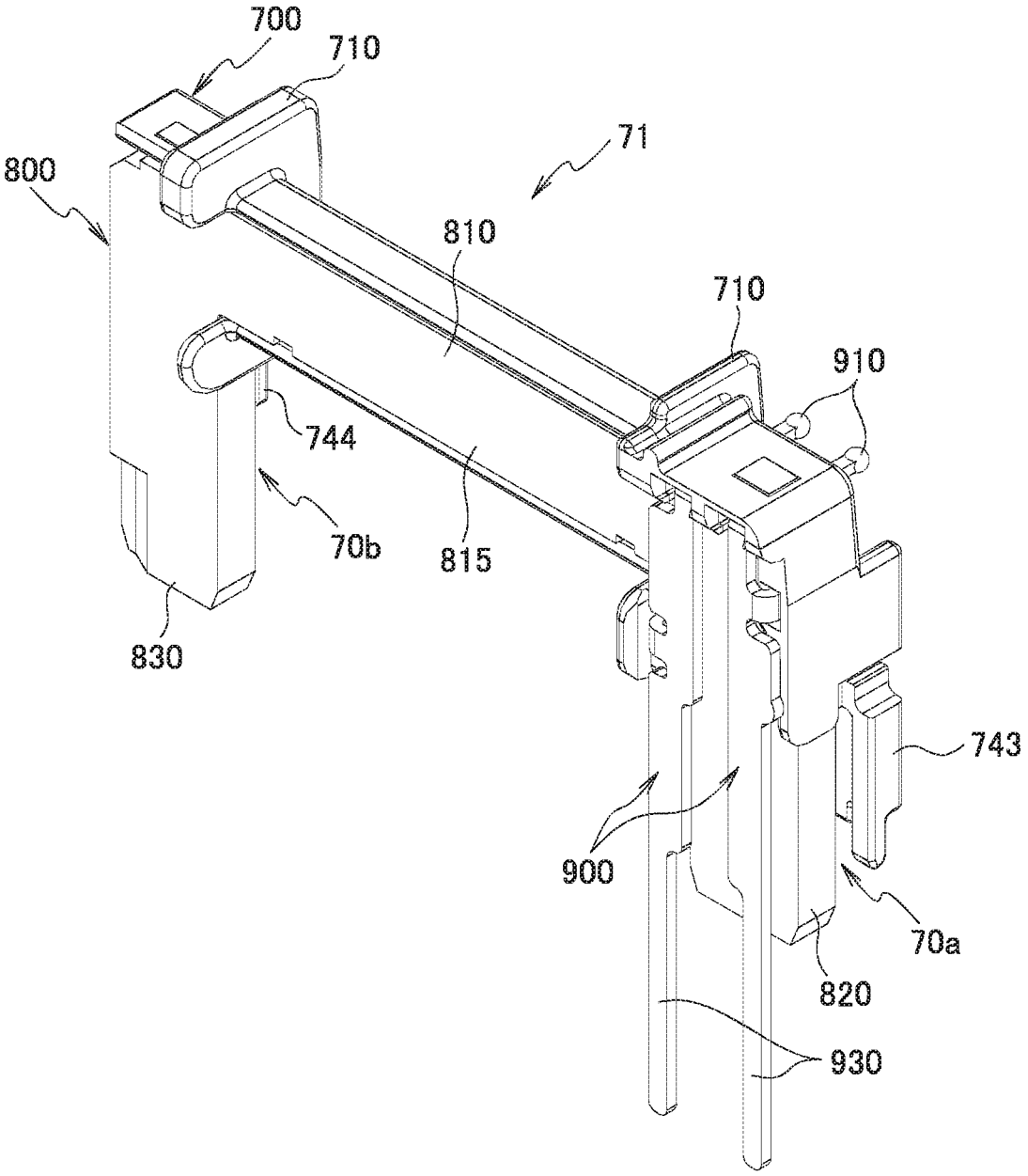
FIG. 14 is a perspective view of a coil frame block according to the first embodiment of the present invention as viewed in one direction.

In the present embodiment, the coil block 70 includes a coil frame block 71 and the coil 72 wound on the coil frame block 71 (refer to FIG. 6, FIG. 7, and FIG. 14).

The coil frame block 71 includes the iron core 800 including a body portion 810 extending in the X direction (in one direction) and leg portions 820 and 830 extending downward from both ends of the body portion 810 in a state in which the extending direction of the body portion 810 conforms to the horizontal direction (the X direction).

The iron core 800 is a thin plate having a substantially C-shape punched out from a plate-like magnetic material, for example.

The coil frame block 71 includes a coil frame 700 to which the iron core 800 is fixed. The coil frame block 71 further includes a plurality of (two in the present embodiment) coil terminals 900, each coil terminal 900 being electrically connected to the coil 72 at one end and projecting downward from the housing 20 in the Z direction at the other end. The coil terminals 900 are electrically connected to an external power source or the like so that a current is applied to the coil 72 via the coil terminals 900.

As shown in FIG. 10A to FIG. 12B, the coil frame 700 includes a body portion 720 extending in the X direction on which the coil 72 is wound, and flanges 710 provided at both ends of the body portion 720 in the X direction.

The coil frame 700 is provided with an opening 731 on one side in the Y direction (on the isolation wall 220 side in a state in which the coil block 70 is fixed to the base 200), and a groove 730 in which the iron core 800 is inserted.

The groove 730 is defined by a base wall 740 extending in the X direction and the Z direction and having a substantially C-shape as viewed in the Y direction, an upper wall 750 connected to the upper side of the base wall 740 and projecting in one direction in the Y direction, a lower wall 760 connected to the lower side of the base wall 740 and projecting in one direction in the Y direction, and extension walls 770 extending on both sides of the upper wall 750 in the X direction.

The flanges 710 are each provided with a notch 711 at a portion corresponding to the groove 730 such that the notch 711 communicates with the groove 730 so that the flanges 710 do not block the insertion of the iron core 800.

In the present embodiment, the extension walls 770 located on both sides in the X direction include horizontal walls 717 extending substantially horizontally. The extension wall 770 on one side in the X direction (toward a support portion 512 of an armature 510 described below) is provided with a hanging wall 772 continuously extending downward from the horizontal wall 771.

Figure 13:
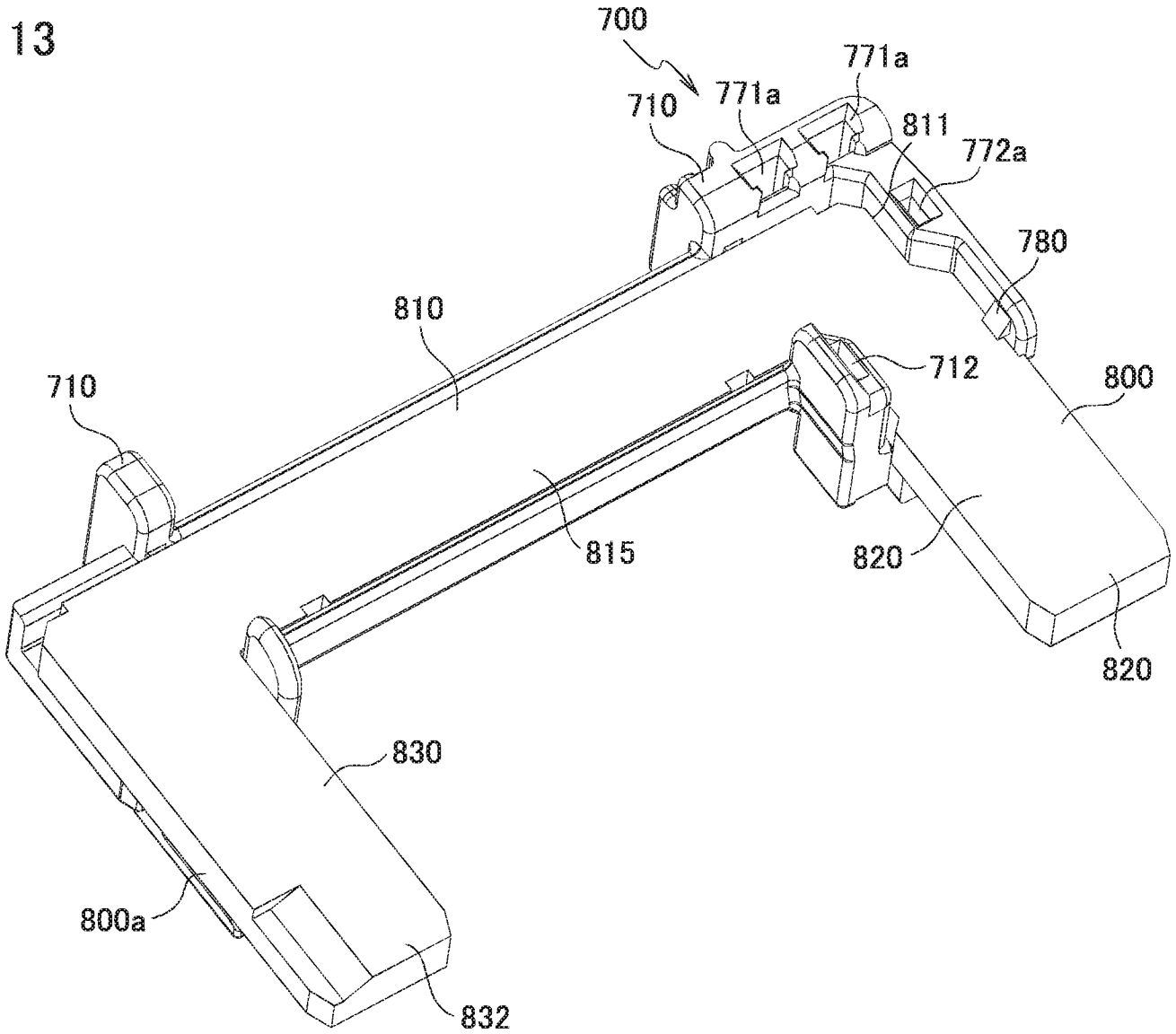
FIG. 13 is a perspective view of the coil frame according to the first embodiment of the present invention, showing a state in which the iron core is inserted in the coil frame.

The iron core 800 is fixed to the coil frame 700 such that the body portion 810 and upper portions of the leg portions 820 and 830 (on the body portion 810 side) are inserted into the groove 730 (refer to FIG. 13).

In the present embodiment, the upper wall (the wall defining the groove 730) 750 is provided with press-fit ribs 751 on the groove 730 side at positions corresponding to the flanges 710 so that the iron core 800 is press-fitted to the groove 730. The press-fit ribs 751 of the present embodiment are elongated on the inner circumferential surface side of the flanges 710. Thus, a pressure force applied from the inner circumferential surface side to the outer circumferential surface side of the flanges 710 is caused when the iron core 800 is press-fitted to the groove 730. Accordingly, deformation of the coil frame 700 is prevented due to the pressure force applied toward the outer circumferential surface of the flanges 710.

The hanging wall (the wall defining the groove 730) 772 is provided with a projection 780 on the inner surface toward the groove 730 to prevent the iron core 800 press-fitted (inserted) to the groove 730 from moving in a direction in which the iron core 800 is removed (toward the opening 731).

In the present embodiment, the projection 780 is formed into a substantially right triangle on the inner surface of the hanging wall 772 facing the groove 730 such that the volume of the projection 780 gradually increases toward the back side of the groove 730 (toward the base wall 740) and has a flat surface on the back side (on the base wall 740 side) substantially parallel to the base wall 740.

The projection 870 facilitates the press fit (the insertion) of the iron core 800 to the groove 730 because the iron core 800 is guided by the inclined surface of the projection 870. In the state in which the iron core 800 is press-fitted (inserted) to the groove 730, the side surface of the iron core 800 (the surface on the opening 731 side) is held by the back surface of the projection 870 (on the base wall 740 side), so as to accurately prevent the iron core 800 press-fitted (inserted) to the groove 730 from moving in the direction in which the iron core 800 is removed (toward the opening 731).

The hanging wall (the wall defining the groove 730) 772 and the base wall (the wall defining the groove 730) 740 are provided, at a position corresponding to the projection 870, with a clearance 781 on which the entire projection 870 is exposed, as viewed in the Y direction (in the direction in which the iron core 800 is inserted to the groove 730).

The clearance 781 facilitates the adjustment to the height of the projection 870 when the coil frame 700 is formed by resin molding with a metal die.

The coil frame 700 is provided with the projection 780 only on one side in the X direction (on the support portion 512 side of the armature 510) because the coil frame 700 and the iron core 800 on the other side in the X direction (on the magnetic pole 513 side of the armature 510 described below) are fixed by chucking when the coil 72 is wound. The projection 780 is provided on the one side, opposite to the chucking side, on which the iron core 800 is likely to be lifted up by leverage during the fixation by chucking, so as to accurately prevent the iron core 800 from being lifted up on the one side in the X direction (on the magnetic pole 513 side of the armature 510).

The iron core 800 is provided with a stepped portion 811 for reducing magnetic flux density and preventing an insertion error, and the groove 730 has a shape conforming to the stepped portion 811.

The coil terminals 900 include terminal wound portions 910 on which a front edge 721 and an end edge 722 of the coil 72 are wound, press-fit pieces 920 press-fitted to the coil frame 700 so as to fix the coil terminals 900 to the coil frame 700, and terminal portions 930 exposed to the outside of the housing 20 to be electrically connected to an external power source or the like.

In the present embodiment, the coil terminal 900 on the outer side in the X direction is fixed to the coil frame 700 such that the terminal wound portion 910 is inserted to one of insertion holes 771*a* provided on the horizontal wall 771 on the one side in the X direction (on the support portion 512 side of the armature 510) while the tip of the terminal wound portion 910 projects to the outside of the coil frame 700, and the press-fit piece 920 is press-fitted to a press-fit groove 772*a* provided on the hanging wall 772.

The other coil terminal 900 on the inner side in the X direction is fixed to the coil frame 700 such that the terminal wound portion 910 is inserted to the other insertion hole 771*a* provided on the horizontal wall 771 on the one side in the X direction (on the support portion 512 side of the armature 510) while the tip of the terminal wound portion 910 projects to the outside of the coil frame 700, and the press-fit piece 920 is press-fitted to a press-fit groove 712 provided on the flange 710.

As described above, the coil frame 700 is formed by resin molding such that the resin material is injected to a metal die from a plurality of resin gates.

In the present embodiment, the coil frame 700 is formed by use of two resin gates. Thus, two (at least two) resin gate spots 741 remain on the coil frame 700. The two (at least two) resin gates contribute to the molding with higher accuracy on both sides of the coil frame 700 filled with a larger volume of the resin material. This expands the possibility of molding conditions, which allows the coil frame 700 to be molded under more preferred molding conditions. Further, molding fluidity can be stabilized, so as to suppress a bend during molding and thus minimize variation of the bend. Accordingly, the coil frame 700 can be molded with much higher accuracy.

In the present embodiment, the two resin gate spots 741 remain adjacent to the flanges 710 formed in the coil frame 700. Namely, the two resin gate spots 741 are provided adjacent to the flanges 710 located on both sides of the coil frame 700 in the X direction at which the molding volume is larger.

An expanded portion 742 is provided in the coil frame 700 on the rear side of one resin gate spot 741. The greater thickness at the expanded portion 742 ensures rigidity of the coil frame 700.

In the present embodiment, a support portion-side projection piece (a positioning portion) 743 continuously extends downward from the lower end of the hanging wall 772. The support portion-side projection piece (the positioning portion) 743 is connected to the lower portion of the hanging wall 772 such that the support portion-side projection piece 743 is separated from the iron core 800 with a predetermined gap in the Y direction. In particular, the lower end of the hanging wall 772 extends in the Y direction, and the support portion-side projection piece (the positioning portion) 743 further extends downward from the edge of the extending portion of the hanging wall 771. Namely, the lower end of the hanging wall 772 extends in the Y direction so as to provide a space above the extending portion. The space provided at the upper portion of the extending portion (at the upper portion of the support portion-side projection piece 743) is used as a coil leading space 790 in the present embodiment. The upper surface of the extending portion defining the lower end of the coil leading space 790 is formed into a smooth curved surface curved downward so that the led coil can easily be wound on the terminal wound portions 910.

In the present embodiment, the expanded portion 742 is formed at a position corresponding to the coil leading space 790. The expanded portion 742 is thus provided with a smoothly-curved surface without edge so as to prevent the coil 72 from being cut by the edge.

The coil block 70 is formed such that the coil terminals 900 are attached to the coil frame 700 to which the iron core 800 is fixed to form the coil frame block 71, the coil 72 is wound on the body portion 810 and the body portion 720, and the front edge 721 and the end edge 722 are led to the coil leading space 790 through a coil leading port 791 and wound on the respective terminal wound portions 910 of the coil terminals 900.

Figure 15:
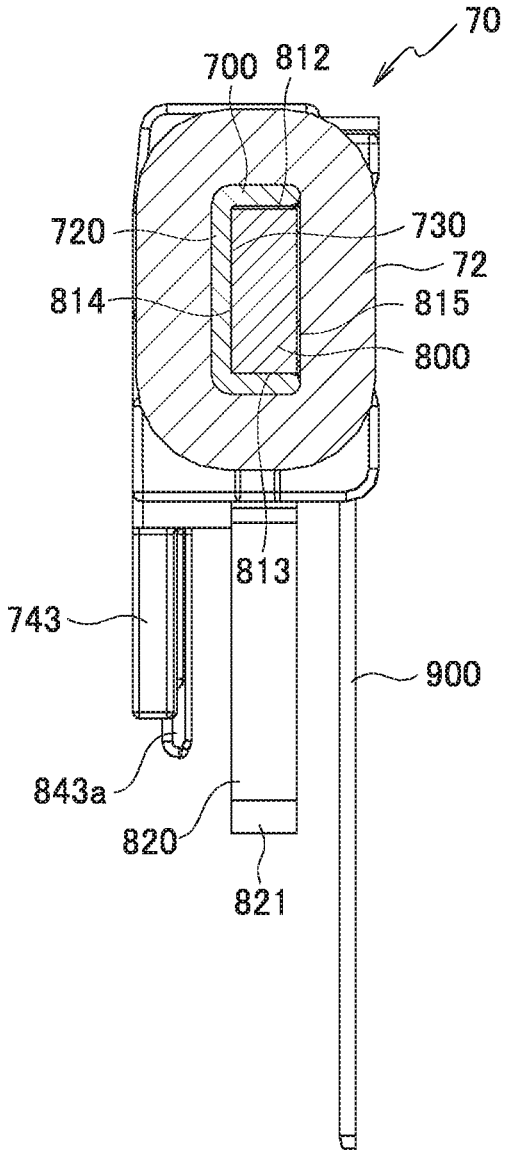
FIG. 15 is a cross-sectional view of the coil block according to the first embodiment of the present invention, showing a state in which a coil is wound on the coil frame block.
Figure 16A:
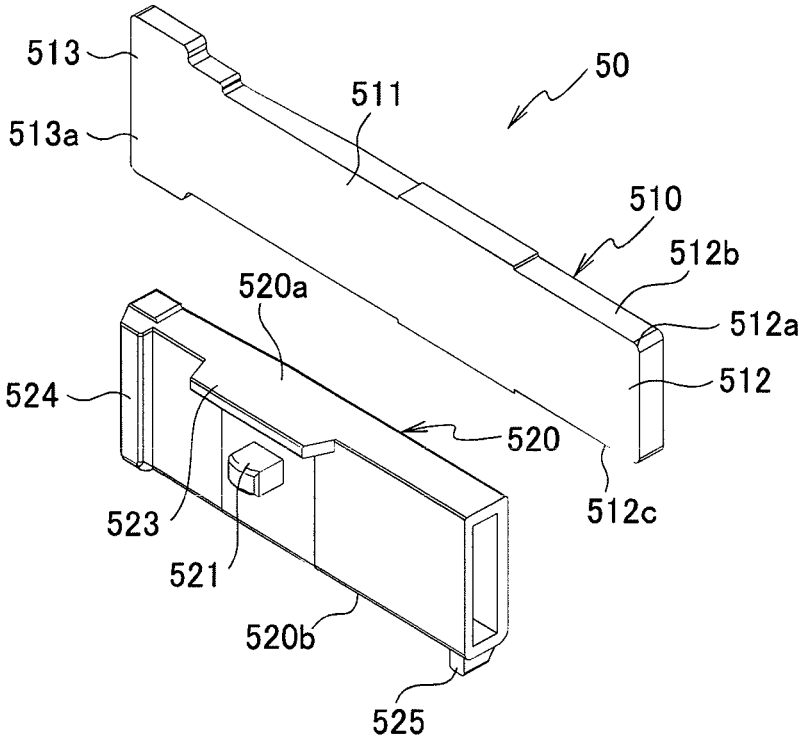
FIGS. 16A and 16B are views showing the armature block according to the first embodiment of the present invention.
Figure 16B:
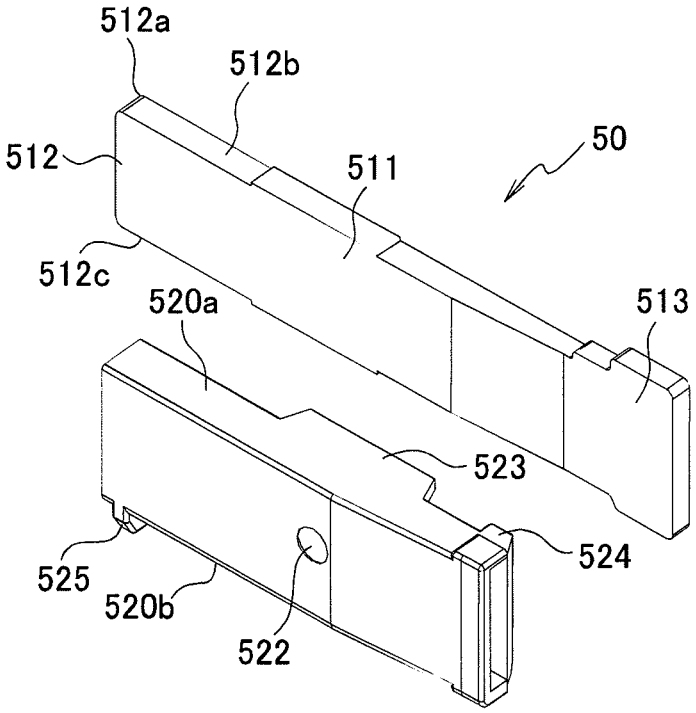
Figure 17A:
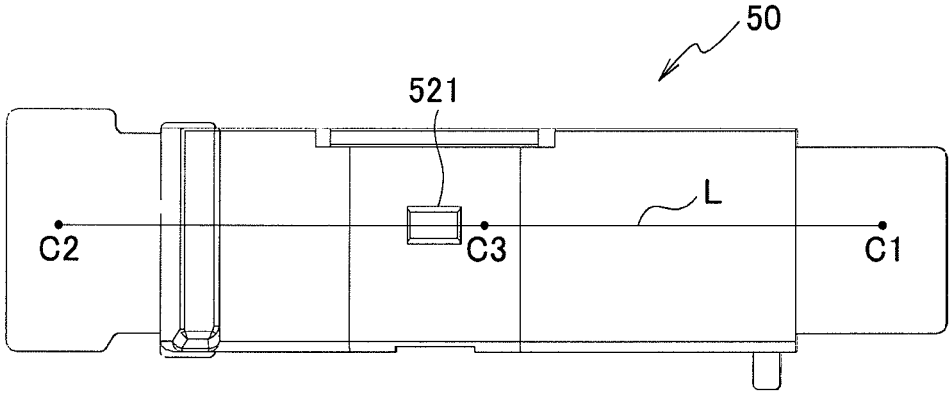
FIGS. 17A and 17B are views showing the armature block according to the first embodiment of the present invention.
Figure 17B:
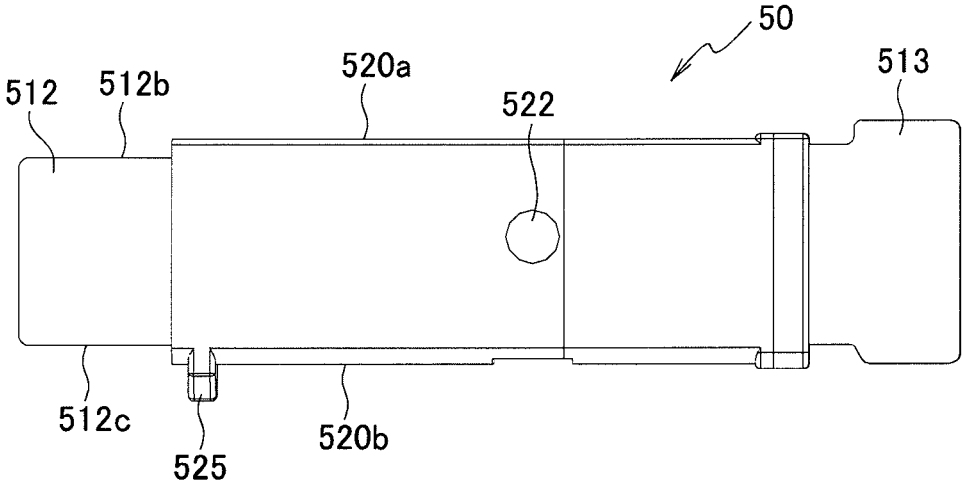

In the coil block 70 described above, the coil 72 is wound on the body portion 810 of the iron core 800 in a state in which upper and lower surfaces 812 and 813 (two surfaces separated from each other) and one side surface 814 are covered with the body portion 720 of the coil frame 700, while the other side surface 815 is not covered with the body portion 720 (refer to FIG. 15). Namely, the body portion 810 of the iron core 800 is fixed to the substantially C-shaped body portion 720. Since the body portion 810 of the iron core 800 is fixed to the substantially C-shaped body portion 720, the rigidity of the coil frame 700 can be ensured.

A space 70*a* into which the support portion 512 of the armature 510 is inserted is provided between the leg portion 820 on one side of the iron core 800 and the support portion-side projection piece (the positioning portion) 743 (refer to FIG. 14).

Figure 34:
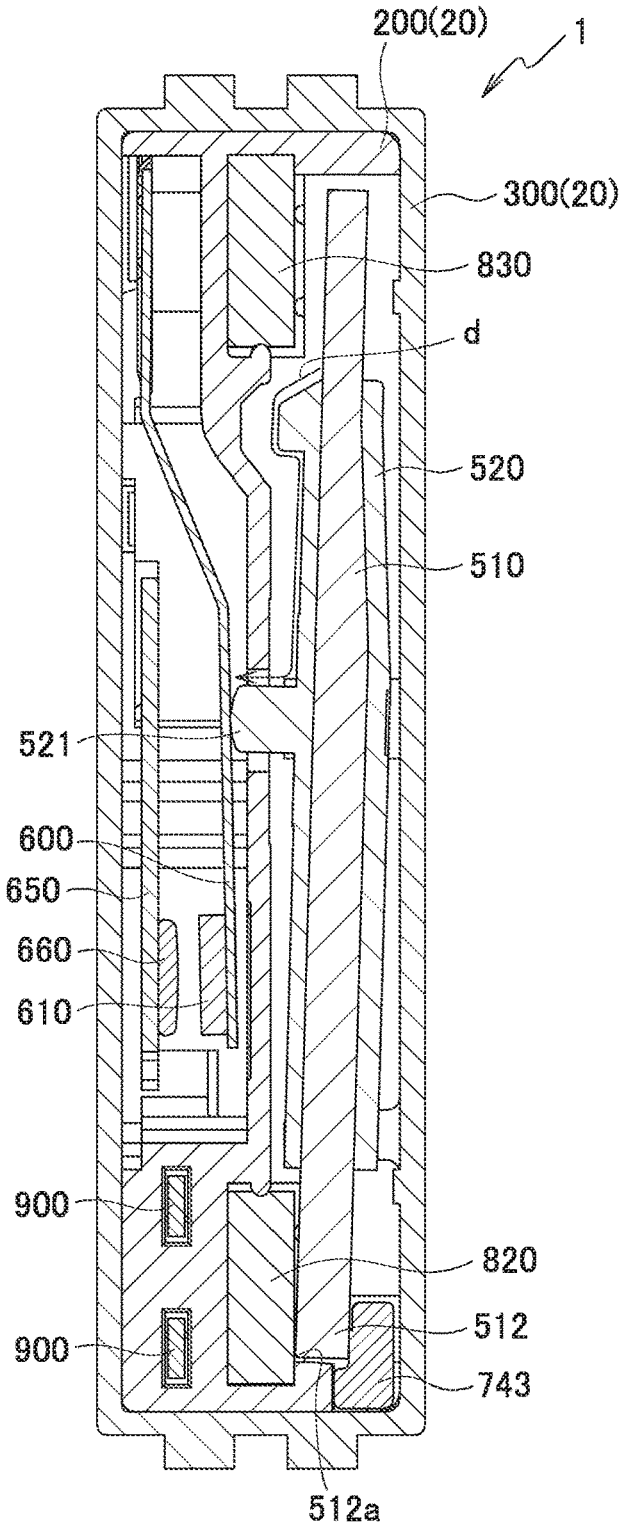
FIG. 34 is a cross-sectional view showing a state in which contacts of the electromagnetic relay according to the first embodiment of the present invention are open.
Figure 35:
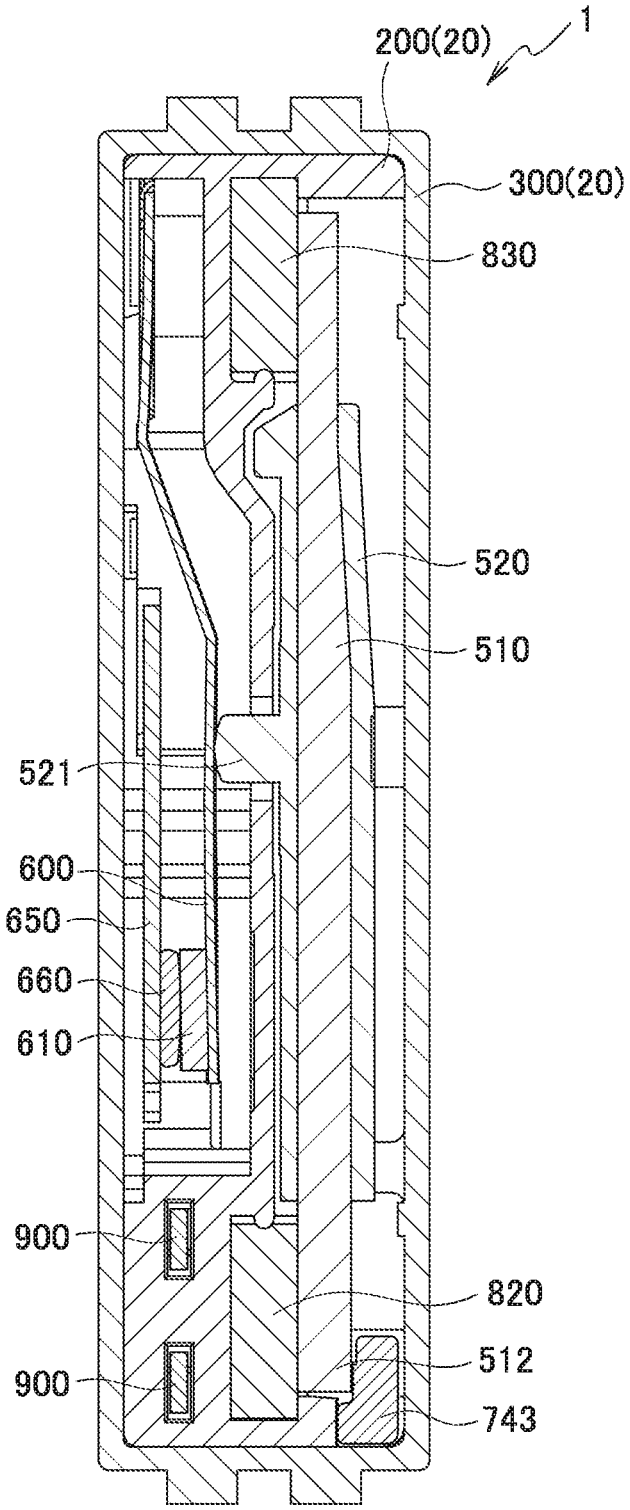
FIG. 35 is a cross-sectional view showing a state in which the contacts of the electromagnetic relay according to the first embodiment of the present invention are closed.

The support portion-side projection piece (the positioning portion) 743 is a plate having a substantially L-shape for holding the support portion 512 of the armature 510 (refer to FIG. 34). The support portion-side projection piece (the positioning portion) 743 is provided with an engagement edge 743*a* at the lower end engaged with an engagement projection 218 of the base 200.

A magnetic pole-side projection piece (a restriction portion) 744 projecting downward is connected to the lower end of the base wall 740 on the other side in the X direction (on the magnetic pole 513 side of the armature 510).

The magnetic pole-side projection piece (the restriction portion) 744 is connected to the lower end of the base wall 740 such that the magnetic pole-side projection piece 744 is separated from the iron core 800 with a predetermined gap in the Y direction. In particular, the lower end of the base wall 740 extends in the Y direction, and the magnetic pole-side projection piece (the restriction portion) 744 further extends downward from the edge of the extending portion of the base wall 740.

The magnetic pole-side projection piece (the restriction portion) 744 has a plate-like shape for restricting a swing movement of the magnetic pole 513 in a direction away from the other leg portion 830 of the iron core 800.

A space 70*b* into which the magnetic pole 513 of the armature 510 is inserted is provided between the other leg portion 830 of the iron core 800 and the magnetic pole-side projection piece (the restriction portion) 744 (refer to FIG. 7).

In a state in which the magnetic pole 513 of the armature 510 is inserted in the space 70*b*, the surface of the magnetic pole 513 and the surface of the leg portion 830 opposed to each other respectively serve as magnetic pole faces 513*a* and 831.

The resin material used for the coil frame 700 may be a liquid crystal polymer (LCP) having high fluidity and heat resistance. The use of the liquid crystal polymer (LCP) can provide the movable body 520 with an accurate stepped shape.

The armature block 50 is placed from the one leg portion 820 to the other leg portion 830 of the iron core 800, and includes the armature 510 which swings on an axis 512*a* at one end, and a movable body 520 which moves in association with the swing of the armature 510.

The armature 510 of the present embodiment has a substantially rectangular shape elongated in the X direction, and includes the support portion 512 opposed to the leg portion 820 on one side of the iron core 800 to serve as the axis 512*a*, and the magnetic pole 513 opposed to the other leg portion 830 of the iron core 800. The armature 510 further includes an arm portion 511 which connects the support portion 512 and the magnetic pole 513 and causes the magnetic pole 513 to swing on the support portion 512 serving as the axis so that the magnetic pole 513 comes close to and separates from the other leg portion 830 of the iron core 800.

The armature 510 of the present embodiment is substantially symmetrical with respect to a horizontal line passing through the middle in the vertical direction in the side view (as viewed in the Y direction) in a state in which the extending direction of the arm portion 511 conforms to the horizontal direction (the X direction) and the width direction of the arm portion 511 conforms to the vertical direction.

In the present embodiment, a segment L described below substantially conforms to the horizontal line passing through the middle in the vertical direction, and the armature 510 is substantially symmetrical with respect to the segment L.

In particular, the support portion 512 has a rectangular shape substantially symmetrical with respect to the segment L, and the magnetic pole 513 also has a rectangular shape substantially symmetrical with respect to the segment L while projecting above and below the arm portion 511 in the vertical direction. The arm portion 511 connecting the support portion 512 and the armature 513 also has a rectangular shape substantially symmetrical with respect to the segment L.

An upper surface 512*b* and a lower surface 512*c* of the support portion 512 are flat surfaces in the side view (as viewed in the Y direction) in the state in which the extending direction of the arm portion 511 conforms to the horizontal direction (the X direction) and the width direction of the arm portion 511 conforms to the vertical direction.

The upper surface 512*b* and the lower surface 512*c* of the support portion 512 are closer to the middle of the movable body 520 in the vertical direction than an upper surface 520*a* and a lower surface 520*b* of the movable body 520 in the side view (as viewed in the Y direction) in the state in which the extending direction of the arm portion 511 conforms to the horizontal direction (the X direction) and the width direction of the arm portion 511 conforms to the vertical direction.

In the present embodiment, the support portion 512 is not provided with any extension (shaft portion pivotally supported by the coil frame 700 or the base 200) extending in the vertical direction (the Z direction). Accordingly, a reduction in weight of the armature block 50 can be achieved, so that the armature block 50 is hardly inclined.

Since the support portion 512 is not provided with any extension extending in the vertical direction, the support portion 512 is positioned by the leg portion 820 on one side of the iron core 800 and the positioning portion provided in one of the coil frame 700 and the base 200 in the present embodiment. This configuration can reduce a fixation error to increase the accuracy of fixation, as compared with the case in which the support portion 512 is supported by both the coil frame 700 and the base 200.

In the present embodiment, as described above, the support portion 512 is positioned by the leg portion 820 of the iron core 800 and the support portion-side projection piece (the positioning portion) 743 provided in the coil frame 700. A fixation error thus can be minimized due to the support portion-side projection piece (the positioning portion) 743 provided in the coil frame 700 to which the iron core 800 is fixed.

The restriction portion for restricting a swing movement of the magnetic pole 513 in the direction away from the other leg portion 830 of the iron core 800 is provided in one of the coil frame 700 and the base 200. This configuration can further increase the accuracy of fixation, which improves the accuracy of strokes (a swing range) of the armature block 50 to stabilize the strokes.

In the present embodiment, the magnetic pole-side projection piece (the restriction portion) 744 is provided in the coil frame 700.

In the present embodiment, the positioning of the support portion 512 and the restriction of the swing range of the magnetic pole 513 are respectively achieved by the support portion-side projection piece (the positioning portion) 743 and the magnetic pole-side projection piece (the restriction portion) 744 of the coil frame 700. Accordingly, the insertion dimensions of the support portion 512 and the strokes of the magnetic pole 513 can further be stabilized.

The movable body 520 is attached to the arm portion 511 of the armature 510. The movable body 520 is formed by resin molding with a metal die. The armature 510 may be press-fitted to the movable body 520 formed separately from the armature 510, or the armature 510 and the movable body 520 may be formed integrally by insert molding.

The resin material used for the movable body 520 may be a liquid crystal polymer (LCP) having high fluidity and heat resistance. The use of the liquid crystal polymer (LCP) can provide the movable body 520 with an accurate stepped shape, and relatively reduce the thickness of the movable body 520.

The movable body 520 is provided with a pressure projection 521 for pressing a movable contact portion 600 described below to move the movable contacts 610.

The pressure projection 521 may be located on the segment L connecting the center of gravity C1 of the support portion 512 and the center of gravity C2 of the magnetic pole 513.

Alternatively, the pressure projection 521 may be located on a segment connecting the center of magnetic force of the support portion 512 and the center of magnetic force of the magnetic pole 513.

The present embodiment is illustrated with the case in which the center of gravity C1 of the support portion 512 substantially conforms to the center of magnetic force of the support portion 512, and the center of gravity C2 of the magnetic pole 513 substantially conforms to the center of magnetic force of the magnetic pole 513. Thus, the segment connecting the center of magnetic force of the support portion 512 and the center of magnetic force of the magnetic pole 513 substantially conforms to the segment L connecting the center of gravity C1 of the support portion 512 and the center of gravity C2 of the magnetic pole 513.

In the present embodiment, the segment L is substantially horizontal in the side view (as viewed in the Y direction) in the state in which the extending direction of the arm portion 511 conforms to the horizontal direction (the X direction) and the width direction of the arm portion 511 conforms to the vertical direction.

Namely, in the present embodiment, the pressure projection 521, the center of gravity C1 (the center of magnetic force) of the support portion 512, and the center of gravity C2 (the center of magnetic force) of the magnetic pole 513 are located at substantially the same level. In addition, the pressure projection 521, the center of gravity C1 (the center of magnetic force) of the support portion 512, and the center of gravity C2 (the center of magnetic force) of the magnetic pole 513 are located between both edges of the armature block 50 in the vertical direction.

Figure 22:
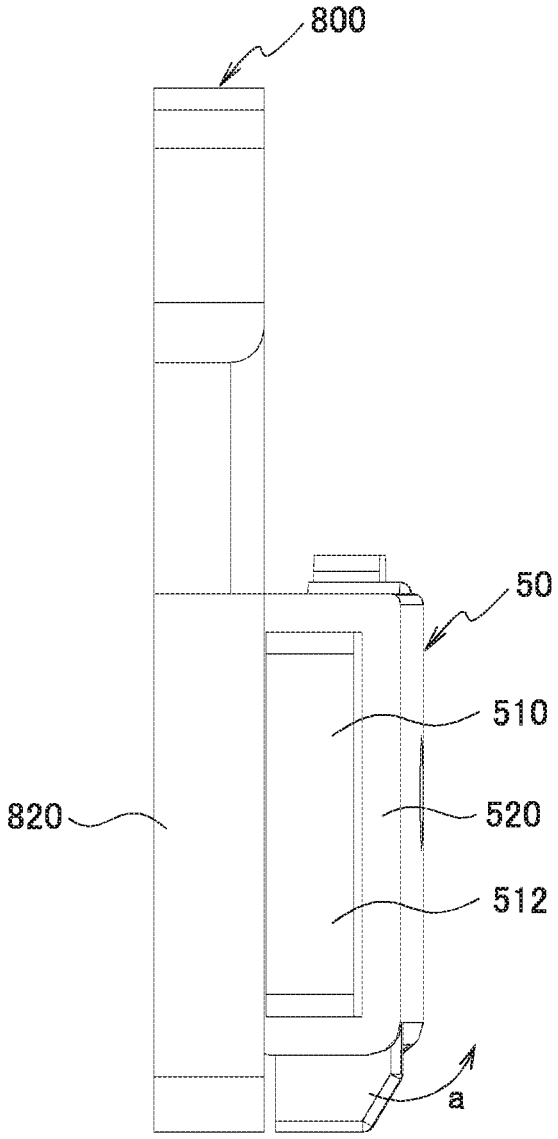
FIG. 22 is a view showing a positional relation between the iron core and the armature block according to the first embodiment of the present invention as viewed from the fulcrum side of the armature block.
Figure 23A:
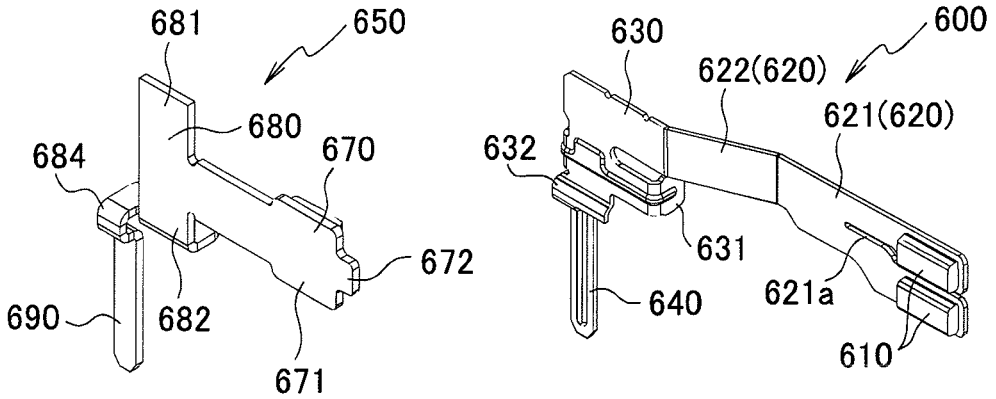
FIGS. 23A and 23B are views showing a contact block according to the first embodiment of the present invention.
Figure 23B:
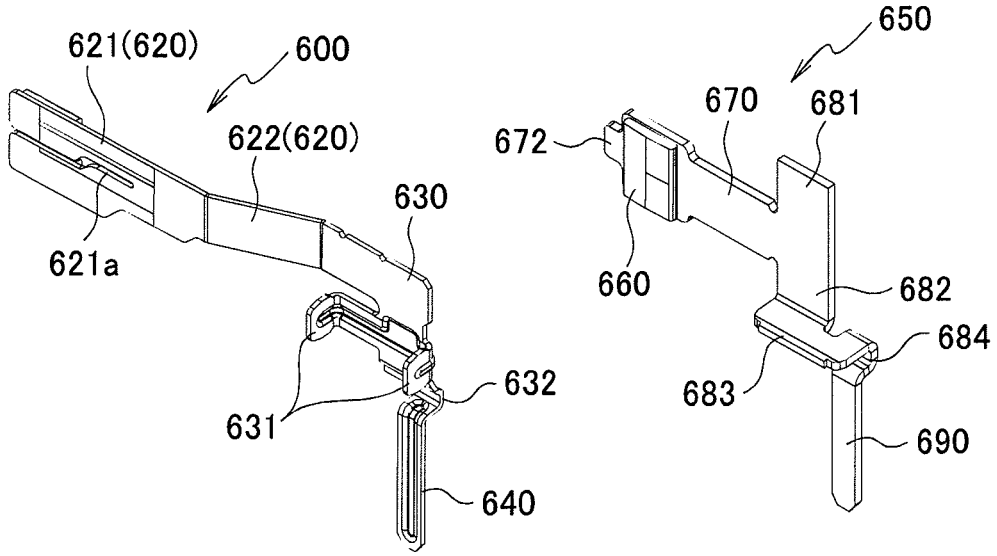

This configuration can prevent the armature block 50 from turning upward with the lower side lifted up (refer to the arrow "a" in FIG. 22) when the pressure is caused by the pressure projection 521.

The pressure projection 521 is located at a position shifted from the center C3 of the armature 510 in the horizontal direction toward the magnetic pole 513 in the side view (as viewed in the Y direction) in the state in which the extending direction of the arm portion 511 conforms to the horizontal direction (the X direction) and the width direction of the arm portion 511 conforms to the vertical direction.

In a state in which the pressure force of the pressure projection 521 acts on the armature 510, the force acting on the support portion 512 to move away from the iron core 800 is smaller than the force acting on the magnetic pole 513 to move away from the iron core 800. Thus, the lower side of the support portion 512 of the armature 510 can be prevented from being lifted up. In addition, since the holding plate for holding the support portion 512 need not have excessive holding strength, a simple projection piece projecting downward from the coil frame 700, such as the support portion-side projection piece (the positioning portion) 743, can sufficiently restrict the movement of the support portion 512. A reduction in the holding force of the holding plate for holding the support portion 512 can prevent large friction caused when the armature block 50 swings, so as to improve the operational stability.

The contact block 60 includes a fixed contact portion 650 provided with the fixed contact 660, and a movable contact portion 600 provided with the movable contacts 610 brought into contact with and separated from the fixed contact 660.

The movable contact portion 600 includes a plate spring 620 provided with the movable contacts 610 and having a plate thickness and a plate width. The other region excluding the movable contacts 610 in the movable contact portion 600 may be formed from a single metal plate bent by press molding.

In the present embodiment, the plate spring 620 includes an operation piece 621 to which the movable contacts 610 are attached, and a spring piece 622 continuously extending and bent from the other end of the operation piece 621 in the X direction and causing the operation piece 621 to move in the Y direction.

The operation piece 621 is provided with a slit 621*a* extending substantially in the X direction to branch the tip of the operation piece 621 into two. The branched pieces are each provided with the movable contact 610.

The operation piece 621 is pressed by the pressure projection 521 to move in the Y direction. The movable contacts 610 move to come into contact with and separate from the fixed contact 660 in association with the movement of the operation piece 621 in the Y direction.

Figure 25:
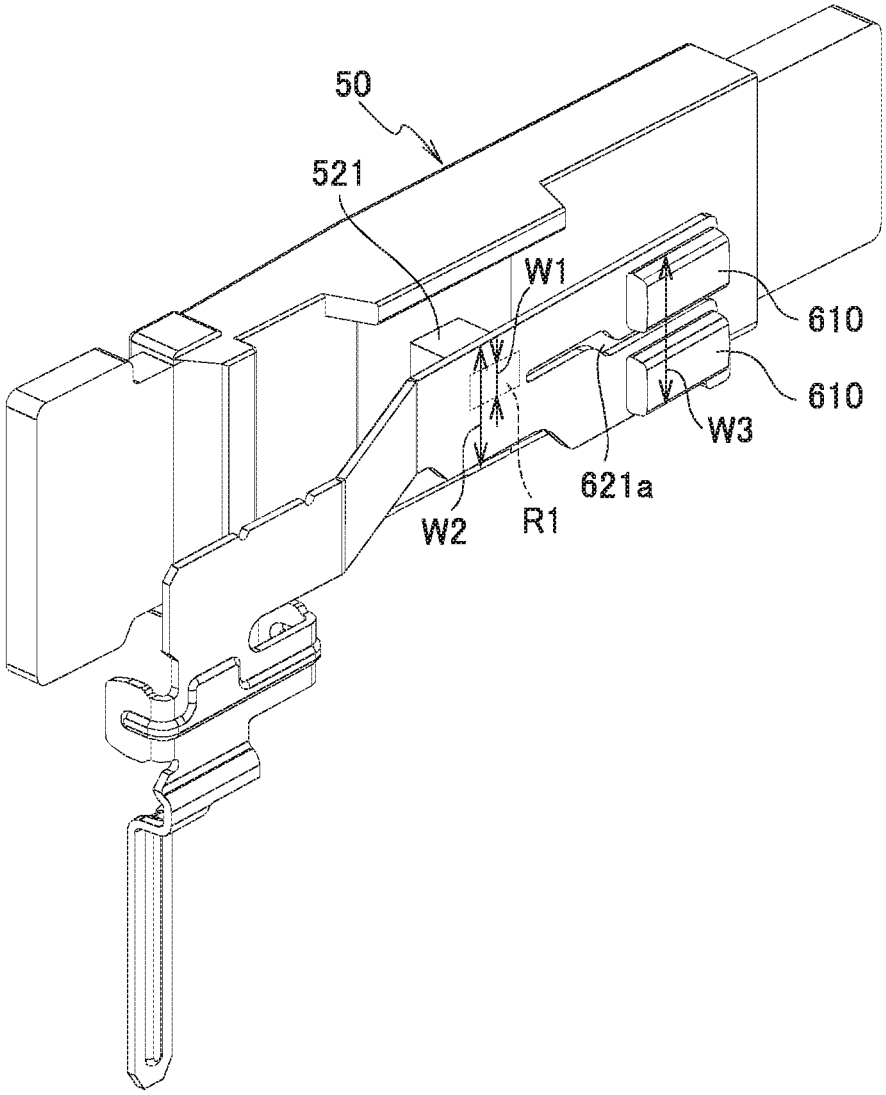
FIG. 25 is a perspective view showing a positional relation between the movable contact portion and the armature block according to the first embodiment of the present invention as viewed from the movable contact portion side.
Figure 26:
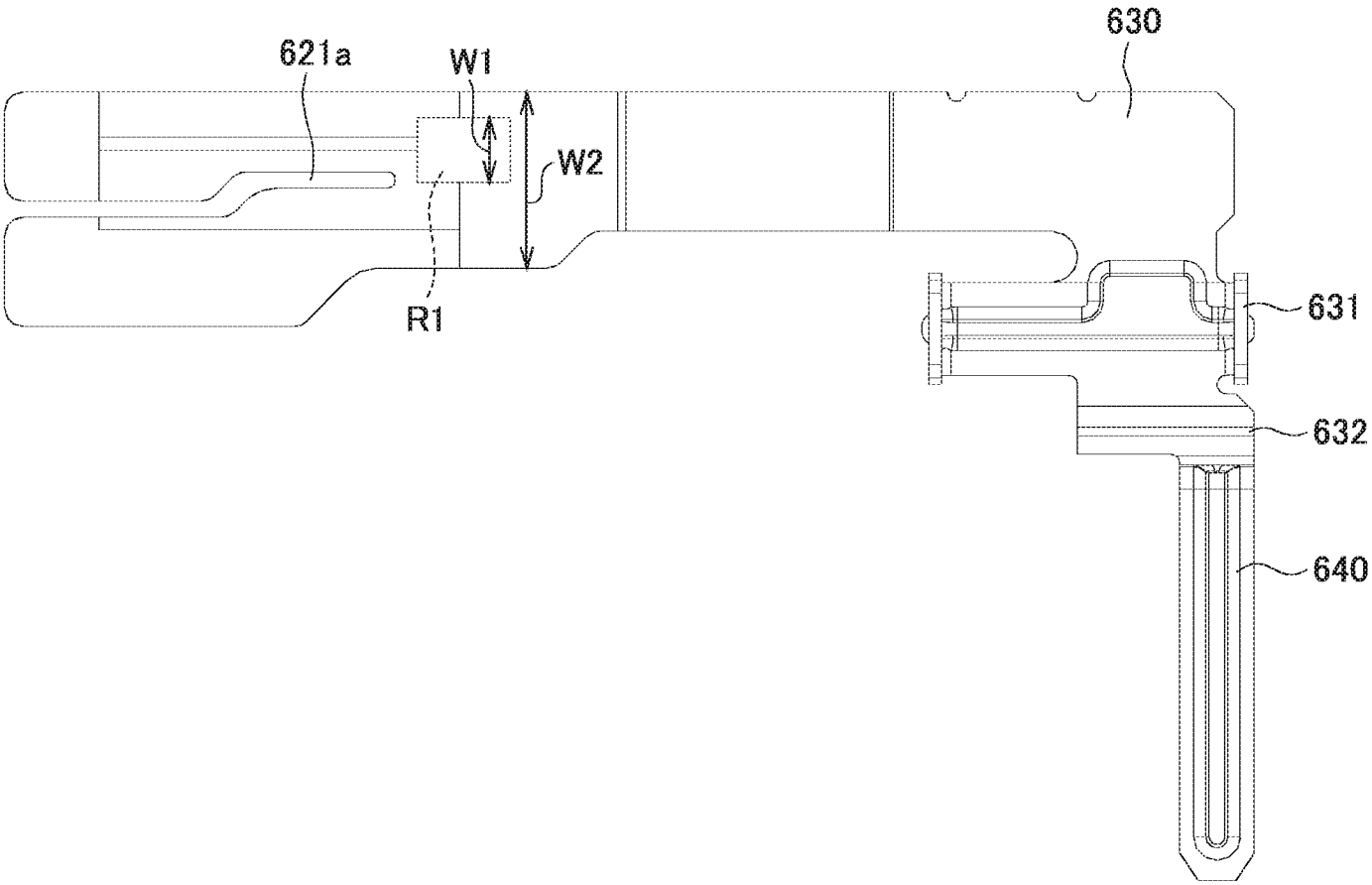
FIG. 26 is a view showing a positional relation between the movable contact portion and the pressure projection according to the first embodiment of the present invention.

In the present embodiment, as shown in FIG. 25 and FIG. 26, a pressure region R1 pressed by the pressure projection 521 is defined in the operation piece 621 toward the spring piece 622. The pressure projection 521 presses a portion in the operation piece 621 not provided with the slit 621*a*. Further, in the present embodiment, the width W1 of the pressure region R1 in the vertical direction (the width in the plate width direction of the plate spring 620) is less than or equal to half of the plate width (the width in the vertical direction) W2 of the plate spring 620 at a position corresponding to the pressure region R1.

This configuration can minimize positional displacement of the pressure point if the movable contact portion 600 or the armature block 50 is inclined, so as to prevent a generation of a force which lifts up the lower side of the armature block 50.

A fixed piece 630 continuously extends from the other end of the spring piece 620 in the X direction. The fixed piece 630 is fixed to the base 200 so that the movable contact portion 600 is fixed to the base 200.

The fixed piece 630 includes press-fit pieces 631 press-fitted to press-fit grooves 212 of the base 200, and a bent portion 632 continuously extending downward from the press-fit pieces 631 to cover a notch 213 of the base 200.

A movable contact portion-side terminal 640 continuously extends from the lower portion of the bent portion 632 to be exposed to the outside below the housing 20.

When the press-fit pieces 631 are press-fitted to the press-fit grooves 212 of the base 200, the movable contact portion-side terminal 640 is exposed to the outside below the housing 20 in a state in which the bent portion 632 covers the notch 213. The movable contact portion-side terminal 640 exposed to the outside below the housing 20 is electrically connected with a target component such as a busbar.

When the case 300 is fitted to the base 200 in a state in which the movable contact portion 600 is fixed to the base 200, the bent portion 632 is located adjacent to the inner surface of the case 300. When the adhesive 100 is applied to the bottom surface of the base 200 to seal, the bent portion 632 prevents the adhesive 100 from entering the inside, so as to suppress operational defects or loose connection.

The fixed contact portion 650 includes a plate portion 670 provided with the fixed contact 660 and having a plate thickness and a plate width. The other region excluding the fixed contact 660 in the fixed contact portion 650 may be formed from a single metal plate bent by press molding.

In the present embodiment, the plate portion 670 includes a wide portion 671 elongated in the vertical direction, and a projection 672 projecting on one side in the X direction (on the tip side of the fixed contact portion 650).

A fixed piece 680 continuously extends from the other end of the plate portion 670 in the X direction. The fixed piece 680 is fixed to the base 200 so that the fixed contact portion 650 is fixed to the base 200.

The fixed piece 680 includes a press-fit piece 681 continuously extending upward and press-fitted to a press-fit groove 223 of the base 200, an extension piece 682 continuously extending downward, a press-fit piece 683 projecting from the lower portion of the extension piece 682 in the Y direction and press-fitted to a press-fit groove 214 of the base 200, and a bent portion 684 continuously extending downward from the press-fit pieces 683 to cover a notch 215 of the base 200.

A fixed contact portion-side terminal 690 continuously extends from the lower portion of the bent portion 684 to be exposed to the outside below the housing 20.

When the press-fit piece 681 is press-fitted to the press-fit groove 223 of the base 200, and the press-fit piece 683 is press-fitted to the press-fit groove 214 of the base 200, the fixed contact portion-side terminal 690 is exposed to the outside below the housing 20 in a state in which the bent portion 684 covers the notch 215. The fixed contact portion-side terminal 690 exposed to the outside below the housing 20 is electrically connected with a target component such as a busbar.

When the case 300 is fitted to the base 200 in a state in which the fixed contact portion 650 is fixed to the base 200, the bent portion 684 is located adjacent to the inner surface of the case 300. When the adhesive 100 is applied to the bottom surface of the base 200 to seal, the bent portion 684 prevents the adhesive 100 from entering the inside, so as to suppress operational defects or loose connection.

Figure 27:
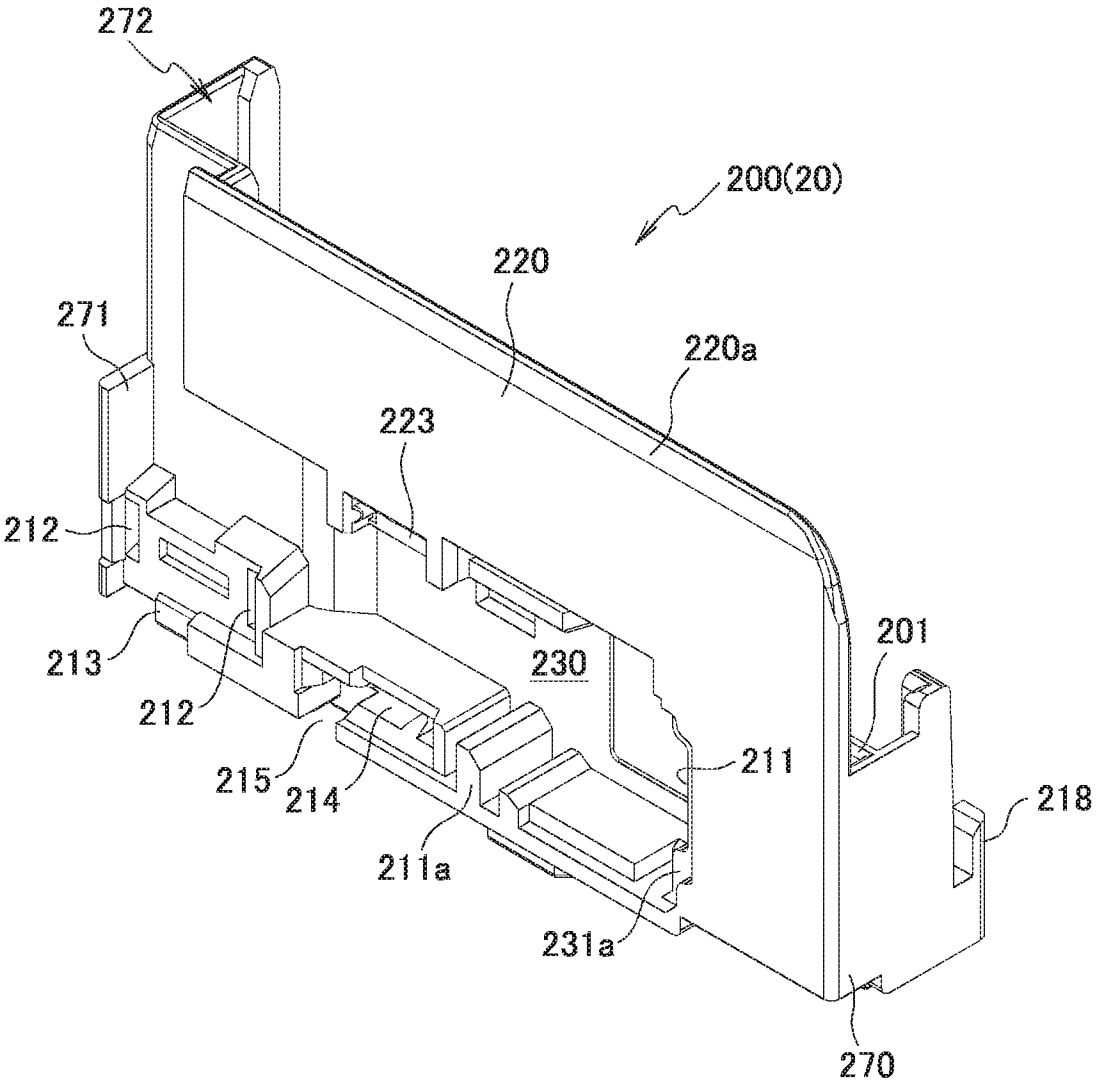
FIG. 27 is a perspective view showing a base according to the first embodiment of the present invention as viewed in one direction.

The base 200 includes the bottom base portion 210. As shown in FIG. 27 and FIG. 28, the bottom base portion 210 is provided with the press-fit grooves 212 to which the press-fit pieces 631 of the movable contact portion 600 are press-fitted, and the notch 213 covered with the bent portion 632 of the movable contact portion 600. The notch 213 is provided so that the movable contact portion-side terminal 640 is exposed to the outside below the bottom base portion 210.

The bottom base portion 210 is also provided with the press-fit groove 214 to which the press-fit piece 683 of the fixed contact portion 650 is press-fitted, and the notch 215 covered with the bent portion 684 of the fixed contact portion 650. The notch 215 is provided so that the fixed contact portion-side terminal 690 is exposed to the outside below the bottom base portion 210.

As described above, the bottom base portion 210 of the base 200 is provided with the isolation wall 220 extending substantially in the X direction and extending upward in the Z direction.

The inside of the housing 20 is divided by the isolation wall 220 so as to define the contact block housing space 230 and the drive block housing space 240.

In the present embodiment, the isolation wall 220 has a structure provided with projections and recesses in the Y direction, so that the contact block housing space 230 and the drive block housing space 240 are respectively provided on both sides of the isolation wall 220 in the Y direction.

In particular, the isolation wall 220 is recessed in the Y direction on the lower side and formed into an L-shape so that the recessed region serves as the contact block housing space 230.

The contact block housing space 230 is defined by a lower surface 232*a* of a top wall 232, an upper surface 234*a* of a bottom wall 234, a side surface 231*a* of a side wall 231, and a contact-side inner surface 233*a* of a back wall 233 in a state in which the bottom base portion 210 is located on the lower side.

In the present embodiment, the bottom wall 234 is a part of the bottom base portion 210, and the back wall 233 and the side wall 231 are each a part of the isolation wall 220.

The side wall 231 is located on the tip side of the movable contact portion 600 and the fixed contact portion 650 in the X direction.

The back wall 233 (the isolation wall 220) is provided with a penetration hole 221 into which the pressure projection 521 of the armature block 50 is inserted so that the movable contact portion 600 is pressed by the pressure projection 521.

In the present embodiment, the penetration hole 221 has a size sufficient to fit the pressure projection 521. Namely, the penetration hole 221 has a size slightly larger than the pressure projection 521. Since the size of the penetration hole 221 is reduced to fit the pressure projection 521, the gap between the pressure projection 521 and the penetration hole 221 is reduced, so as to prevent chipping dust from scattering toward the drive block housing space 240.

In the present embodiment, the pressure projection 521 is located between the fixed contact 660 and a shortest-distance contact portion 60*a* having the shortest distance from the fixed contact 660 in the contact block 60 in contact with the bottom wall 234 as viewed in the moving direction of the movable contacts 610 (as viewed in the Y direction).

The penetration hole 221 is thus located at a position between the shortest-distance contact portion 60*a* and the fixed contact 660 as viewed in the Y direction.

In the present embodiment, the shortest-distance contact portion 60*a* is located in the extension portion 682 of the fixed contact portion 650 toward the fixed contact 660.

This configuration can relatively increase the distance between the fixed contact 660 and the shortest-distance contact portion 60*a*, so as to prevent a short circuit or insulation deterioration due to scattering of chipping dust.

The bottom wall 234 is provided with elongated projections 211*a* elongated in the moving direction of the movable contacts 610 (in the Y direction) and projecting upward between the shortest-distance contact portion 60*a* and the fixed contact 660.

In the present embodiment, two elongated projections 211*a* are aligned in the X direction. The elongated projections 221*a* can increase the insulation distance between the fixed contact 660 and the shortest-distance contact portion 60*a*, and prevent chipping dust from scattering toward the shortest-distance contact portion 60*a*.

In the present embodiment, the side wall 231 is provided with a recess 211 recessed in a direction away from the contact block 60. The recess 211 recessed in the direction away from the contact block 60 can reduce scattering dust adhering to the side wall 231, so as to prevent insulation deterioration of the side wall 231.

A stepped portion 231*a* recessed toward the contact-side inner surface 233*a* (recessed inward in the Y direction) is provided at the end of the side wall 231 on the contact block 60 side on the opposite side of the contact-side inner surface 233*a* (on the cover 300 side). The stepped portion 231*b* is a gap provided between the cover 300 and the base 200 and communicating with the contact block housing space 230 when the base 200 is covered with the cover 300.

The stepped portion 231*b* provided on the side wall 231 can prevent insulation deterioration of the cover 300.

Figure 32:
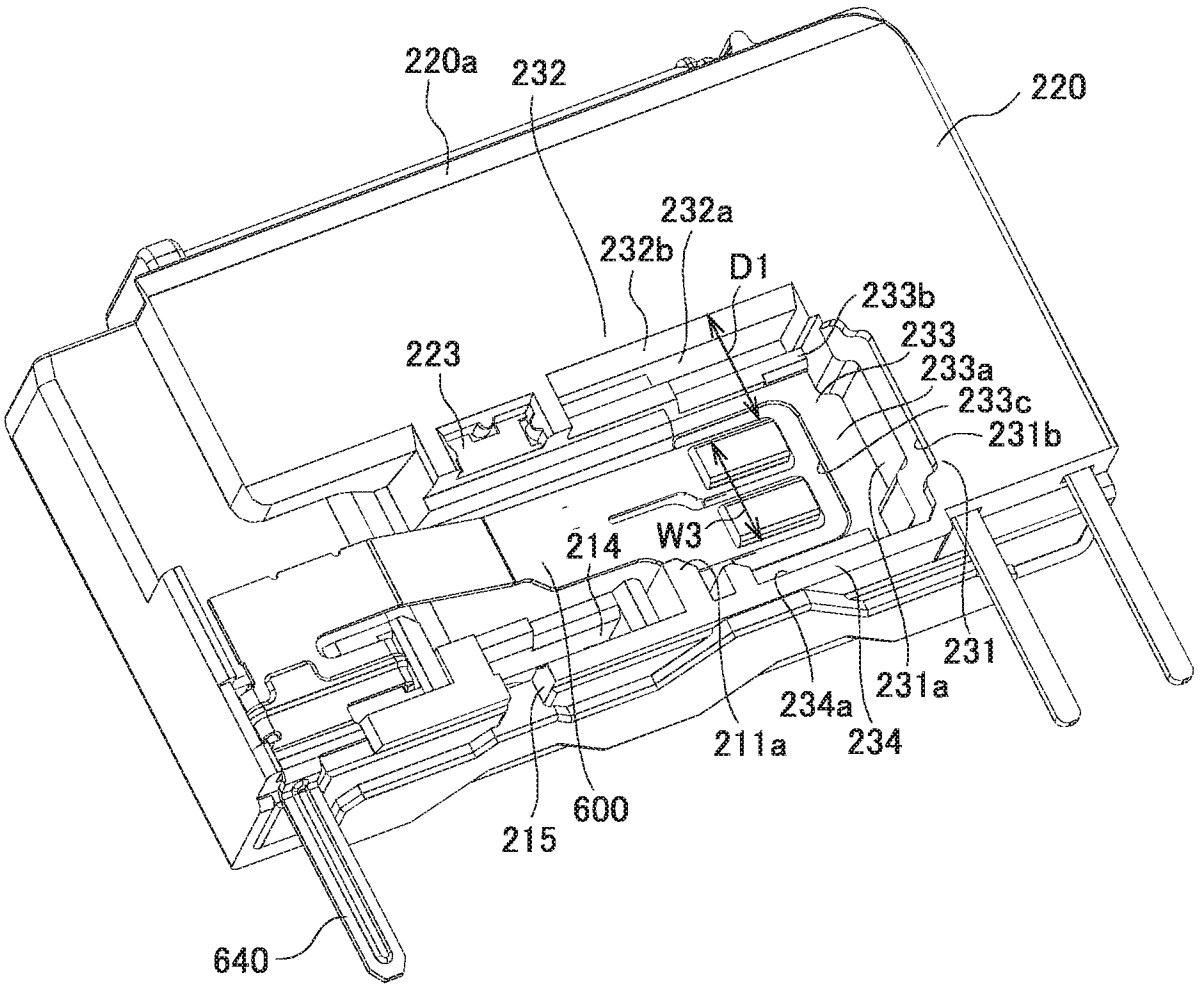
FIG. 32 is a perspective view for illustrating a process of attaching the contact block to the base according to the first embodiment of the present invention, showing a state in which the movable contact portion is attached to the contact block housing space.

In the present embodiment, as shown in FIG. 32, a distance D1 between the contact block 60 and the lower surface 232*a* of the top wall 232 is greater than a width W3 of the movable contacts 610 in the vertical direction.

In particular, a notch 232*b* is provided on the top wall 232 so as to increase a space distance above the movable contacts 610. The increase in the space distance above the movable contacts 610 can prevent insulation deterioration of the top wall 232.

In the present embodiment, an elongated projection 233*b* is provided above the contact block 60 on the contact-side inner surface 233*a* of the back wall 233 (the isolation wall 220). The elongated projection 233*b* can isolate the contact block 60 from the top wall 232 more accurately, so as to prevent insulation deterioration of the top wall 232.

In the present embodiment, a recess 233*c* recessed in a direction away from the movable contacts 610 is provided at a position corresponding to the movable contacts 610 on the contact-side inner surface 233*a* of the back wall 233 (the isolation wall 220), as viewed in the moving direction of the movable contacts 610 (as viewed in the Y direction).

The recess 233*c* has an area to cover the pair of the movable contacts 610 as viewed in the Y direction.

The recess 233*c* can prevent insulation deterioration of the back wall 233 (the isolation wall 220).

The isolation wall 220 on the drive block housing space 240 side is provided with the partition wall 222 extending substantially in the X direction and projecting in the Y direction. The partition wall 222 divides the drive block housing space 240 into the coil housing space 250 and the armature block housing space 260.

Figure 30A:
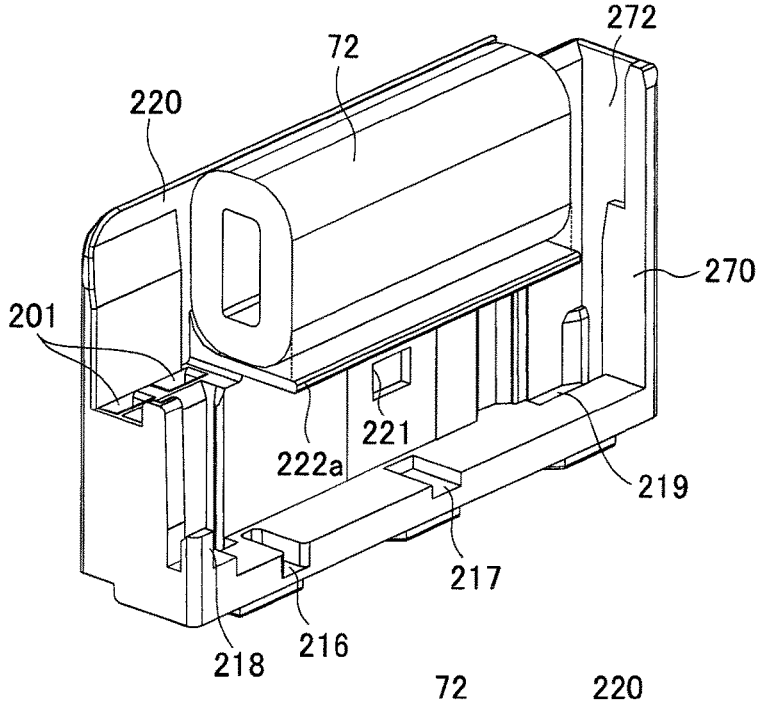
FIGS. 30A, 30B and 30C are views showing a positional relation between a partition wall of the base and the coil according to the first embodiment of the present invention.
Figure 30B:
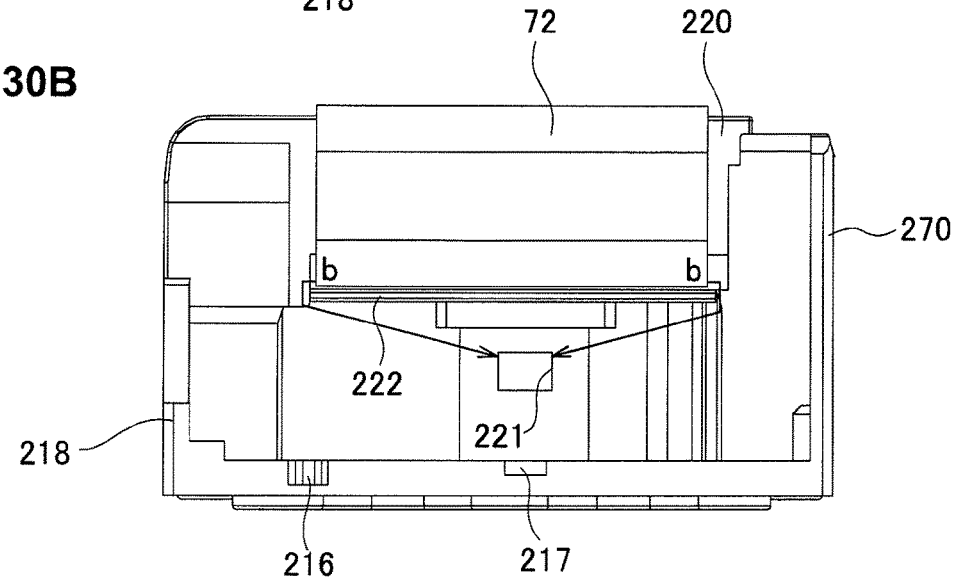
Figure 30C:
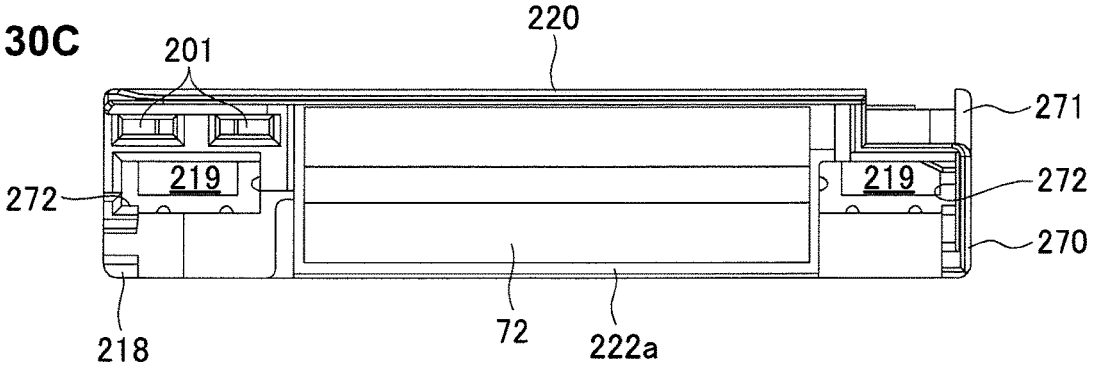
Figure 31:
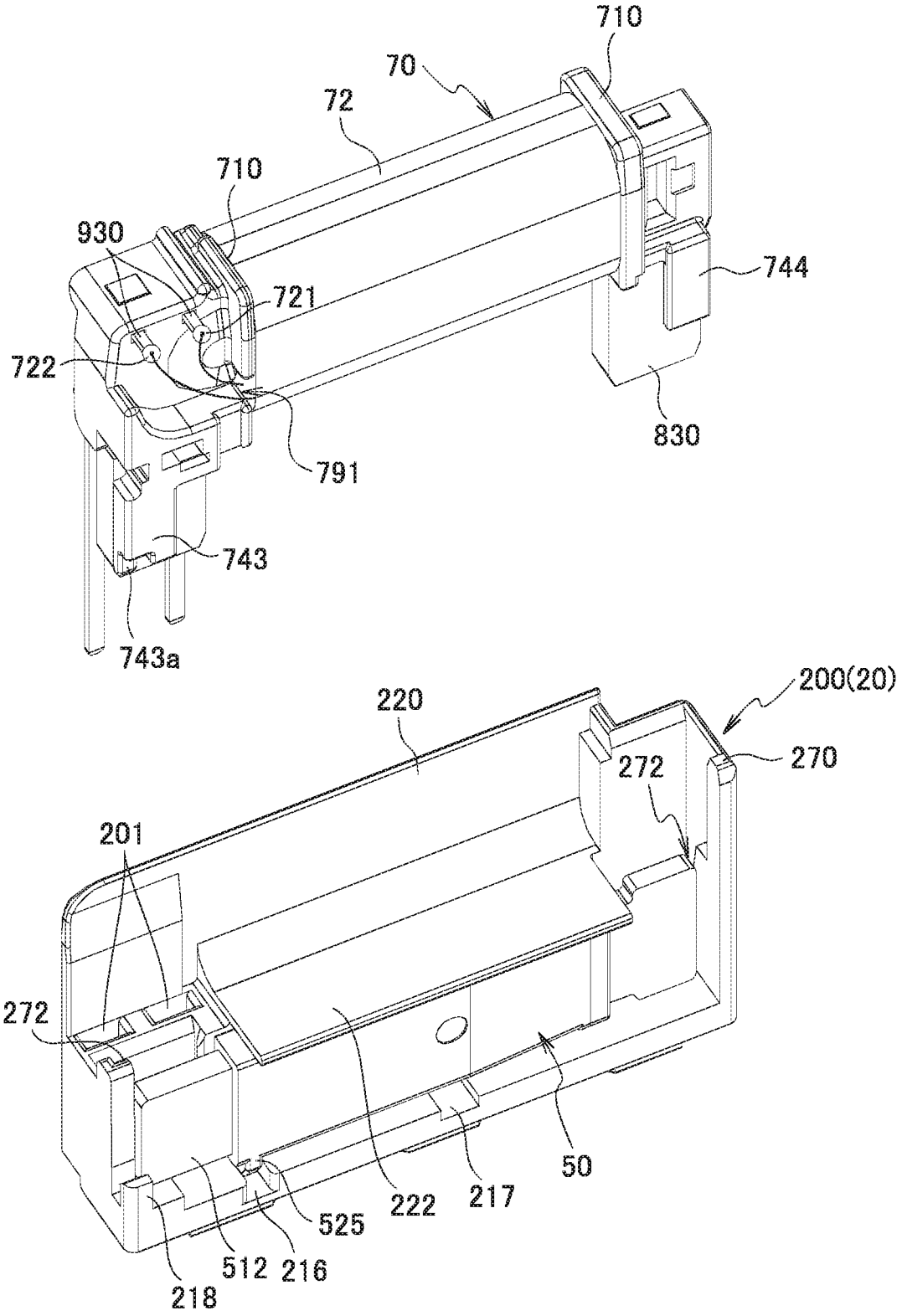
FIG. 31 is a view for illustrating a process of attaching the drive block to the base according to the first embodiment of the present invention.

In the present embodiment, an edge 222*a* of the partition wall 222 projects forward from the coil 72 and extends along the coil 72 from one end to the other end in the X direction (in the extending direction of the body portion 810) in a state in which the drive block 40 is fixed to the base 200 and the extending direction of the body portion 810 conforms to the horizontal direction (the X direction) (refer to FIGS. 30A-30C).

The partition wall 222 projects such that the entire coil 72 is located within the region of the partition wall 222 as viewed from above (refer to FIG. 30C).

In the present embodiment, the penetration hole 221 is located in the middle in the X direction of the partition wall 222.

Since the partition wall 222 extends along the entire coil 72, and the penetration hole 221 is provided in the middle in the X direction of the partition wall 222, an insulation distance "b" between both ends of the coil 72 and the contact block 60 via the penetration hole 221 can be increased (refer to FIG. 30B).

The present embodiment further increases the insulation distance between the both ends of the coil 72 and the contact block 60 via the penetration hole 221 in the middle in the X direction of the partition wall 222.

In particular, the movable body 520 is provided with an upper projection (a movable body-side projection: at least one of a movable body-side recess and a movable body-side projection) 523 at a portion opposed to the isolation wall 220.

The upper projection 523 is located between the partition wall 222 and the penetration hole 221 (the pressure projection 521) in the vertical direction when the armature block 50 is fixed to the base 200. The penetration hole 221 (the pressure projection 521) is located in the middle in the X direction of the upper projection 523.

A partition plate-side recess 261 into which the upper projection (the movable body-side projection) 523 is inserted is provided on the partition wall 222 at a position corresponding to the upper projection (the movable body-side projection) 523.

In a case in which the movable body 520 is provided with a movable body-side recess, the partition wall 222 is provided with a partition plate-side projection inserted into the movable body-side recess.

Figure 36:
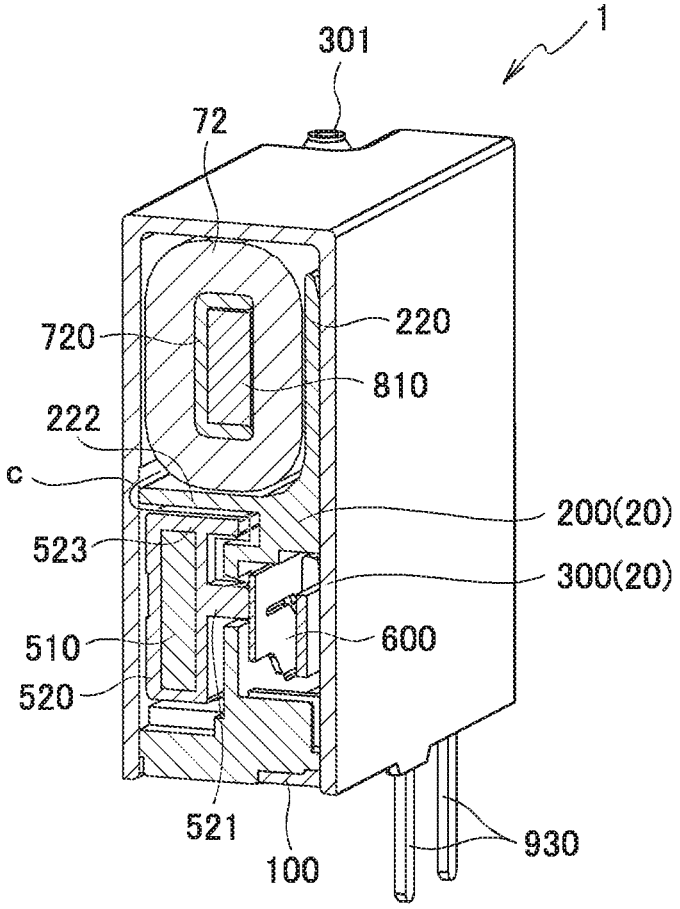
FIG. 36 is a cross-sectional view for illustrating an insulation distance from the coil to the movable contact portion in the electromagnetic relay according to the first embodiment of the present invention.

The upper projection (the movable body-side projection) 523 and the partition plate-side recess 261 into which the upper projection (the movable body-side projection) 523 is inserted, can increase an insulation distance "c" between the coil 72 and the contact block 60 via the penetration hole 221 in the middle in the X direction of the partition wall 222 (refer to FIG. 36).

In the present embodiment, the movable body 520 covers the entire circumference of the arm portion 511. More particularly, the armature 510 is covered with the movable body 520 from one end to the other end in the X direction, except for both sides of the armature 510 in the X direction (the support portion 512 and the magnetic pole 513) which are exposed to the outside.

Figure 18:
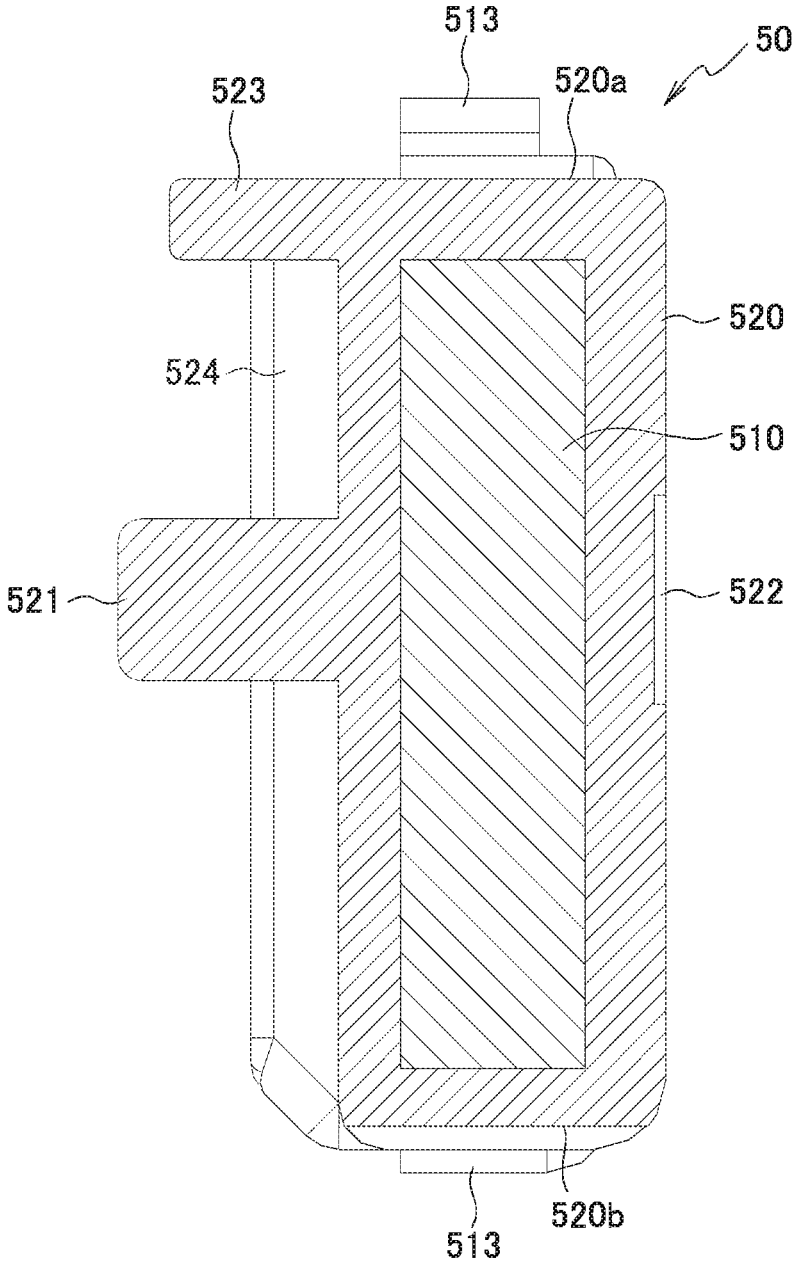
FIG. 18 is a cross-sectional view of the armature block according to the first embodiment of the present invention at a position corresponding to the pressure projection and the recess.
Figure 19A:
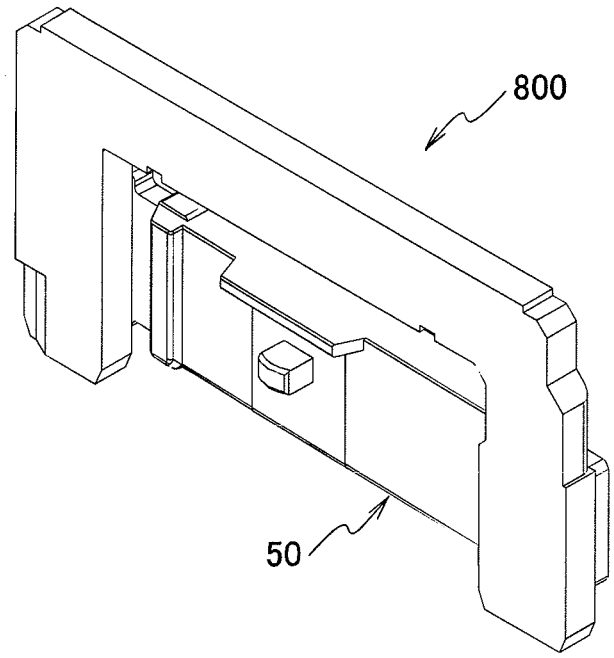
FIGS. 19A and 19B are views showing a positional relation between the iron core and the armature block according to the first embodiment of the present invention.
Figure 19B:
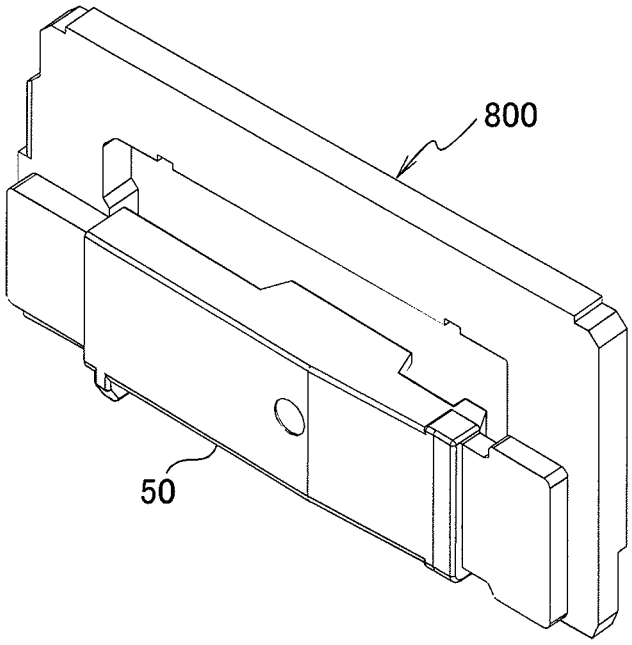
Figure 20:
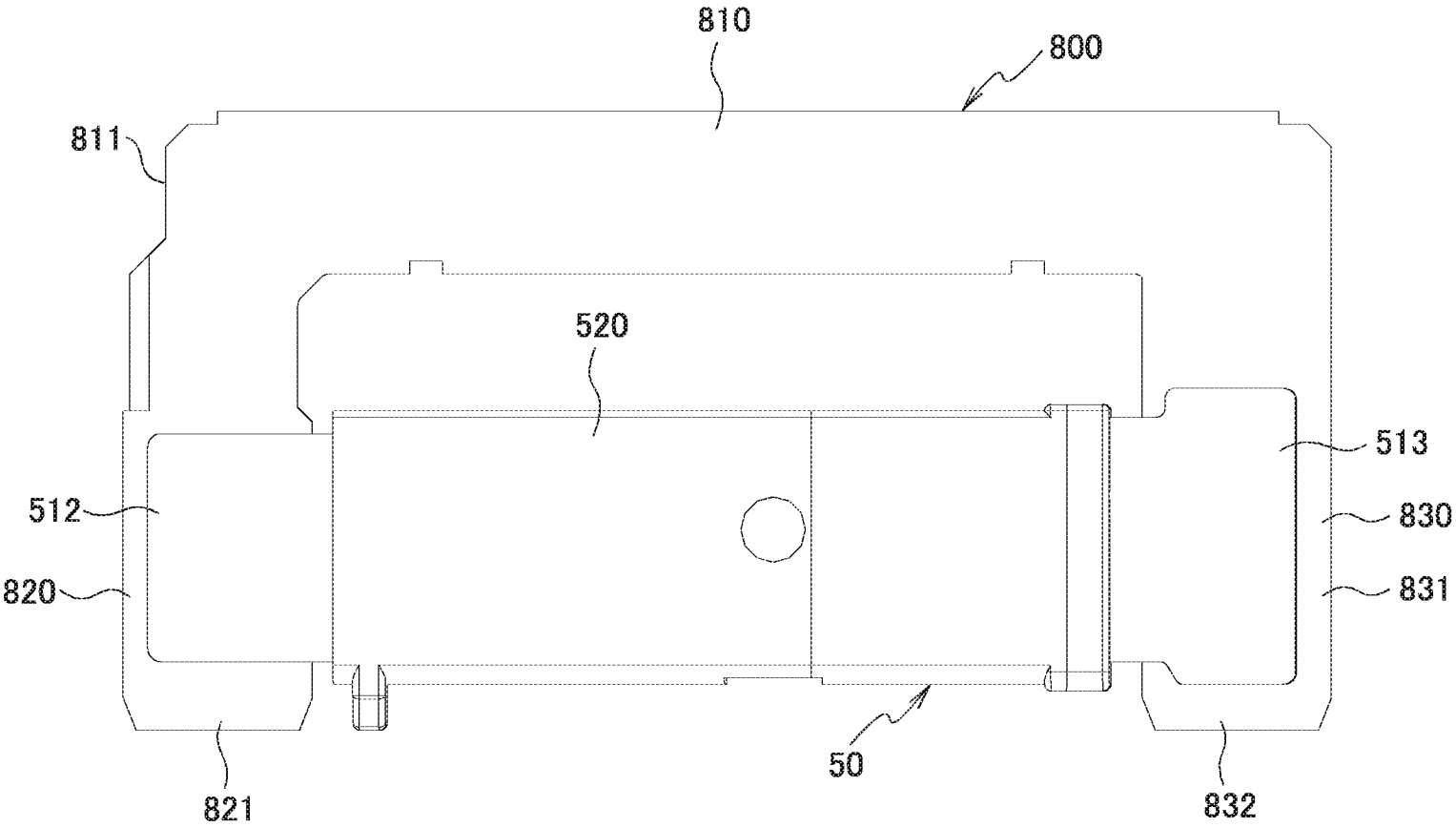
FIG. 20 is a side view showing a positional relation between the iron core and the armature block according to the first embodiment of the present invention as viewed from the armature block side.
Figure 21:
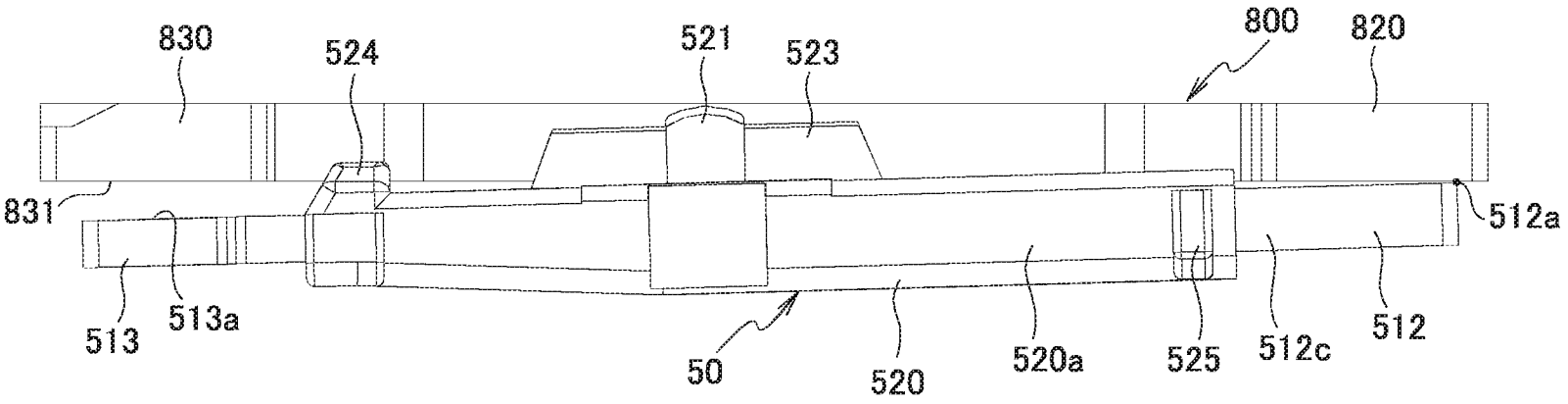
FIG. 21 is a view showing a positional relation between the iron core and the armature block according to the first embodiment of the present invention as viewed from the tip side of leg portions of the iron core.

Although the movable body 520 is provided with a recess 522 on the rear side of the pressure projection 521, the armature 510 is not exposed to the outside at a portion corresponding to the recess 522 (refer to FIG. 18).

The movable body 520 is provided with an elongated projection 524 elongated from the upper surface 520*a* to the lower surface 520*b* on the same side as the pressure projection 521 in the state in which the drive block 40 is fixed to the base 200 and the extending direction of the body portion 810 of the iron core 800 conforms to the horizontal direction (the X direction).

In the present embodiment, the pressure projection 521 is located at the position shifted from the center C3 of the armature 510 in the horizontal direction toward the magnetic pole 513 as viewed in the Y direction, and the elongated projection 524 is also located in the movable body 520 toward the magnetic pole 513.

The elongated projection 524 located in the movable body 520 toward the magnetic pole 513 can increase an insulation distance "d" between the magnetic pole 513 and the contact block 60 via the penetration hole 221 (refer to FIG. 34).

The isolation wall 220 is provided with an elongated recess 262 at a position corresponding to the elongated projection 524 so that the isolation wall 220 does not interferes with the elongated projection 524 when the armature block 50 swings.

The bottom base portion 210 is provided with a guide groove 216 on the armature block housing space 260 side. A guide projection 525 provided in the movable body 520 in the armature block 50 is introduced to the guide groove 216 so as to guide the armature block 50 upon swinging.

The bottom base portion 210 is further provided with a groove 217 on the armature block housing space 260 side in the middle in the X direction (at a position corresponding to the penetration hole 221). The groove 217 ensures an insulation distance between the coil 72 or the armature 510 and the contact block 60.

In the present embodiment, an upper edge 220*a* of the isolation wall 220 is located above the iron core 800 in the state in which the drive block 40 is fixed to the base 200 and the extending direction of the body portion 810 conforms to the horizontal direction (the X direction).

The iron core 800 is not exposed from the upper edge 220*a* of the isolation wall 220 when the isolation wall 220 is viewed in the direction in which the contact block 60 is fixed (as viewed in the Y direction). Thus, an insulation distance "e" between the iron core 800 (the drive block 40) and the contact block 60 can be increased (refer to FIG. 33).

The isolation wall 220 is further provided with a side wall 270 covering an end surface 800*a* of the iron core 800 in the extending direction of the body portion 810 (in the X direction) in the state in which the drive block 40 is fixed to the base 200 and the extending direction of the body portion 810 conforms to the horizontal direction (the X direction).

The end surface 800*a* is thus not exposed to the outside when the side wall 270 is viewed externally in the X direction (in the extending direction of the body portion 810).

Figure 33:
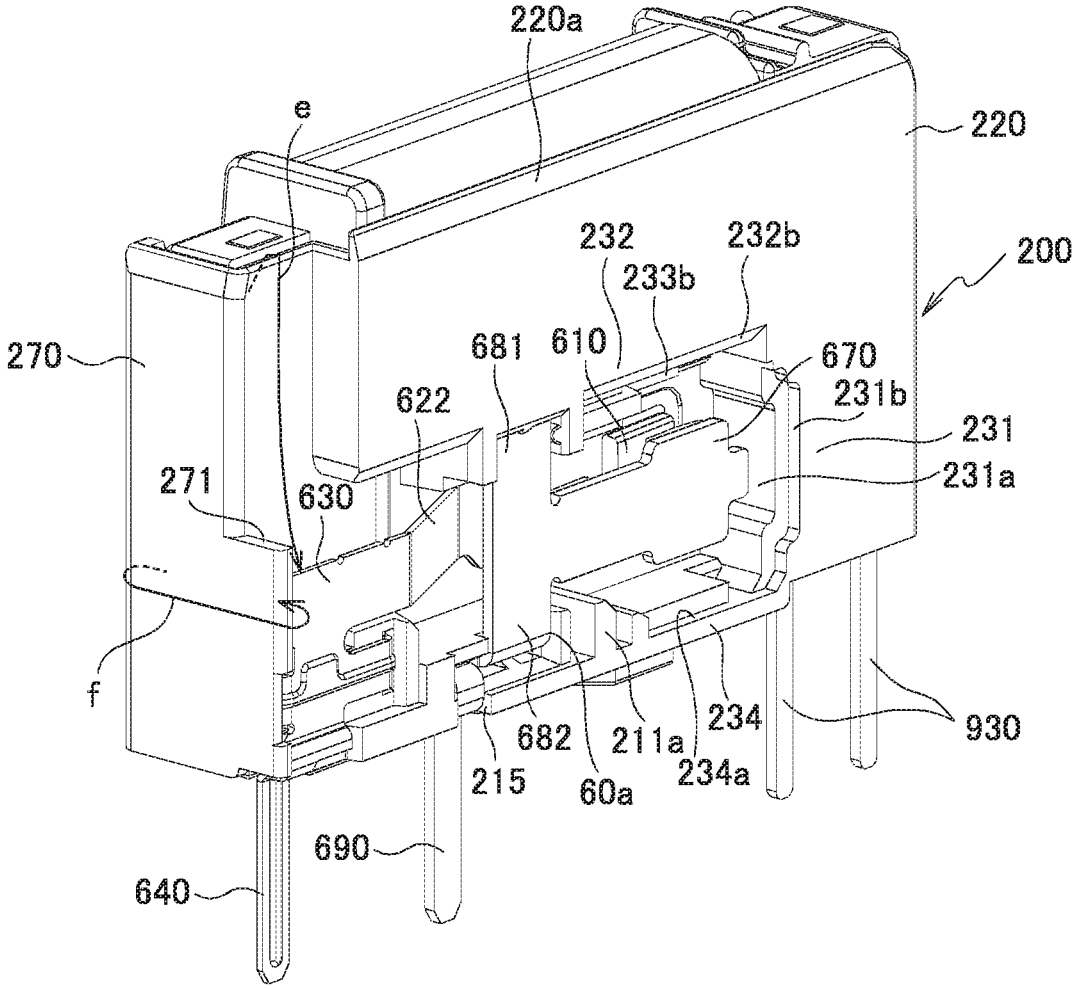
FIG. 33 is a perspective view for illustrating the process of attaching the contact block to the base according to the first embodiment of the present invention, showing a state in which a fixed contact portion is attached to the contact block housing space.
Figure 37:
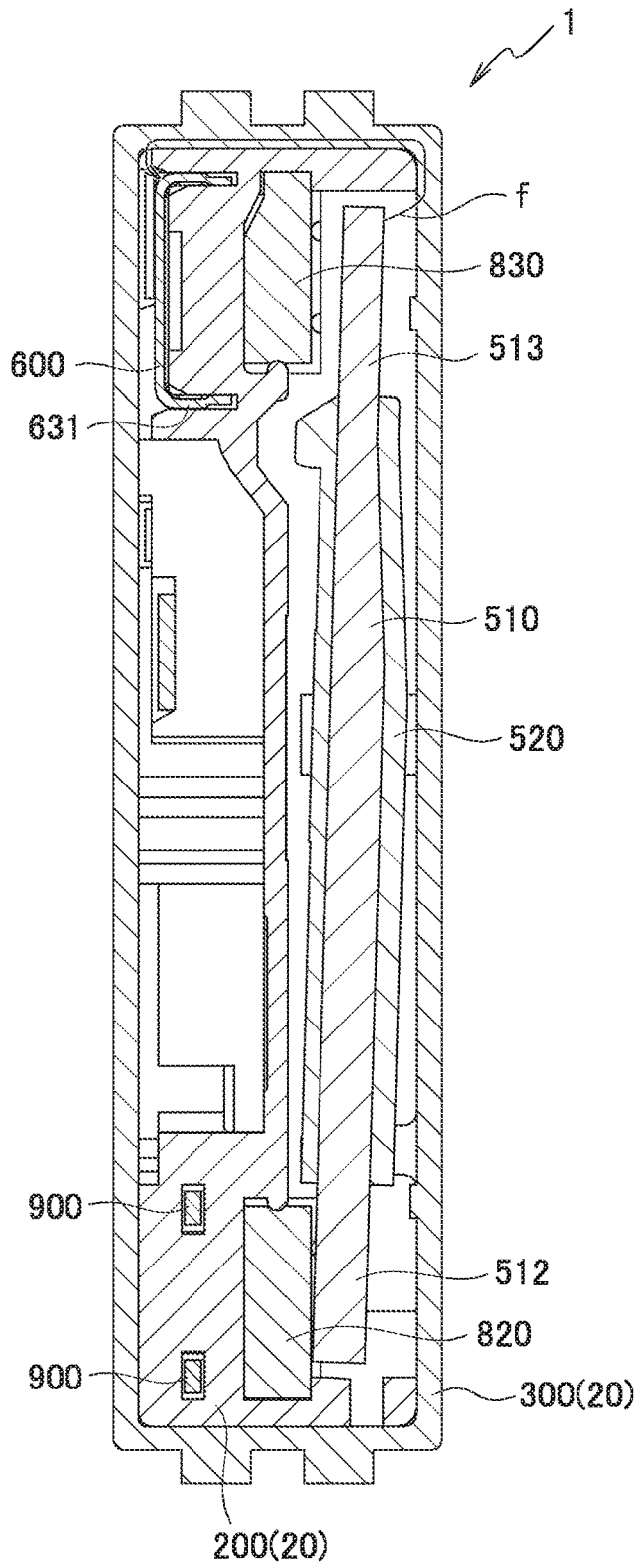
FIG. 37 is a cross-sectional for illustrating an insulation distance from an armature to the movable contact portion in the electromagnetic relay according to the first embodiment of the present invention.

Thus, an insulation distance "f" between the iron core 800 (the drive block 40) and the contact block 60 can be increased (refer to FIG. 33 and FIG. 37).

The side wall 270 is provided with an extension wall 271 covering an end surface 600*a* and an end surface 650*a* of the movable contact portion 600 and the fixed contact portion 650 in the X direction (in the extending direction of the body portion 810) in the state in which the contact block 60 is fixed to the base 200 and the extending direction of the body portion 810 conforms to the horizontal direction (the X direction).

The end surface 600*a* of the movable contact portion 600 and the end surface 650*a* of the fixed contact portion 650 are thus not exposed to the outside when the extension wall 271 is viewed externally in the X direction (in the extending direction of the body portion 810).

Thus, the insulation distance "f" between the armature 510 (the drive block 40) and the contact block 60 can further be increased.

The drive block 40 and the contact block 60 may be fixed to the base 200 in the following process.

First, the armature block 50 is housed in the armature block housing space 260 of the base 200. The armature block 50 is housed such that the pressure projection 521 is inserted to the penetration hole 221 and the guide projection 525 is inserted in the guide groove 216.

The coil block 70 is then inserted and fixed to the base 200 from above.

The base 200 is provided with coil terminal insertion holes 201 penetrating in the vertical direction along the isolation wall 220 toward the bottom base portion 210.

The base 200 is further provided with positioning portions 219 to which tips 821 and 832 of the leg portions 820 and 830 are inserted so as to position the iron core 800 in the base 200.

The side wall 271 of the base 200 is provided with guide grooves 272 for guiding the leg portions 820 and 830 to the positioning portions 219.

Thus, in the present embodiment, the coil block 70 is fixed to the base 200 such that the terminal portions 930 of the coil terminals 900 are inserted to the coil terminal insertion holes 201, and the leg portions 820 and 830 are guided by the guide grooves 272.

The tips 821 and 832 of the leg portions 820 and 830 are inserted to the positioning portions 219 while the support portion 512 of the armature block 50 is introduced to the space 70*a* and the magnetic pole 513 of the armature block 50 is introduced 70*b*, so that the coil block 70 is fixed to the base 200.

At the same time, the engagement edge 743*a* of the support portion-side projection piece (the positioning portion) 743 is engaged with the engagement projection 218 of the base 200.

In the present embodiment, the positioning of the coil block 70 on the base 200 is ensured on both the support portion 512 side and the magnetic pole 513 side so as to stabilize the strokes of the armature block 50, when the iron core 800 and the coil frame 700 are fixed to the base 200. The positioning on both sides can prevent the coil frame 700 and the base 200 from being bent, so as to further stabilize the strokes and operations of the armature block 50.

Figure 24A:
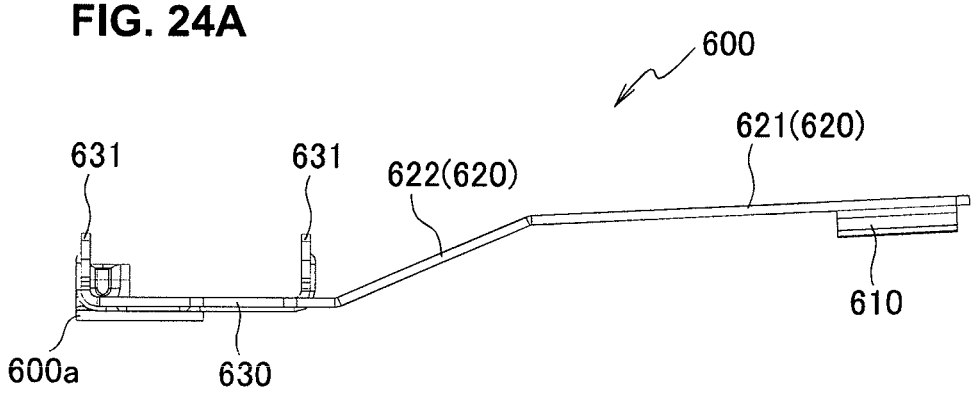
FIGS. 24A and 24B are views showing a movable contact portion according to the first embodiment of the present invention.
Figure 24B:
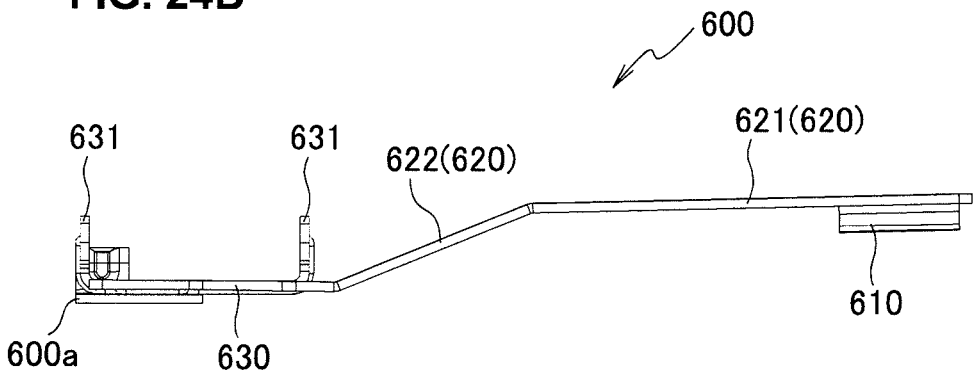

The press-fit pieces 631 of the movable contact portion 600 are then press-fitted to the press-fit grooves 212 of the base 200 on the armature block housing space 260 side (refer to FIG. 32). The movable contact portion 600 is thus fixed to the base 200 in a state in which the movable contacts 610 are housed in the armature block housing space 260. At the same time, the operation piece 621 of the plate spring 620 is pressed by the pressure projection 521, so that the movable contact portion 600 is switched from a free state as shown in FIG. 24A to a biased state as shown in FIG. 24B. Namely, in the present embodiment, in a state in which the operation piece 621 of the plate spring 620 is biased in a direction away from the fixed contacts 660, the movable contact portion 600 is fixed to the base 200.

In the state in which the movable contact portion 600 is fixed to the base 200, the press-fit piece 681 of the fixed contact portion 650 is press-fitted to the press-fit groove 223 of the base 200, and the press-fit piece 683 is press-fitted to the press-fit groove 214 of the base 200. The fixed contact portion 650 is thus fixed to the base 200 in a state in which the fixed contact 660 is housed in the armature block housing space 260 while being opposed to the movable contacts 610 (refer to FIG. 33).

The cover 300 is then attached to the base 200 from above and fixed with the adhesive 100, and the hole 301 is sealed by heat, so as to assembly the electromagnetic relay 1.

The process of fixing the drive block 40 and the contact block 60 to the base 200 is not limited to the process described above, although the coil block 70 should be fixed to the base 200 after the fixation of the armature block 50.

Next, the operations of the electromagnetic relay 1 are described below.

Figure 38:
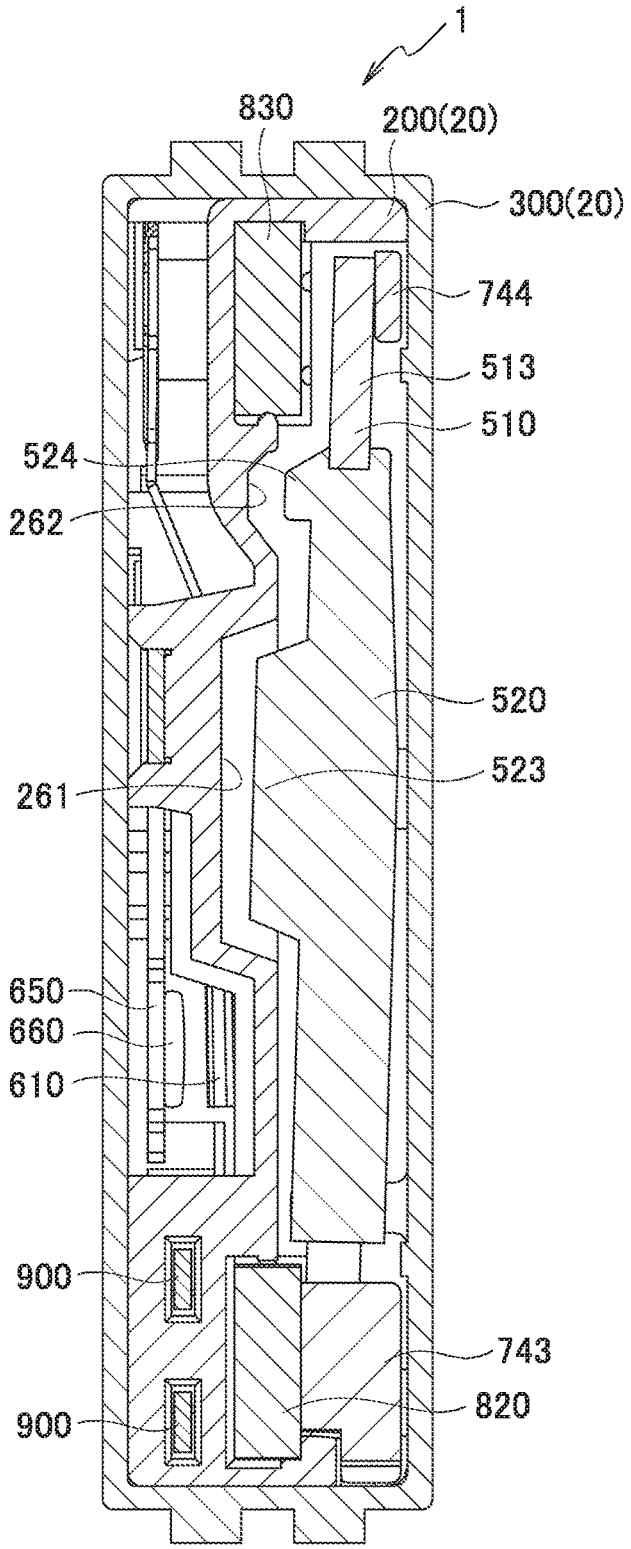
FIG. 38 is a cross-sectional view for illustrating a relation between an upper projection of the armature block and an isolation wall of the base in the electromagnetic relay according to the first embodiment of the present invention.

When a current is not applied to the coil 72 of the coil block 70 (in a non-conductive state), the armature block 50 is biased in a direction away from the isolation wall 220 due to a biasing force of the movable contact portion 600. Therefore, the movable contacts 610 and the fixed contact 660 are separated from each other, and the magnetic pole 513 of the armature block 50 is separated from the leg portion 830 of the iron core 800 (refer to FIG. 34). The movement (turn) of the magnetic pole 513 is restricted by the magnetic pole-side projection piece (the restriction portion) 744 (refer to FIG. 38).

When a current is applied to the coil 72 of the coil block 70 to excite the coil 72 (in a conductive state), a magnetic force is generated between the magnetic pole face 513*a* of the magnetic pole 513 and the magnetic pole face 831 of the leg portion 830, so that an attractive force acts on the magnetic pole 513 to move toward the leg portion 830. Namely, the armature block 50 turns on the axis 512*a* of the support portion 512.

The pressure projection 521 of the movable body 520 then moves in association with the turn of the armature block 50, so that the operation piece 621 of the movable contact portion 600 is pressed to move toward the fixed contact portion 650. As a result, the movable contacts 610 attached to the operation piece 621 are brought into contact with the fixed contact 660.

When the current application to the coil 72 is stopped (the conductive state is released), the movable contacts 610 are separated from the fixed contact 660 due to the biasing force of the movable contact portion 600, and the armature block 50 turns in the opposite direction, so that the magnetic pole 513 is separated from the leg portion 830.

Second Embodiment

An electromagnetic relay according to a second embodiment has a configuration basically similar to the electromagnetic relay 1 according to the first embodiment, but differs from the electromagnetic relay 1 according to the first embodiment in that a hinge spring 743A is attached to the coil frame 700.

Figure 39:
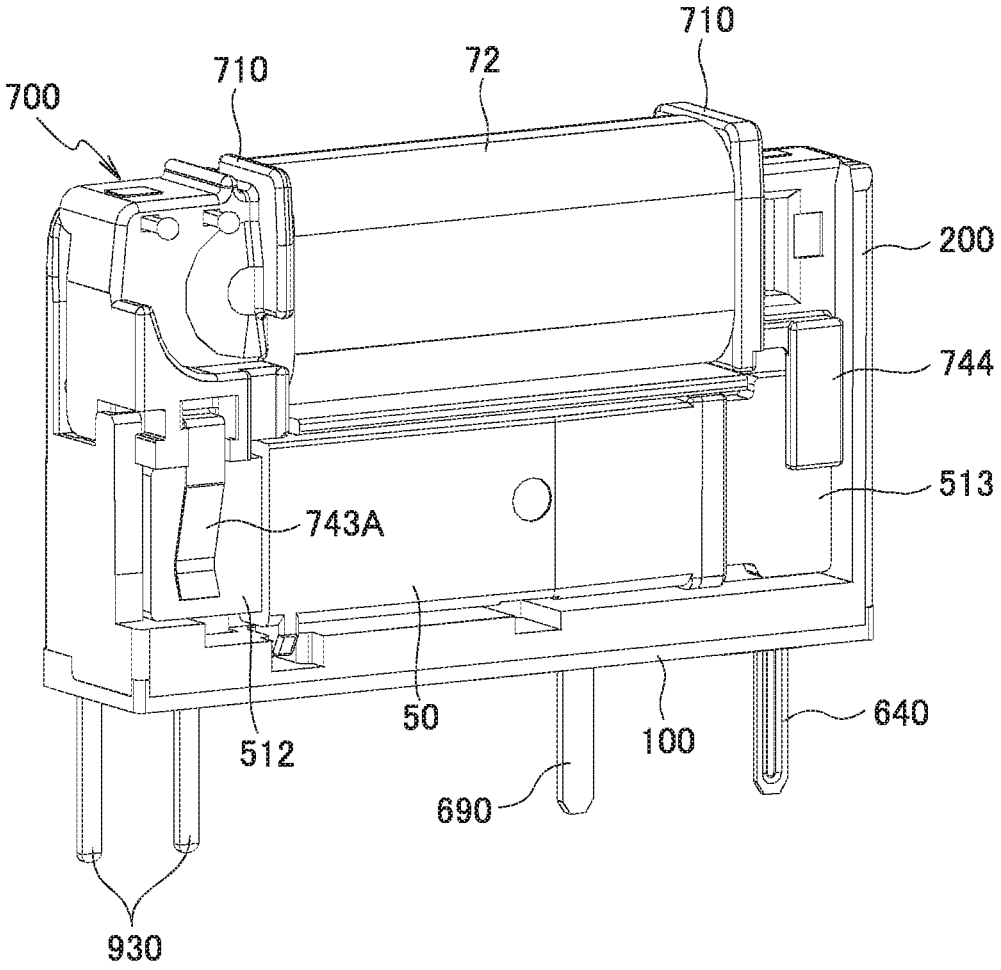
FIG. 39 is a perspective view showing an electromagnetic relay according to a second embodiment of the present invention with a cover removed.
Figure 40:
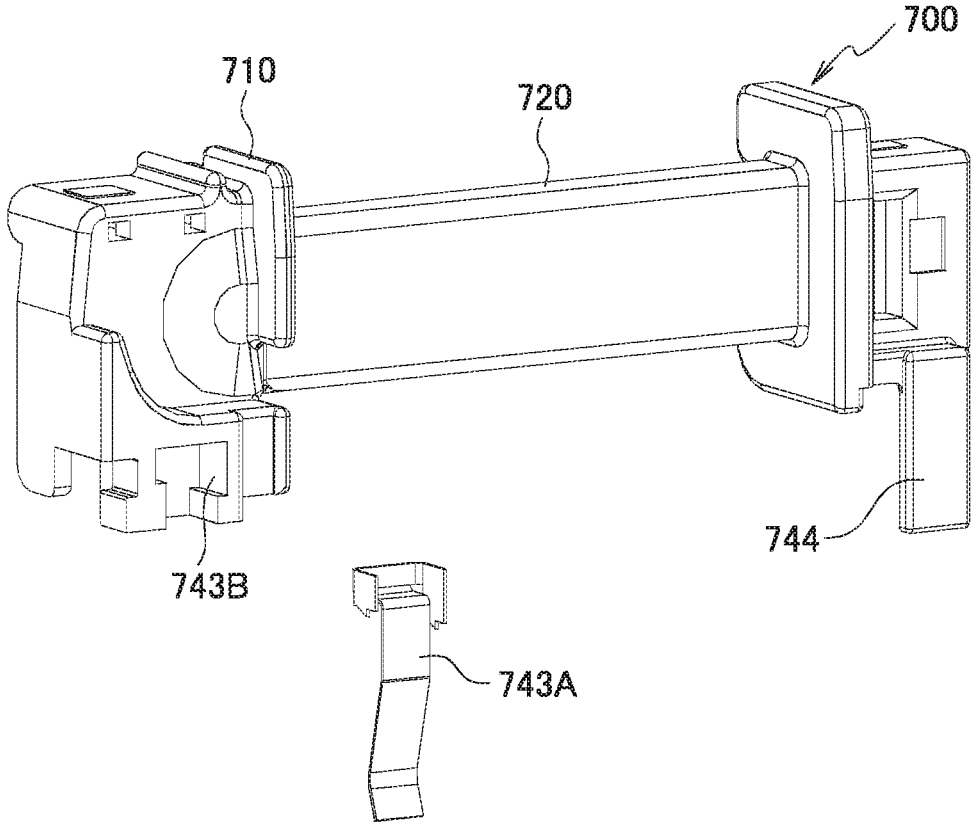
FIG. 40 is a perspective view showing a coil frame and a plate spring separated from each other according to the second embodiment of the present invention.
Figure 41:
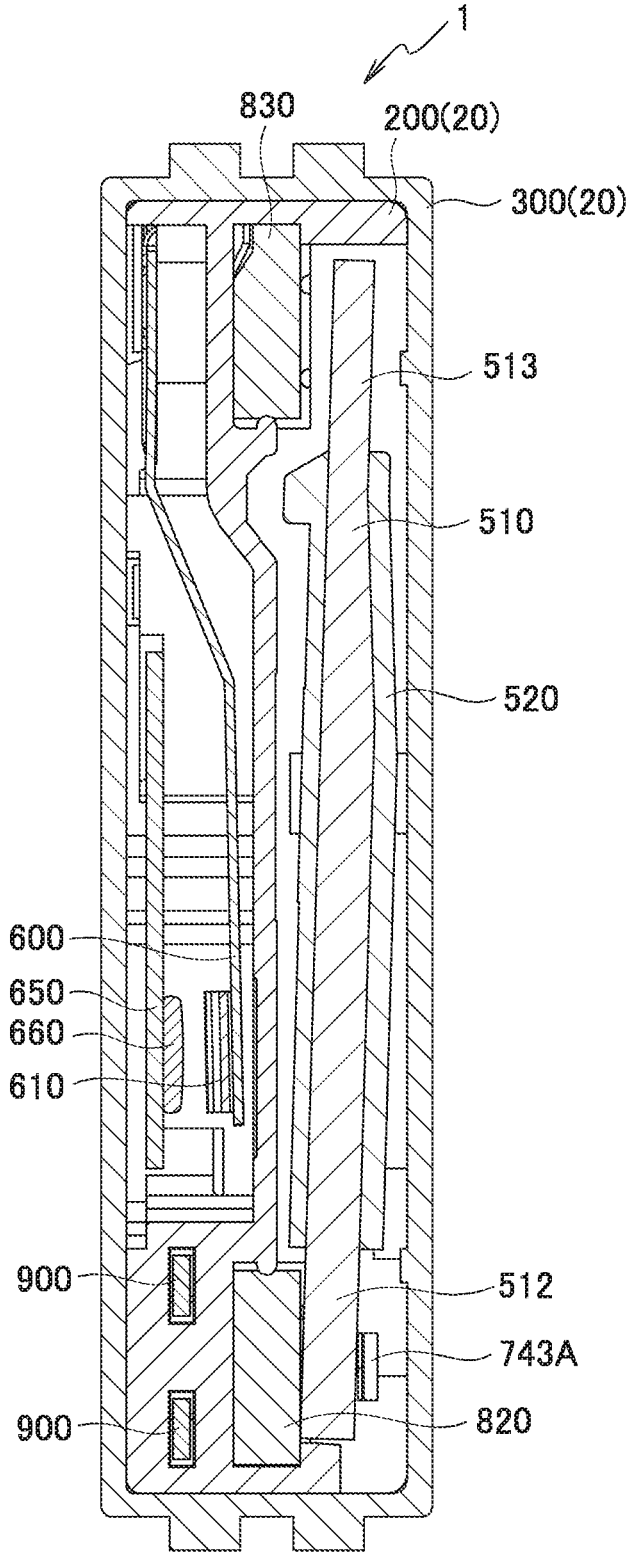
FIG. 41 is a cross-sectional view of the electromagnetic relay according to the second embodiment of the present invention, showing a state in which a support portion of an armature is supported by the plate spring and an iron core.
Figure 42:
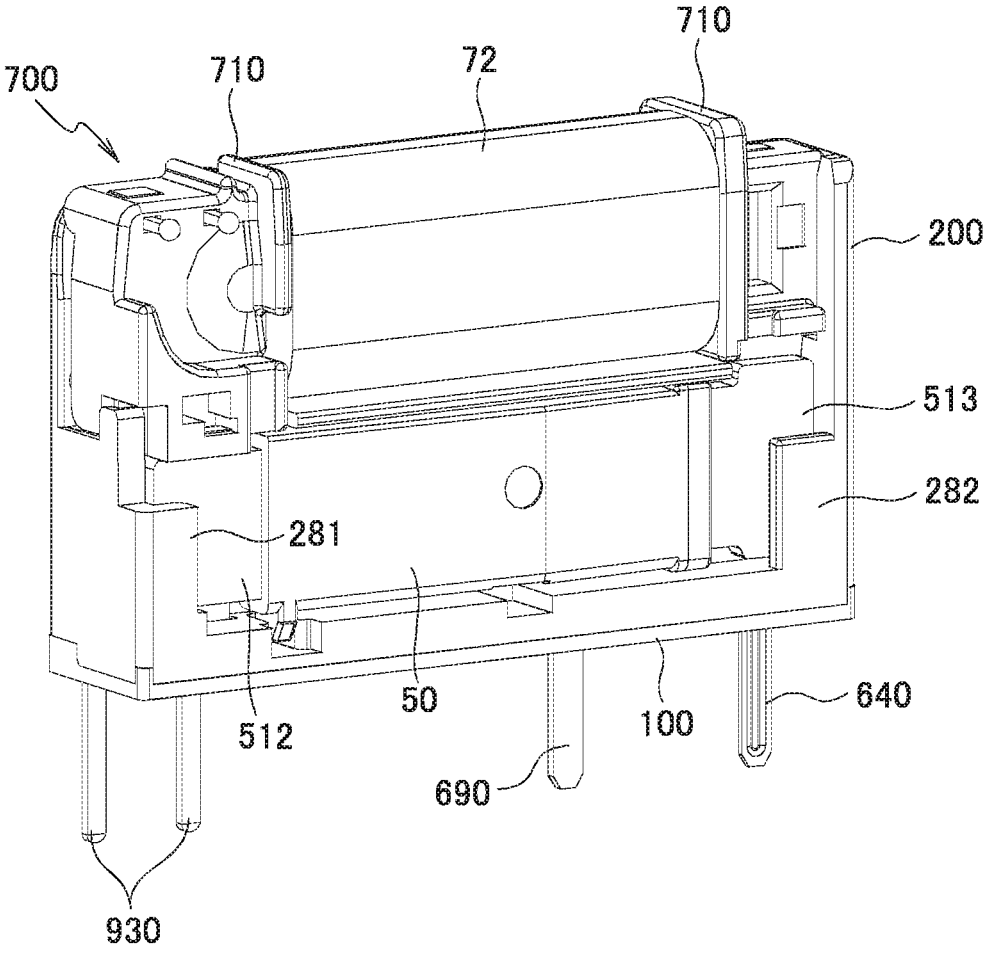
FIG. 42 is a perspective view showing an electromagnetic relay according to a third embodiment of the present invention with a cover removed.
Figure 43:
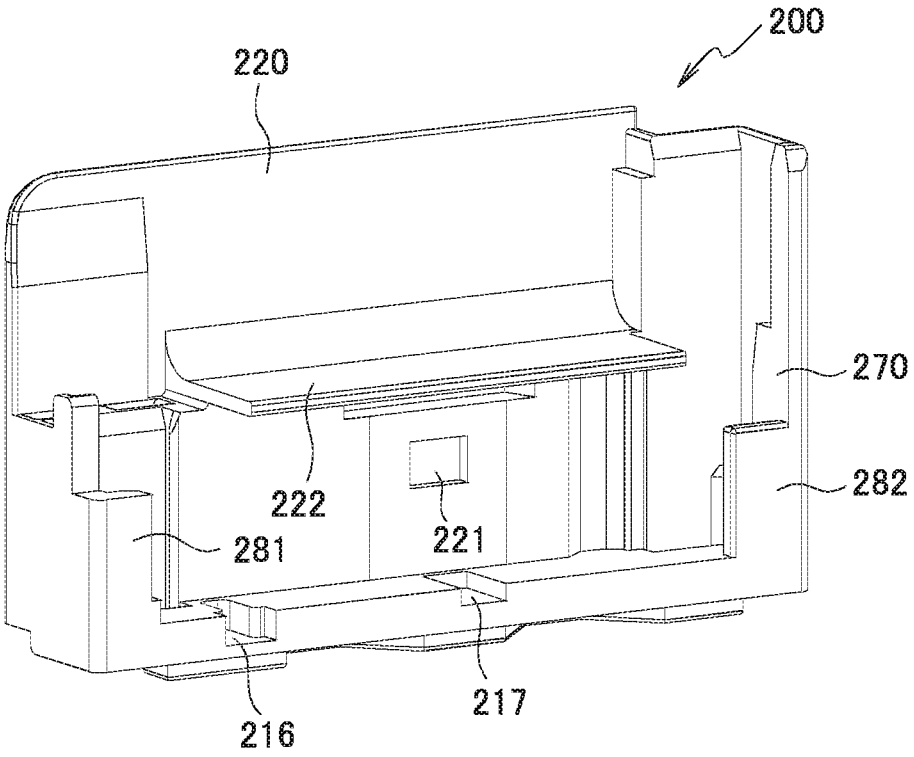
FIG. 43 is a perspective view showing a base according to the third embodiment of the present invention.

As shown in FIG. 39 and FIG. 40, the hinge spring 743A is attached to an attachment hole 743B provided on the coil frame 700, and is elongated downward therefrom.

The hinge spring 743A according to the present embodiment also positions the support portion 512 of the armature block 50, as in the case of the support portion-side projection piece 743 according to the first embodiment.

In the present embodiment, the hinge spring 743A presses the support portion 512 toward the leg portion 820 on one side of the iron core 800.

The hinge spring 743A thus can prevent the lower side of the support portion 512 from being lifted up.

The hinge spring 743A presses the support portion 512 in the middle in the vertical direction in the side view (as viewed in the Y direction) in the state in which the extending direction of the arm portion 511 conforms to the horizontal direction and the width direction of the arm portion 511 conforms to the vertical direction.

The hinge spring 743A pressing the support portion 512 in the middle in the vertical direction can prevent the armature block 50 from being inclined, since the pressure is applied adjacent to the center of gravity and the center of magnetic force of the support portion 512.

Third Embodiment

An electromagnetic relay according to a third embodiment has a configuration basically similar to the electromagnetic relay 1 according to the first embodiment, but differs from the electromagnetic relay 1 according to the first embodiment in that the support portion 512 is positioned by both the leg portion 820 on one side of the iron core 800 and a positioning portion 281 provided in the base 200.

The present embodiment also differs from the first embodiment in that the base 200 is provided with a restriction portion 282 for restricting a swing movement of the magnetic pole 513 in a direction away from the other leg portion 830 of the iron core 800.

Figure 44:
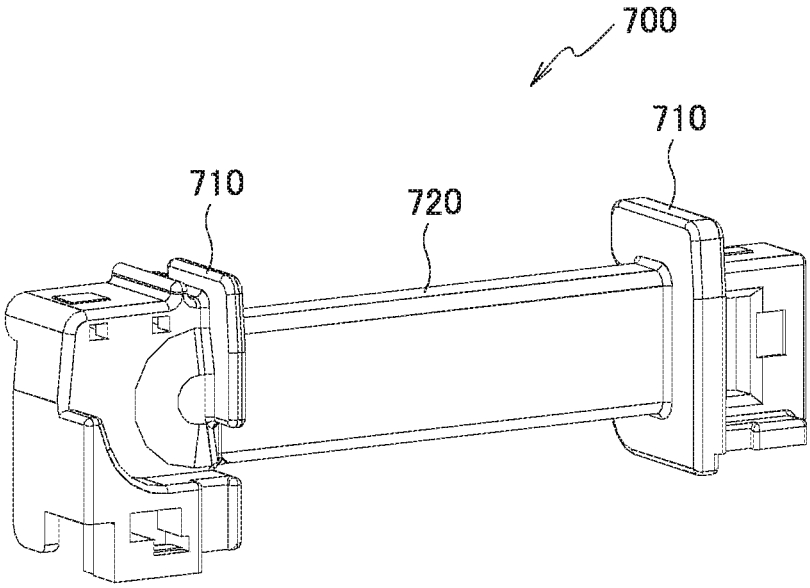
FIG. 44 is a perspective view showing a coil frame according to the third embodiment of the present invention.
Figure 45:
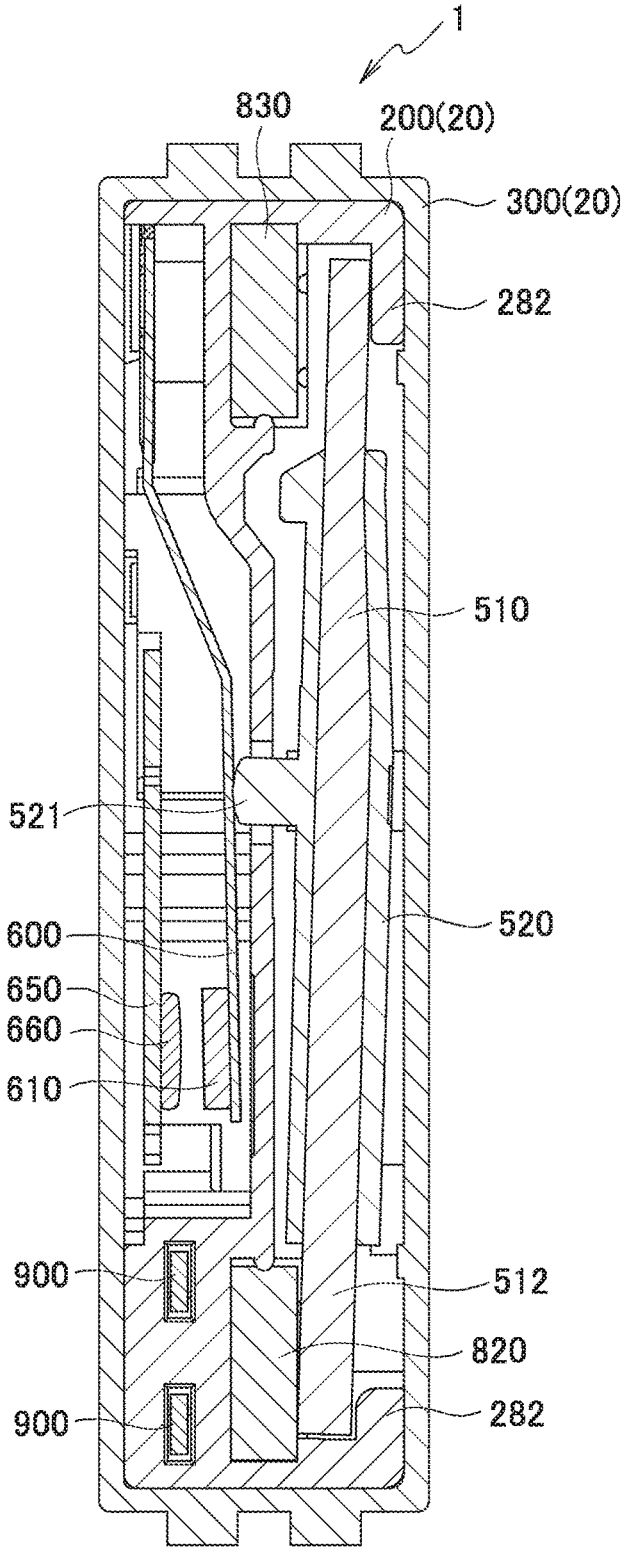
FIG. 45 is a cross-sectional view of the electromagnetic relay according to the third embodiment of the present invention, showing a state in which a support portion of an armature is supported by the base and an iron core.

In the present embodiment, since the positioning portion and the restriction portion are both provided in the base 200, the coil frame 700 is not provided with the support portion-side projection piece 743 or the magnetic pole-side projection piece 744, as shown in FIG. 44.

The present embodiment in which the positioning portion 281 and the restriction portion 282 are provided in the base 200 can minimize unevenness due to dimensional errors, so as to further improve the operational stability.

Fourth Embodiment

An electromagnetic relay according to a fourth embodiment has a configuration basically similar to the electromagnetic relay 1 according to the first embodiment, but differs from the electromagnetic relay 1 according to the first embodiment in that the coil frame 700 and the iron core 800 are integrally formed by insert molding.

Figure 46:
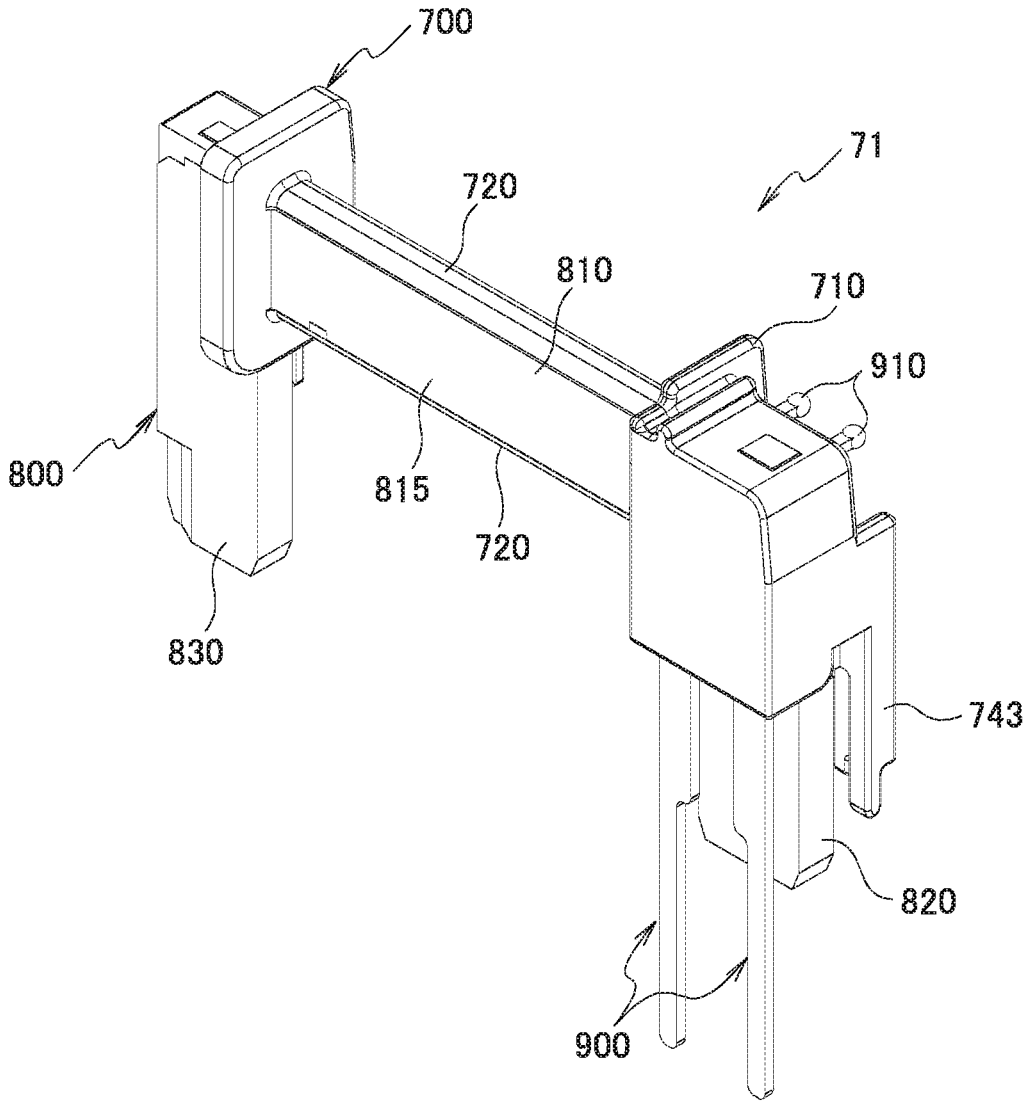
FIG. 46 is a perspective view showing a coil frame block according to a fourth embodiment of the present invention.
Figure 47:
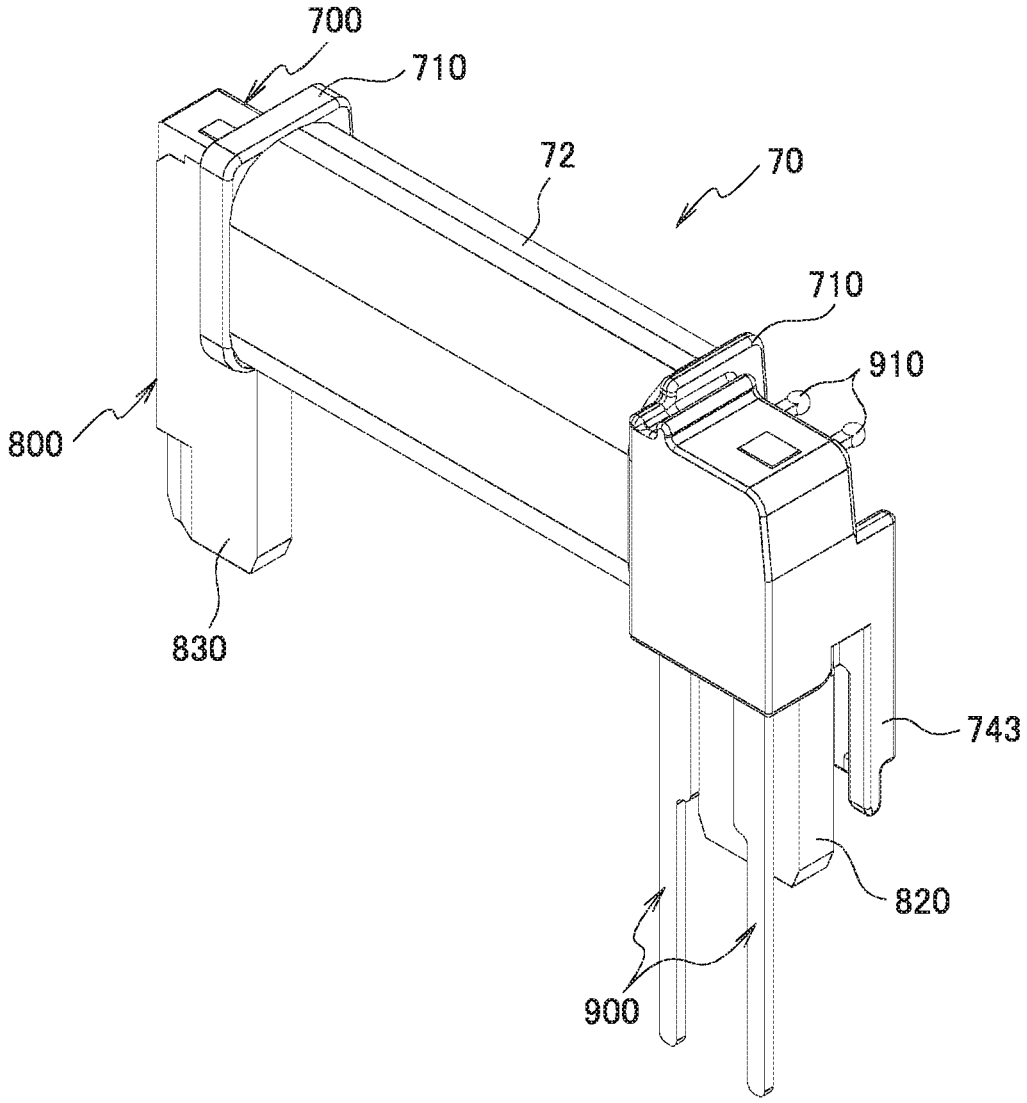
FIG. 47 is a perspective view showing a coil block according to the fourth embodiment of the present invention.

In the present embodiment, the coil terminals 900 are also integrally formed by insert molding, so as to integrate the coil frame block 71, as shown in FIG. 46.

The integration of at least the coil frame 700 and the iron core 800 by insert molding eliminates the process of fixing the iron core 800 to the coil frame 700, so as to facilitate the production method. Further, the insert molding can improve the accuracy of integration as compared with the case in which the iron core 800 is fixed to the coil frame 700.

In the case in which the iron core 800 is fixed to the coil frame 700, it is necessary to increase the rigidity of the body portion 720 of the coil frame 700 in order to prevent deformation of the coil frame 700. In contrast, the insert molding according to the present invention need not increase the rigidity of the body portion 720.

In contrast to the first embodiment, the three surfaces of the body portion 810 of the iron core 800 (the upper surface 812, the lower surface 813, and one side surface 814) are not necessarily covered with the body portion 720. In other words, only two surfaces separated from each other in the body portion 810 of the iron core 800 may be covered with the coil frame 700.

Figure 48:
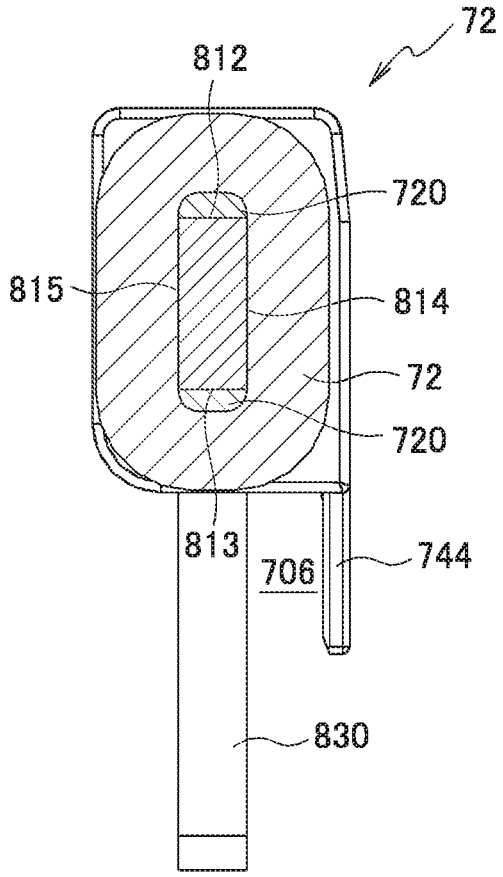
FIG. 48 is a cross-sectional view of the coil block according to the fourth embodiment of the present invention, showing a state in which a coil is wound on the coil frame block.

In the present embodiment, the upper surface 812 and the lower surface 813 (the two surfaces separated from each other) are only covered with the body portion 720 of the coil frame 700, as shown in FIG. 48.

Since the side surfaces 814 and 815 are not covered with the body portion 720, a larger amount of the coil 72 is wound on the body portion 810, so as to increase the magnetic force without an increase in size of the coil block 70.

While the present invention has been described above by reference to the preferred embodiments, the present invention is not intended to be limited to those embodiments, and various modifications will be apparent to those skilled in the art.

For example, the base, the contact block, and other specifications (such as the shape, size, and layout) may be varied as appropriate.

This application claims the benefit of priority from Japanese Patent Applications No. 2015-153745, No. 2015-153749, and No. 2015-153750, each filed on Aug. 3, 2015, the entire contents of which are incorporated by reference herein.

INDUSTRIAL APPLICABILITY

The present invention can provide an electromagnetic relay capable of achieving improved operational stability.

The invention claimed is:

1. An electromagnetic relay comprising:

a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact, the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween;

an armature arranged across the iron core from one leg portion to another leg portion and configured to swing on one end serving as an axis; and a movable body configured to move in association with a swing of the armature, the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the movable body being attached to the arm portion and provided with a pressure projection for moving the movable contact, the pressure projection being located on a segment connecting a center of gravity of the support portion and a center of gravity of the magnetic pole.

2. The electromagnetic relay according to claim 1, wherein the segment is substantially horizontal in a side view in a state in which an extending direction of the arm portion conforms to the horizontal direction and a width direction of the arm portion conforms to a vertical direction.

3. The electromagnetic relay according to claim 1, wherein an upper surface and a lower surface of the support portion are closer to a middle of the movable body in a vertical direction than an upper surface and a lower surface of the movable body in a side view in a state in which an extending direction of the arm portion conforms to the horizontal direction and a width direction of the arm portion conforms to a vertical direction.

4. The electromagnetic relay according to claim 1, wherein:

the movable contact portion includes a plate spring provided with the movable contact and having a plate thickness and a plate width;

the pressure projection presses the plate spring; and a pressure region of the pressure projection in a plate width direction of the plate spring has a width less than or equal to half of the plate width of the plate spring.

5. The electromagnetic relay according to claim 1, wherein the armature is substantially symmetrical with respect to a horizontal line passing through a middle in a vertical direction in a side view in a state in which an extending direction of the arm portion conforms to the horizontal direction and a width direction of the arm portion conforms to the vertical direction.

6. The electromagnetic relay according to claim 1, wherein an upper surface and a lower surface of the support portion are flat surfaces in a side view in a state in which an extending direction of the arm portion conforms to the horizontal direction and a width direction of the arm portion conforms to a vertical direction.

7. The electromagnetic relay according to claim 1, wherein a hinge spring is attached to the coil frame, and the hinge spring presses the support portion toward the one leg portion of the iron core.

8. The electromagnetic relay according to claim 7, wherein the hinge spring presses a middle of the support portion in a vertical direction in a side view in a state in which an extending direction of the arm portion conforms to the horizontal direction and a width direction of the arm portion conforms to the vertical direction.

9. An electromagnetic relay comprising:

a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact, the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween;

an armature arranged across the iron core from one leg portion to another leg portion and configured to swing on one end serving as an axis; and a movable body configured to move in association with a swing of the armature, the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the movable body being attached to the arm portion and provided with a pressure projection for moving the movable contact, the pressure projection being located on a segment connecting a center of magnetic force of the support portion and a center of magnetic force of the magnetic pole.

10. An electromagnetic relay comprising:

a contact block including a fixed contact portion provided with a fixed contact, and a movable contact portion provided with a movable contact brought into contact with and separated from the fixed contact; and a drive block configured to bring the movable contact into contact with the fixed contact and separate the movable contact from the fixed contact, the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween;

an armature arranged across the iron core from one leg portion to another leg portion and configured to swing on one end serving as an axis; and a movable body configured to move in association with a swing of the armature, the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the movable body being attached to the arm portion and provided with a pressure projection for moving the movable contact, the pressure projection being located at a position shifted from a center of the armature in the horizontal direction toward the magnetic pole in a side view in a state in which an extending direction of the arm portion conforms to the horizontal direction and a width direction of the arm portion conforms to a vertical direction.

11. An electromagnetic relay comprising:

a contact block including a fixed contact and a movable contact brought into contact with and separated from the fixed contact;

a drive block configured to bring the movable contact into contact with the fixed contact and separate the movable contact from the fixed contact; and a base to which the contact block and the drive block are fixed, the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween; and an armature arranged across the iron core from one leg portion to another leg portion and configured to swing on one end serving as an axis, the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the support portion being positioned by the one leg portion of the iron core and a positioning portion provided in at least one of the coil frame and the base, wherein the drive block includes a movable body configured to move in association with a swing of the armature;

the movable body is attached to the arm portion; and an upper surface and a lower surface of the support portion are closer to a middle of the movable body in a vertical direction than an upper surface and a lower surface of the movable body in a side view in a state in which an extending direction of the arm portion conforms to the horizontal direction and a width direction of the arm portion conforms to the vertical direction.

12. The electromagnetic relay according to claim 11, wherein the support portion is positioned by the one leg portion of the iron core and the positioning portion provided in the coil frame.

13. The electromagnetic relay according to claim 11, wherein the base is provided with positioning portions to which tips of the leg portions are inserted so as to position the iron core in the base, and a side wall of the base is provided with a guide groove for guiding the leg portions to the positioning portions.

14. The electromagnetic relay according to claim 11, wherein the coil frame is provided with a groove in which the iron core is inserted, and a wall defining the groove is provided with a press-fit rib projecting toward the groove.

15. The electromagnetic relay according to claim 11, wherein the coil frame is provided with a groove in which the iron core is inserted, and a wall defining the groove is provided with a projection for preventing the iron core inserted in the groove from moving in a direction in which the iron core is removed.

16. The electromagnetic relay according to claim 15, wherein the wall defining the groove is provided, at a position corresponding to the projection, with a clearance on which the entire projection is exposed as viewed in a direction in which the iron core is inserted in the groove.

17. The electromagnetic relay according to claim 11, wherein the coil frame and the iron core are integrally formed by insert molding.

18. The electromagnetic relay according to claim 17, wherein two surfaces of the body portion separated from each other are only provided with the coil frame.

19. An electromagnetic relay comprising:

a contact block including a fixed contact and a movable contact brought into contact with and separated from the fixed contact;

a drive block configured to bring the movable contact into contact with the fixed contact and separate the movable contact from the fixed contact and a base to which the contact block and the drive block are fixed;

the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween; and an armature arranged across the iron core from one leg portion to another leg portion and configured to swing on one end serving as an axis the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the support portion being positioned by the one leg portion of the iron core and a positioning portion provided in at least one of the coil frame and the base, wherein at least one of the coil frame and the base is provided with a restriction portion wherein a restriction portion is provided in the coil frame, the restriction portion restricting a swing movement of the magnetic pole in a direction away from the other leg portion of the iron core.

20. An electromagnetic relay comprising:

a contact block including a fixed contact and a movable contact brought into contact with and separated from the fixed contact;

a drive block configured to bring the movable contact into contact with the fixed contact and separate the movable contact from the fixed contact and a base to which the contact block and the drive block are fixed;

the drive block including:

an iron core including a body portion extending in one direction, and leg portions extending downward from both ends in an extending direction of the body portion in a state in which the extending direction of the body portion conforms to a horizontal direction;

a coil frame to which the iron core is fixed;

a coil wound on the body portion of the iron core with the coil frame interposed therebetween; and an armature arranged across the iron core from one leg portion to another leg portion and configured to swing on one end serving as an axis the armature including:

a support portion opposed to the one leg portion of the iron core to serve as the axis;

a magnetic pole opposed to the other leg portion of the iron core; and an arm portion extending to connect the support portion and the magnetic pole and configured to cause the magnetic pole to swing on the support portion so as to come close to and separate from the other leg portion of the iron core, the support portion being positioned by the one leg portion of the iron core and a positioning portion provided in at least one of the coil frame and the base, wherein at least two resin gate spots are provided in the coil frame, and the two resin gate spots are located adjacent to flanges formed in the coil frame.

21. The electromagnetic relay according to claim 20, wherein an expanded portion is provided in the coil frame on a rear side of one of the resin gate spots.

* * * * *